US005938252A

United States Patent [19]

Uemura et al.

[11] Patent Number: 5,938,252

[45] Date of Patent: Aug. 17, 1999

[54] DOOR MEMBER LOCKING/UNLOCKING APPARATUS

[75] Inventors: Keiichi Uemura, Kariya; Mitsuhiro Kondo, Kosai, both of Japan

[73] Assignee: ASMO Co., Ltd., Shizuoka-ken, Japan

[21] Appl. No.: 08/916,988

[22] Filed: Aug. 21, 1997

[30] Foreign Application Priority Data

| | | | |
|---|---|---|---|
| Aug. 22, 1996 | [JP] | Japan | 8-221427 |
| Nov. 27, 1996 | [JP] | Japan | 8-316640 |
| Jun. 17, 1997 | [JP] | Japan | 9-159748 |
| Jun. 17, 1997 | [JP] | Japan | 9-159749 |
| Jun. 17, 1997 | [JP] | Japan | 9-159750 |
| Jun. 17, 1997 | [JP] | Japan | 9-159751 |

[51] Int. Cl.[6] ..... E05C 3/06

[52] U.S. Cl. ..... 292/201; 292/216; 292/DIG. 23

[58] Field of Search ..... 292/201, 216, 292/DIG. 23

[56] References Cited

U.S. PATENT DOCUMENTS

| | | | |
|---|---|---|---|
| 4,948,183 | 8/1990 | Yamada | 292/201 |
| 5,180,198 | 1/1993 | Nakamura et al. | 292/201 |
| 5,288,115 | 2/1994 | Inoue et al. | 292/201 |
| 5,564,761 | 10/1996 | Mizuki et al. | 292/201 |
| 5,639,130 | 6/1997 | Rogers, Jr. et al. | 292/201 |

FOREIGN PATENT DOCUMENTS

| | | |
|---|---|---|
| 58-83777 | 5/1983 | Japan . |
| 58-153873 | 9/1983 | Japan . |
| 58-178778 | 10/1983 | Japan . |
| 59-8462 | 1/1984 | Japan . |
| 60-148974 | 8/1985 | Japan . |
| 2-30871 | 7/1988 | Japan . |
| 5-27748 | 4/1993 | Japan . |
| 2503445 | 4/1996 | Japan . |
| 2515711 | 8/1996 | Japan . |

*Primary Examiner*—Suzanne Dino Barrett
*Assistant Examiner*—Teri Pham
*Attorney, Agent, or Firm*—Sheridan Ross P.C.

[57] ABSTRACT

A door member locking/unlocking apparatus comprises a motor for driving an output shaft rotationally, and a latch rotatably hinged in a position to engage with a striker for retaining a door member in a closed state and urged in a direction to disengage from the striker. A first ratchet regulates the latch in a partially latched position and in a fully latched position. A second ratchet turns the latch from the partially latched position to the fully latched position. An engaging pin provided on the first ratchet releases the retention of the latch in the fully latched position by the first ratchet. A cam is arranged to have an axis of rotation in parallel with that of the latch. The cam is rotationally driven by the motor for actuating the second ratchet and the engaging pin.

22 Claims, 45 Drawing Sheets

DOOR MEMBER LOCKING/UNLOCKING APPARATUS

BACKGROUND OF THE INVENTION

The present invention relates to a door member locking/unlocking apparatus such as a door closing apparatus for forcibly closing a door member such as a side door or a trunk door of an automobile to a fully latched state when it detects that the door member is not fully latched (or partially latched).

When the side door of an automobile is to be closed, a weather strip reaction or a locking resistance acts immediately before the full closure so that a considerable force is required for closing out the door. This may frequently leave the door partially (or not fully) latched. Then, the door has to be troublesomely closed again. This trouble can likewise occur in the trunk door, too.

In order to solve this problem, there has been known a door closing apparatus for forcibly closing the side door (or trunk door) into the fully latched state when it detects that the door is partially latched. Usually, the door closing apparatus is provided with two functions: an unlocking function for unlocking the doors and a forcibly latching function for forcibly latching the lock from a partially latched position to a fully latched position. These functions are individually controlled in the prior art using two actuators. This use enlarges the size of the door closing apparatus and raises the production cost. Another problem is that the use raises a factor to reduce the capacity of the trunk.

In order to solve these problems, there has been disclosed in Japanese Patent Publication No. 27748/1993, for example, a door locking apparatus (or a door closing apparatus) which is equipped with one actuator for performing the unlocking function and the forcibly latching function.

As shown in FIG. 57, a door locking mechanism 81, as mounted in a door, is equipped with a latch 83 which is so hinged on a pin 84 as is normally urged counter-clockwise of FIG. 57. The latch 83 has a recess 83*a* capable of restricting a striker 82. If the force to be applied for closing the door is relatively weak, the latch 83 is not turned, even it abutting against the striker 82, so far as the partially latched position, as shown in FIG. 57(*a*). As a result, the latch 83 is regulated in the position where its pole 85 is retained. If the force to be applied for closing the door is relatively strong, on the other hand, the latch 83 is brought into abutment against the striker 82 so that it is completely turned to the fully latched position, as shown in FIG. 57(*b*). As a result, the latch 83 is regulated in the position where its pole (or ratchet) 85 is retained.

A door closing apparatus 86 having the door locking mechanism 81 is equipped with one reversible motor 87 as the actuator, as shown in FIG. 56. As this reversible motor 87 is driven forward, a turn disc 88 is turned clockwise of FIG. 56 from its neutral position. As a result, one end of an output member 89, as fixed on the turn disc 88, is brought into abutment against an arm 90 so that the arm 90 is turned to pull a rod 91. When this rod 91 is pulled, the latch 83, is forcibly turned from the partially latched position to the fully latched position.

As the reversible motor 87 is driven backward by operating the opener, on the other hand, the turn disc 88 is turned counter-clockwise from the neutral position. As a result, the other end of the output member 89 is brought into abutment against an arm 92 so that the arm 92 is turned to pull a rod 93. When this rod 93 is pulled, the pole 85 having regulating the latch 83 in the fully latched position is turned in the releasing direction so that the door is released from its fully latched (or locked) state. Since the door closing apparatus 86 is thus equipped with the single reversible motor 87, its size can be reduced, and its control can be simply executed by one electric controller.

Despite of this advantage, however, the turn disc to be turned for pulling the individual rods 91 and 93 has to be arranged to have its individual faces normal to the latch 83. This makes it necessary to adopt the layout in which the two members 83 and 88 are not compactly arranged. This has failed to reduce the size of the door closing apparatus 86 sufficiently.

Moreover, the door closing apparatus 86 is constructed such that the turn disc 88 is positioned within a range of a predetermined angle (e.g., several tens degrees). As a result, the reversible motor 87 is driven back and forth within the relatively narrow angular range so that it is required to generate, a relatively high torque. This relatively enlarges the size of the reversible motor 87 to be employed, thus raising a cause for the apparatus to be sufficiently reduced in size. Here, the size reduction of the door closing apparatus is an important target because the apparatus is mounted in the limited space of the inside of the door.

Moreover, the reversible motor 87 has to be controlled forward and backward and is accompanied by a more complex control than the ordinary one-way motor. Since the reversible motor 87 is driven in the two directions from the neutral position, it has to be equipped with a neutral detecting sensor 94. This increases the number of detectors for controlling the reversible motor 87. As the detectors are the more, the control of the motor 87 becomes the more complex to complicate the control circuit the more.

Depending upon where the door locking mechanism 81 is mounted in the trunk door, on the other hand, the door may be unable to be closed reliably and stably. As an example for solving this problem, it is conceivable to employ a plurality of door closing apparatuses 86. However, this employment will increase the number of steps of assembling the door closing apparatuses 86 in the vehicle and will raise the cost for the vehicle. This makes it necessary to consider the positions for mounting the door closing apparatuses 86 in the trunk door.

According to the door closing apparatus 86, on the other hand, the door is excessively closed, if it is further latched once it was forcibly latched to the fully latched state. This excessive closure may deform the door panel or the like by the apparatus 86. It is, therefore, necessary that the door closing apparatus 86 has to be stopped without fail in its latching operation when the door comes into the fully latched state.

Moreover, when the pole (or ratchet) 85 retains the latch 83 in the partially latched position or in the fully latched position, the two members collide against each other to make a rattling sound. This is a major cause for the rattling sound of the door closing apparatus 86.

SUMMARY OF THE INVENTION

An object of the invention is to provide a door member locking/unlocking apparatus which can perform a latching action from a partially latched position to a fully latched position and an unlocking action of the door member by using one actuator commonly and which can reduce its size.

Another object of the invention is to provide a control circuit for controlling the drive of a drive source by a simple construction in addition to the size reduction of the apparatus.

A further object of the invention is to provide a door member locking/unlocking apparatus which can close the door member reliably and stably, by considering the position where the locking/unlocking is mounted in the vehicle.

A yet another object of the invention is to provide a doom member locking/unlocking apparatus which can stop the latching action without fail when the door member is fully latched.

A still further object of the invention is to provide a door member locking/unlocking apparatus which can suppress a rattling sound therefrom.

In accordance with the present invention, there is provided a door member locking/unlocking apparatus comprising: a drive source for driving an output shaft rotationally; a latch rotatably hinged in a position to engage with a retaining portion for retaining a door member in a closed state and urged in a direction to disengage from the retaining portion; retaining means for regulating the latch in a partially latched position and in a fully latched position; latching means for turning the latch from the partially latched position to the fully latched position; retention releasing means for releasing the retention of the latch in the fully latched position by the retaining means; and a cam arranged to have an axis of rotation in parallel with that of the latch and rotationally driven by the drive of the drive source for actuating the latching means and the retention releasing means.

Other aspects and advantages of the invention will become apparent from the following description, taken in conjunction with the accompanying drawings, illustrating by way of example the principle of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

First Embodiment

There will be explained a first embodiment of the present invention with reference to FIG. 1 through FIG. 9.

Figure 1:
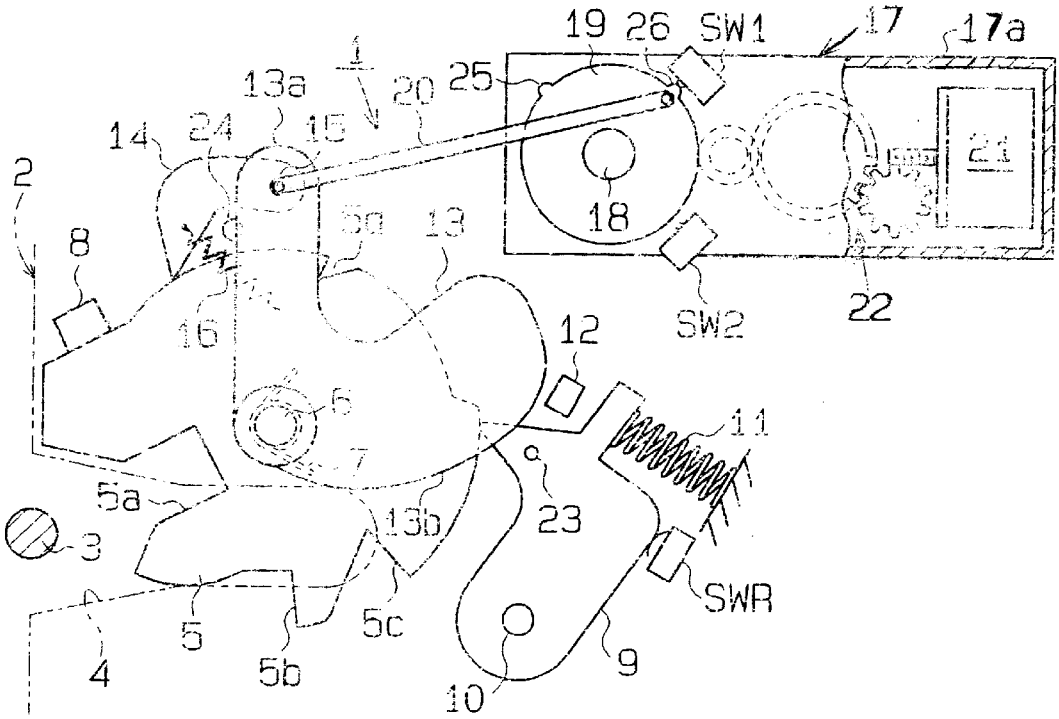
FIG. 1 is a top plan view showing a door closing apparatus according to a first embodiment of the invention.

Referring to FIG. 1, a door closing apparatus 1 as a locking and unlocking apparatus provided on a side door of an automotive vehicle. The door closing apparatus 1 is built in a side door 2 as a door member at a location opposed to a striker 3 as an engaging portion provided on a center pillar, not shown, so that it forcibly pulls the striker into a full latch state to automatically place the side door into a fully closed state when the side door 2 is not fully closed or in a half latch state. In the door closing apparatus. 1, opening and closing is done under electronic control by an opener, not shown, provided in the inside-to-outside of the side door 2.

The door closing apparatus 1, as shown in FIG. 1, has a disc-formed latch 5 arranged at a location close to an insertion passage 4 for receiving therein the striker 3, for rotation about a support shaft 6. The latch 5 is urged by a torsion spring 7 in a clockwise direction as viewed in the figure. The rotational position of the latch 5 is restricted with respect to an urged direction by a stopper 8. The latch 5 is formed, at an outer periphery, with a recess 5*a* for guiding to receive therein the striker 3, an engaging surface 5*b* for fully latching, an engaging surface 5*c* for half latching, and an engaging groove 5*d*. In the vicinity of the latch 5, a first ratchet 9 as an engaging means is arranged for rotation about a support shaft 10, which ratchet is urged by a spring 11 in a direction of abutting against the outer periphery of the latch 5. The rotational position of the first ratchet 9 is restricted with respect to an urged direction by a stopper 12.

Figure 2:
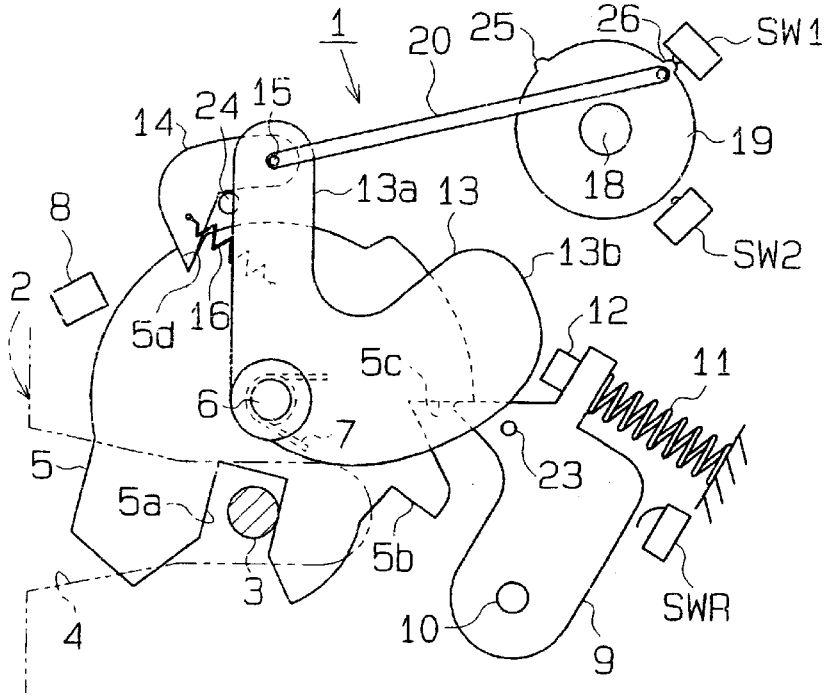
FIGS. 2 to 6 are top plan views for explaining the actions of the door closing apparatus of FIG. 1.
Figure 4:
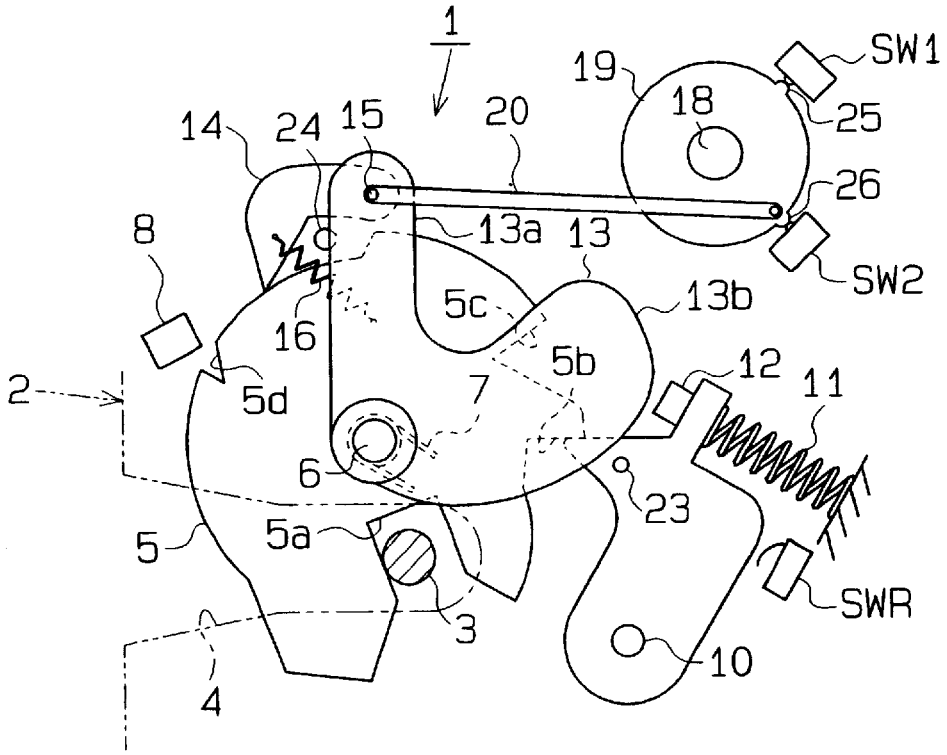

The latch 5 is rotated in the urged direction into abutment against the stopper 8 as shown in FIG. 1, where the latch is in an unlocked state that the striker 3 is free from restriction by the recess 5*a*. If the striker 3 strikes the latch 5 to cause the latch 5 to rotate counterclockwise as view in FIG. 1 against the urging force, the first ratchet 9 engages with either one of the engaging surfaces 5*b* and 5*c*. A half latch position of the latch 5 is shown in FIG. 2 where the first ratchet 9 is engaged with the engaging surface 5*c*, while a full latch position of the latch 5 is shown in FIG. 4 where the first ratchet 9 is engaged with the engaging surface 5*b*. In the half latch position or the full latch position for the latch 5, the striker 3 positioned within the insertion passage 4 is placed in restriction by the recess 5*a*.

A generally L-formed drive cam 13 is arranged on an upper side or on a side toward this as viewed in the figure of the latch 5, for rotation about a support shaft 6. At an extending 13*a* of the drive cam 13, a second ratchet 14 is supported for rotation about a support shaft 15. The second ratchet 14 is urged by a spring 16 in a direction abutting against the outer periphery of the latch 5. The second ratchet 14 is arranged engageable with the engaging groove 5*d* when the latch 5 is put into the half latch position. The cam 13 as shown in FIG. 1 is at a neutral position, which is swingable to the left and the right with respect to the neutral position.

The drive cam 13 is linked to a rotating member 19 is fixed on a output shaft 18 of the actuator for rotation therewith through a link 20 as a power transmitting mechanism and a link mechanism. The link 20 has a first end thereof rotatably connected to the drive cam 13 via a support shaft, and a second end thereof rotatably connected to the rotating member 19 at its an eccentric location on a surface, of a side toward this as viewed in FIG. 1.

The actuator 17 has an electric motor 21 as a drive source provided within a housing 17*a* thereof. The output of the electric motor 21 is reduced of speed via a speed-reducing mechanism 22, being delivered as a predetermined rotational speed output through the output shaft 18. In general as the derive speed of a motor increases the size becomes smaller. In the present embodiment, a high-speed driving and small-sized motor is employed to incorporate therein the speed-reducing mechanisn 22 for constituting the actuator 17, obtaining a required rotational speed output.

The counterclockwise rotation of the rotating member 19 causes the second end of the link 20 to circularly move in the same direction. Accordingly, the first end of the link 20 is pushed outward and pulled inward to thereby causes the drive cam 13 to swing about the support shaft 6.

The rotating member 19 as shown in FIG. 1 is at an initial position. Whenever the side door is open, the rotating member 19 is always at the initial position. The rotating member 19 as shown in FIG. 4 is at a home position. Whenever the side door is fully closed or in a full latch positions the rotating member 19 is always at the home position. In a state that the rotating member 19 assumes at either of the two positions, the drive cam 13 is positioned at the neutral position.

In a state that the latch 5 is at a half latch position as shown in FIG. 2, if the rotating member 19 rotates counterclockwise from its initial position to the home position, the drive cam 13 is moved from the neutral position by lone cycle back to the original neutral position. This swing process (swing range) is a first swing range, wherein when the second ratchet 14 engaged with the engaging groove 5*d* in the half latch position is pushed leftward as viewed in the figure, the latch 5 is forcibly rotated from the half latch position to the full latch position.

On the other hand, when the rotating member 19 is rotated counterclockwise from the home position to the initial position in the state that the latch 5 is in the full latch position as shown in FIG. 4, the,drive cam 13 at its right side is moved by one cycle from the neutral position to be returned to the beginning neutral position. This swing process (swing range) of the drive cam 13 is a first swing range. In this second swing range, an extending portion 13*b* of the drive cam 13 engages with a pin 23 that constitutes a disengaging means projectingly provided on the first ratchet 9 to push the first ratchet 9 in a direction away from the latch 5 against its urging force. Thus, the latch 5 confined in the half or full latch position is released from the engagement by the first ratchet 9.

Figure 5:
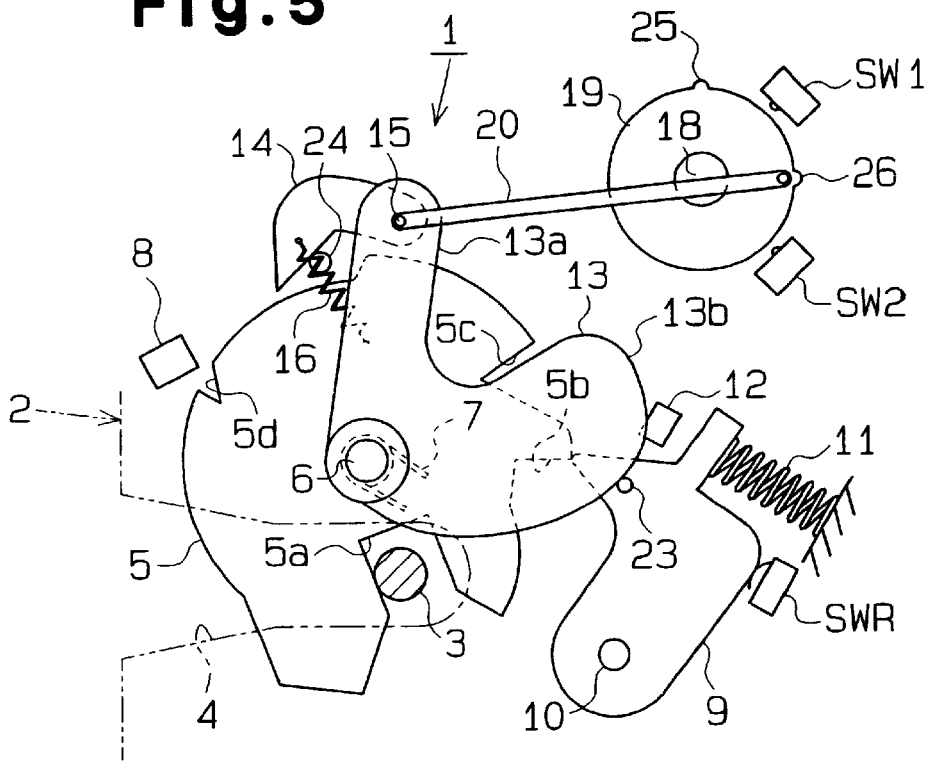
Figure 6:
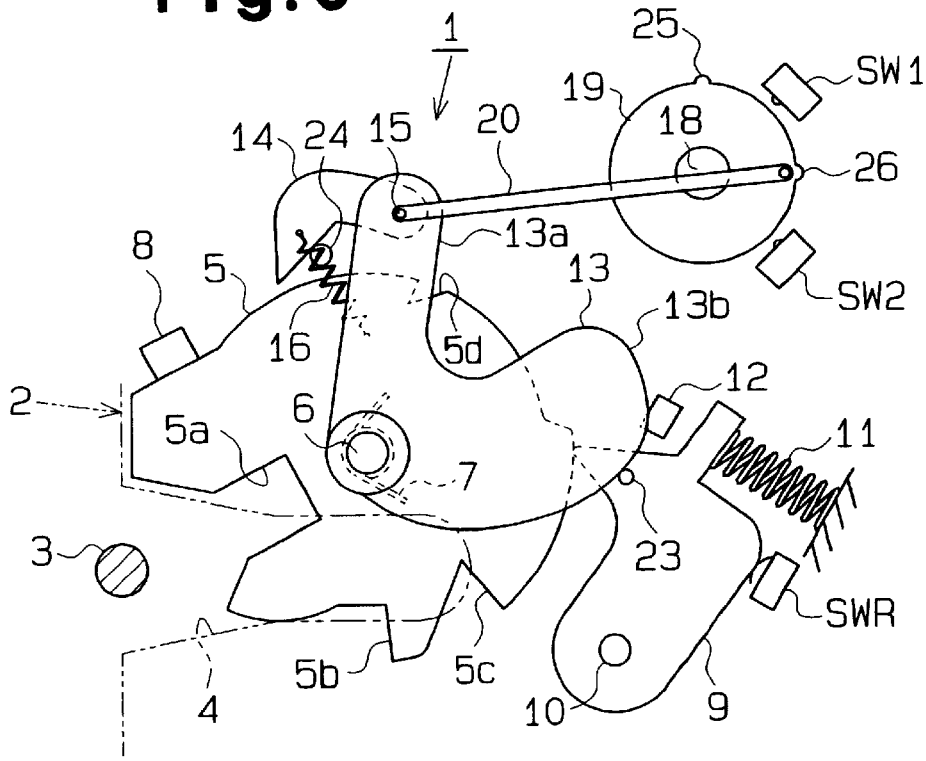

The restriction pin 24 is fixed at such a position that it is brought into engagement with the second ratchet when the drive can 13 rotates to a position of pushing away the first ratchet 9. When the engagement of the latch 5 by the first ratchet 9 is released by the swing of the drive cam 13, the second ratchet 14 is placed away from the outer periphery of the latch 5 as shown in FIG. 5. In this manner, the second ratchet 14 is arranged such that it is not engaged with the engaging groove 5*d* when the latch 5 is released from the engagement by the first ratchet 9 to be rotated returning to an unlock position due to its urge force.

The rotating member 19 has two points to be detected 25, 26 provided projecting from an outer periphery thereof. The points to be detected 25, 26 are placed at such locations that they assume a radial angle therebetween equivalent to an angle of rotation of the rotating member 19 from the home position to the initial position. A sensor (micro-switch) SW1 as a second detector and a sensor (microswitch) SW2 as a third detector are arranged at respective locations where they are contacted with the points to be detected 25, 26 when the rotating member 19 is at the home position. Further, a sensor (micro-switch) SWR as a first detector is provided on the back side of the first ratchet 9 so as to detect whether or not the first ratchet 9 is in engagement with the engaging surface 5*b*, 5*c*.

Figure 8A:
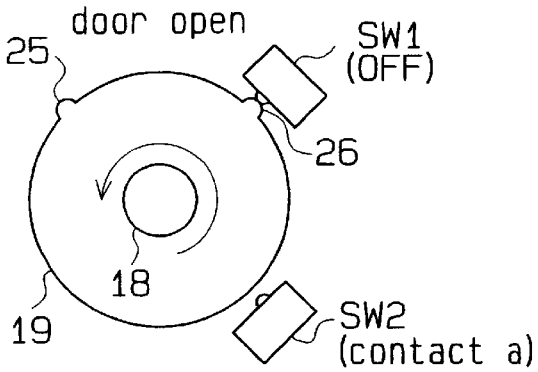
FIG. 8 presents top plan views for explaining the actions of various sensors of the door closing apparatus of FIG. 1.
Figure 8B:
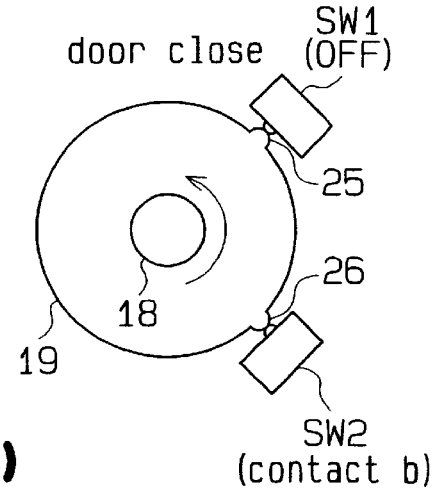
Figure 8C:
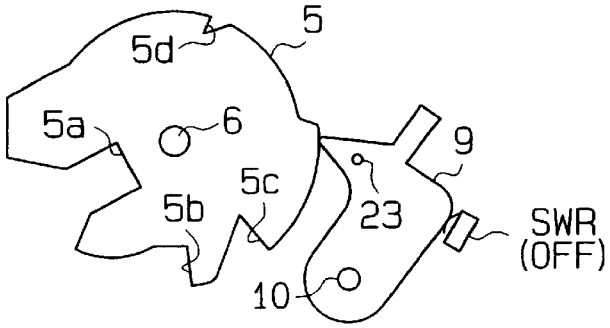

The sensors SW1, SW 2, and SWR are arranged to operate as shown in FIG. 8. That is, as shown in FIGS. 8(*a*) and 8(*b*), the sensor SW1 turns "off" when its detecting portion is in contact with the point to be detected 25, 26, and turns "on" when it is out of contact with the point to be detected 25, 26. The sensor SW2 turns is connected to a "contact a" when its detecting portion is in contact with the point to be detected 25, 26, and connected to a "contact b" when it is out of contact with the point to be detected 25, 26. The sensor SWR as shown in FIG. 8(*c*) turns "off" when its detecting portion is in contact with the first ratchet 9, and turns "on" when it is out of contact with the first ratchet 9.

Figure 7:
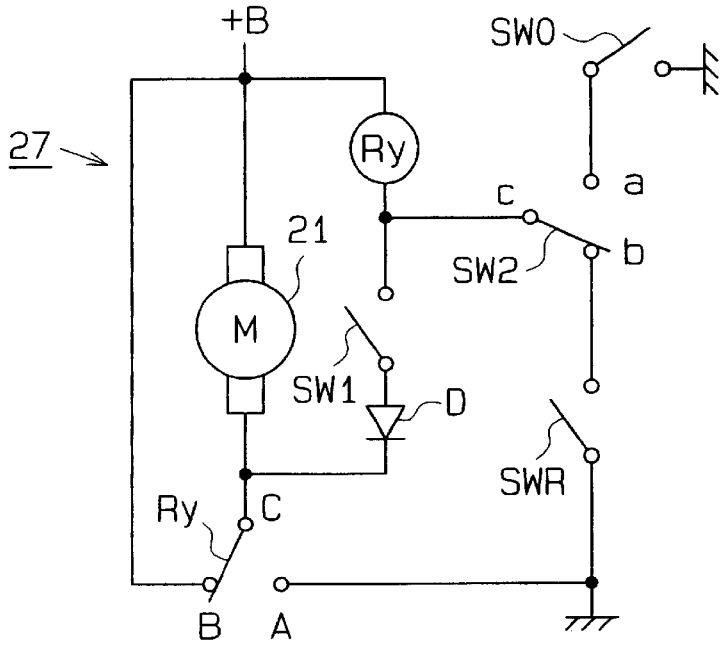
FIG. 7 is a circuit diagram showing a control circuit of the door closing apparatus of FIG. 1.

FIG. 7 shows a control circuit 27 for control the drive to the electric motor 21. The electric motor 21 has a positive terminal connected to a battery, not shown, to be applied with a battery voltage "+B". The positive terminal of the electric motor 21 is connected to its own negative terminal by way of a relay Ry as a switch means, the sensor SW1, and a diode D. The electric motor 21 has a negative terminal connected to a contact C of a relay Ry. Consequently, when an electric-current flows through the relay Ry, the contact C is, connected to a contact A, while, when no electric current flows through the relay Ry, the contact C is connected to a contact B. The contact A of the relay Ry is grounded, while the contact B thereof is connected to the positive terminal of the electric motor 21. The drive of the electric motor 21 is halted by switching over the connection of the contact C from the contact A to the contact B. When the contact C of the relay Ry is connected to the contact B, the electric motor 21 is short-circuited at its positive and negative terminals. Thus, this circuit forms a brake circuit.

The negative terminal of the relay Ry is connected to a contact c of the SW2. The sensor SW2 has a contact a being grounded through a switch SW0 as an operation detector that is opened and closed based on operation of the opener. The sensor SW2 has a contact b that is connected to the sensor SWR that is grounded together with the contact A of the relay Ry.

The operation of the door closing apparatus constructed as above will then be explained.

First explained will be the operation of the door closing apparatus 1 when the side door 2 is closed while the side door 2 is open, the rotating member 19 is at the initial position as shown in FIG. 1. In such state, the sensor SW1 is in contact with the point to be detected 26 and hence in the state of "off". The sensor SW2 at its detecting portion is in a noncontact state so that the sensor is in the state of being connected to the "contact b". The sensor SWR is in the "off" state because the first ratchet 9 is not in engagement with the engaging surface 5*b*, 5*c*. Note that as shown in FIG. 9 the rotational angle θ of the rotating member 19 is denoted "0 degree" when the member 19 is at the initial position.

For example, if sufficient force is not applied for closing the side door 2 and the striker 3 inserted into the insertion passage 4 pushes to rotate the latch 5 just to the half latch position, the first ratchet 9 is brought into engagement with the engaging surface 5*c* of the latch 5. Thus, the latch 5 is confined in the half latch position. In this state, the second ratchet 14 is in engagement with the engaging groove 5*d* as shown in FIG. 2. At this time, as the first ratchet 9 engages with the engaging surface 5*c*, the first ratchet 9 rotates or displace close to the latch 5. Accordingly, the sensor SWR is switched over from the off state to the on state.

Figure 9:
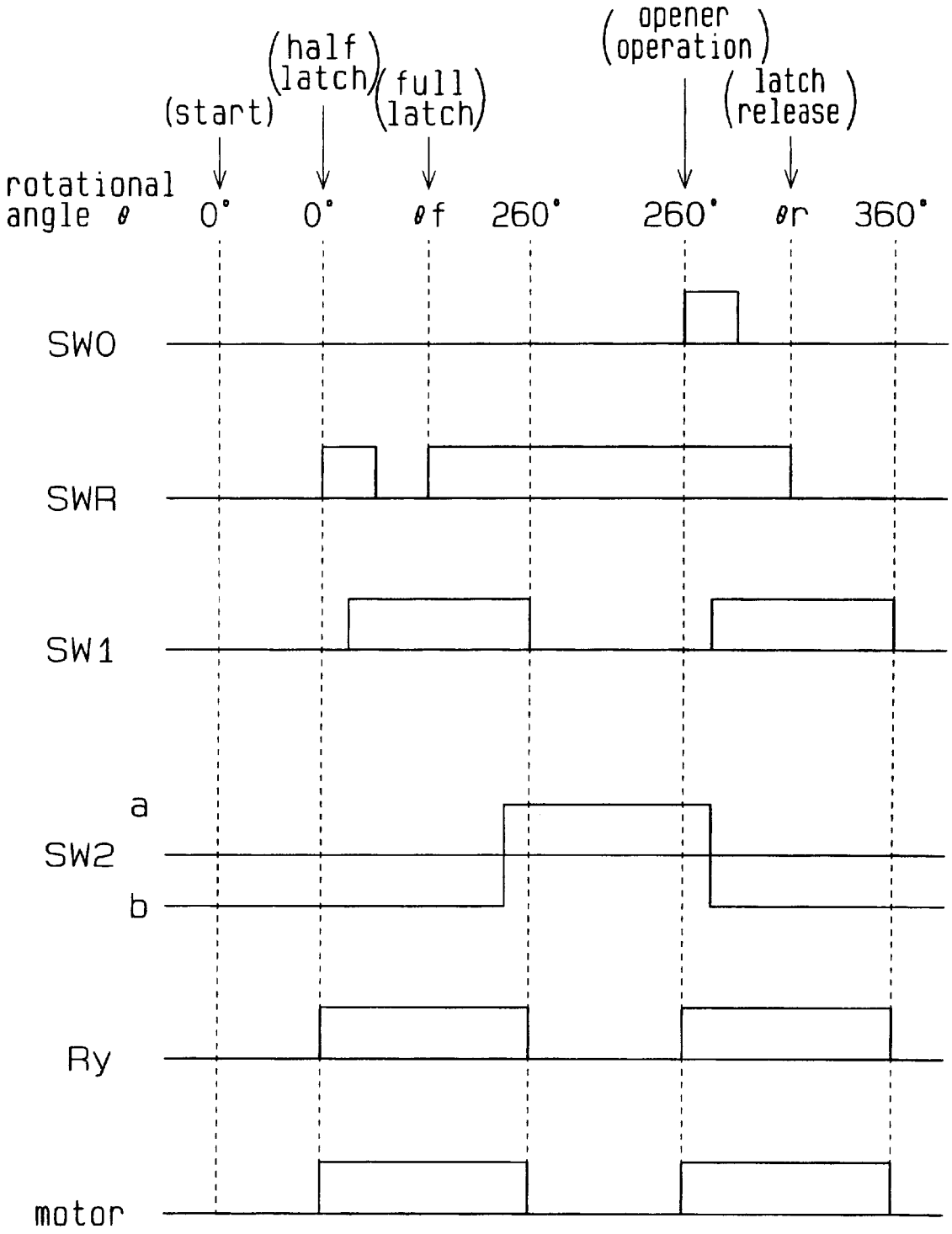
FIG. 9 is a timing chart for explaining the actions of the control circuit of FIG. 7.

When the sensor SWR turn on, an electric current flows through the relay Ry as shown in the control circuit 27 of FIG. 7 and the time chart of FIG. 9 so that the contact C of the relay Ry is brought into connection to the contact A. As a result, the electric, motor 21 is energized to thereby cause the rotating member 19 to start rotating from the state shown in FIG. 8(*a*) in the counterclockwise direction as viewed in the figure. As the rotating member 19 begins to rotate, the sensor SW1 is placed out of contact with the point to be detected 26 and hence changed over from the off state to the on state.

As the rotating member 19 is unidirectionally rotated in the counterclockwise direction, the drive cam 13 is rotated through the link in the counterclockwise direction about its support shaft 6 from the neutral position in. FIG. 2. As a result, the second ratchet 14 engaged with the engaging groove 5*d* forcibly drives the latch 5 toward the left in the figure so that the latch 5 is rotated counterclockwise as viewed in the figure. When the first ratchet 9 is disengaged from the engaging surface 5*c*, the sensor SWR once turns "off". However, the sensor SW1 is turned "on" by this time so that there is no interruption in electric current flow through the relay Ry and accordingly the electric motor 21 does not halt of driving.

Figure 3:
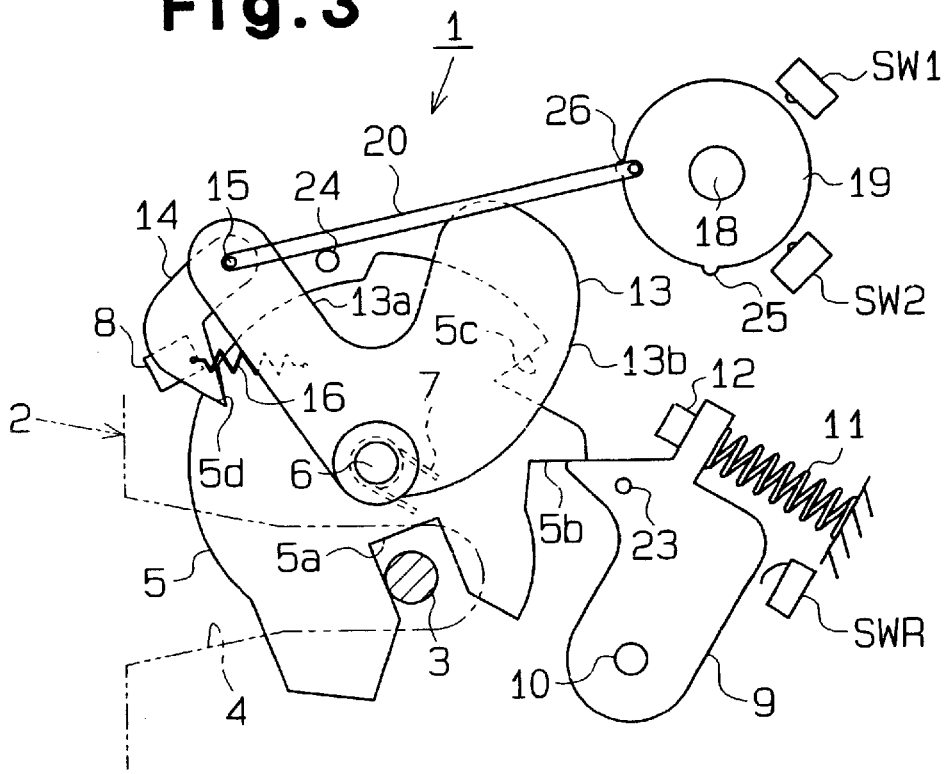

As the rotating member 19 reaches close to its rotational angle θf (=approximately 130 degrees) as shown in FIG. 3, the first ratchet 9 is placed into engagement with the engaging surface 5*b*. Thus, the latch 5 is placed in restriction in position at the full latch position as shown in FIG. 3. Thereupon, the sensor SWR again comes to the "on" state. The rotating member 19 continues to rotates until its point to be detected 25 is placed in contact with the sensor SW1 (the state of the rotational angle θ in FIG. 4 and FIG. 8(*b*)=260 degrees). When the sensor SW1 is switched over from the on state to the off state, the relay has no current passing therethrough (non-exciting state) so that the contact C thereof is connected to the contact B, halting the drive of the electric motor 21. Incidentally, when the side door 2 is fully closed (full latch state) instead of incomplete door closure state, the electric motor 21 is driven in the similar manner and the rotating member 19 also assumes at the home position. In this manner, whenever the side door 2 is closed in a full latch state, the rotating member 19 always assumes at the home position.

Then explanation will be made for operation in opening the side door 2. While the side door 2 is in a locked state as shown in FIG. 4, the rotating member 19 is at a rotational angle θ=approximately 260 degrees, as shown in FIG. 4 and FIG. 8(*b*). In this state, the sensor SW1 is "off", the sensor SW2 is in connection to the "contact a", and the sensor SWR is "on".

When the opener, not shown, on the side (door for example is operated, the switch SW0 Shown in FIG. 7 is turned on. At this time, since the sensor SW2 is in connection to the "contact a", the relay has an electric current passing therethrough (exciting state) so that the contact C of the relay Ry is connected to the "contact A", thereby starting the drive of the electric motor 21. If the electric motor 21 is driven, the rotating member 19 begins to rotate in the counterclockwise direction as viewed in FIG. 4. The rotation of the rotating member 19 causes the connection of the sensor SW2 to be switched over from the contact a to the contact b. At almost the same time, more exactly somewhat earlier timing than this, the sensor SW1 is switched over from the off state to the on state. This maintains the state of the relay Ry in exciting even if the sensor SW2 connection is changed to the contact b side. Thus, the drive of the electric motor 21 is not halted.

The rotation of the rotating member 19 cause through the link 20 the drive cam 13 to rotate from the neutral position toward the clockwise direction as viewed in FIG. 4 so that the drive cam 13 comes to abutment against the pin 23. Consequently, the first ratchet 9 is rotated about its support shaft 10 in the clockwise direction. At the time that the rotating member 19 rotates to a position of a rotational angle θr (=approximately 310 degrees), the first ratchet 9 disengages from the engaging surface 5*b*. As a result, when the first ratchet 9 is disengaged from the engaging surface 5*b*, the latch 5 is rotated clockwise about the support shaft 6 by the urging force of the torsion spring 7 to be returned to the unlocking position shown in FIG. 6. Thus, the latch 5 is confined in position by the abutment against the stopper 8. In this manner, the striker 3 is released from the restriction by the recess 5*a* of the latch 5, thereby unlocking the side door 2. The sensor SWR is switched over from the on state to the off state when the engagement by the first ratchet 9 is released.

After the latch 5 is returned to the unlocking position, the rotating member l9 continues to rotate until the point to be detected 26 comes to contact with the sensor SW1, i.e., until the rotational angle θ=360 degrees (or 0 degree) is reached. When the point to be detected 26 contacts with the sensor SW1 to turn "off" the sensor SW1, no electric current flow through the relay Ry (non-exciting state) so that the contact C of the relay is placed in contact with the contact B. Thus, the drive of the motor 21 is halted. In this manner, the rotating member 19 rotates by one turn from the initial position (θ= degree) again to the initial position. In this manner, each time the opening and closing of the side door 2 is repeated, the rotating member 19. rotates in one direction. That is, the rotating member 19 makes one turn whenever the side door 2 is opened and closed by one time.

When the electric motor 21 is halted of drive, the contact C of the relay Ry becomes connected to the contact B so that the electric motor 21 is short-ciicuited at its positive and negative terminals. According, the inertial rotation of the rotor induces a back electromotive current in a winding to cause a brake force, thereby promptly halting the electric motor 21. As a result, the rotating member 19 is stopped at the home position or the initial position with accuracy.

The first embodiment of the present invention as explained in detail above provides the following effects.

(1) Since the drive cam 13 and the latch 5 are rotatably arranged on the coaxial support shaft 6, the drive cam 13 and latch 5 can be placed in compactness with their surfaces overlapped with each other. Consequently, the door closing apparatus 1 is made further reduced in size as compared with the conventional apparatus having the layout arranged, as stated in the prior art description, with orthogonal surfaces of the latch 83 and the rotating plate 88.

(2) The unidirectional circular motion of the rotating member 19 is converted through the link 20 and the drive cam 13 into the depressing motion of the second ratchet 14 and the disengaging motion of the first ratchet 9. Consequently, the ordinary small-sized electric motor 21 of a unidirectional rotation type, that is smaller compared with the conventionally used reversible motor, can be employed to further reduce the size of the door closing apparatus 1.

(3) The detectors for taking the timing in drive control for the electric motor 21 are comprised by only three sensors, i.e., the sensors SW1, SW2 for detecting two positions of the initial position corresponding to the neutral position of the drive cam 13 and the home position, and the sensor SWR for detecting the half latch position or the full latch position of the latch 5. In contrast to this, the door locking apparatus using a reversible motor as stated in the prior art requires four sensors, i.e., the sensors for detecting the half latch position, the full latch position, and the neutral position, and the sensor for pole-open detection. Accordingly, the door closing apparatus 1 can reduce the number of the detectors used in addition to omitting the use of a reversible motor. Therefore, the control for the apparatus is made without complication as compared with the conventional apparatus, and the control circuit 27 is simplified in structure.

(4) Since the transmission of power between the rotating member 19 and the drive cam 13 is through the link 20, the actuator can be placed distant from the latch 5 by appropriately determining the length of the link 20. Therefore, where there is limitation in installation space for the door closing apparatus 1, the actuator 17 is placed at a relatively free location relative to the latch 5 or the drive cam 13, correspondingly providing freedom in design.

(5) When the electric motor 21 is halted of driving, the contact of the relay Ry is connected to the contact B to short-circuit the respective terminals of the electric motor 21. The electric motor 21 upon halting has a back electromotive current induced in the rotor thereof by inertial rotation. Consequently, the electric motor 21 is applied by brake due to electricity generation, and halted in position with accuracy. Therefore, it is possible to positively avoid errors in detection by the sensor SW1, SW2 due to poor accuracy in stoppage position of the rotating member 19, positively preventing the door closing apparatus 1 from erroneously operating.

Second Embodiment

The second embodiment of the present invention will then be explained with reference to FIG. 10 through FIG. 18. That is, the closing apparatus provided in the trunk of the automotive vehicle will be explained.

Figure 10:
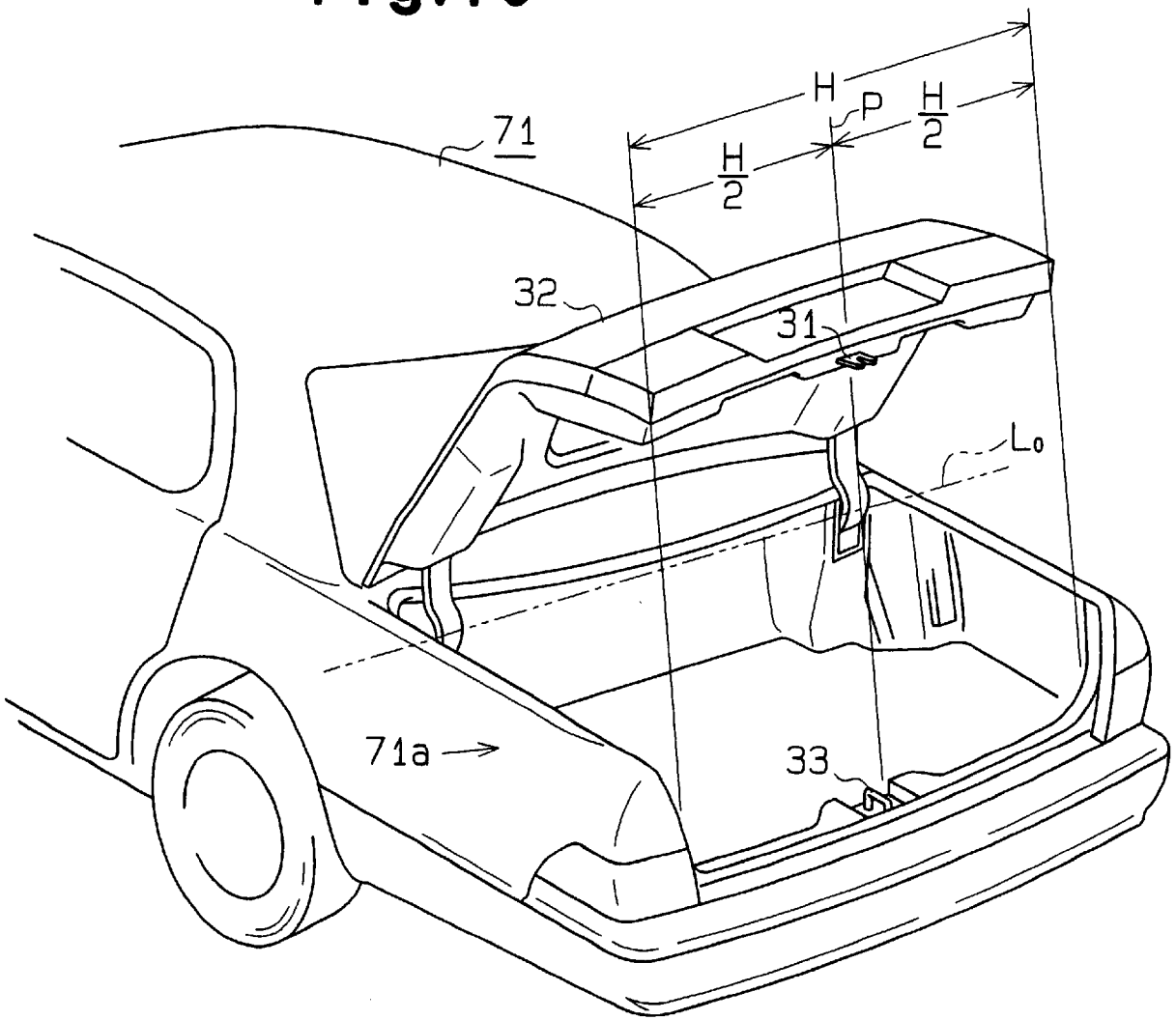
FIG. 10 is a perspective view of the back of a vehicle to be equipped with a trunk closing apparatus of the invention.

FIG. 10 shows a rear perspective view of an automotive vehicle 71. At the rear of the automotive vehicle 71, a trunk section 71*a* is provided. A generally rectangular-shape trunk door 32, serving as a door member, is provided at an upper portion of the trunk section 71*a* so as to provide a accommodation space for loading with luggage therein. The trunk door 32 is rotatably supported at a base portion thereof to have a rotational axis L0 arranged in parallel with the width direction of the vehicle 71. The trunk door 32 has a tip end, on the side of the rear end of the automotive vehicle 71, formed downwardly bent in a L-form.

The trunk door 32 has a closing apparatus 31 as a lock and unlock apparatus installed at a central location P with respect to a length H in a width direction of the door tip end. On the other hand, a striker 33 as an engaging portion is provided on a main body of the vehicle 31 at a location opposed to the closing apparatus 31. The closing apparatus 31 operates to automatically close the trunk door 32 by forcibly pulling inward the striker 33 to a full latch state if the trunk door 32 is in a state of incomplete closure (half latch). At this time, the trunk door 32 can be positively and stably closed, because the closing apparatus 31 is mounted at a central portion with respect to the width direction of the trunk door 32.

Figure 11:
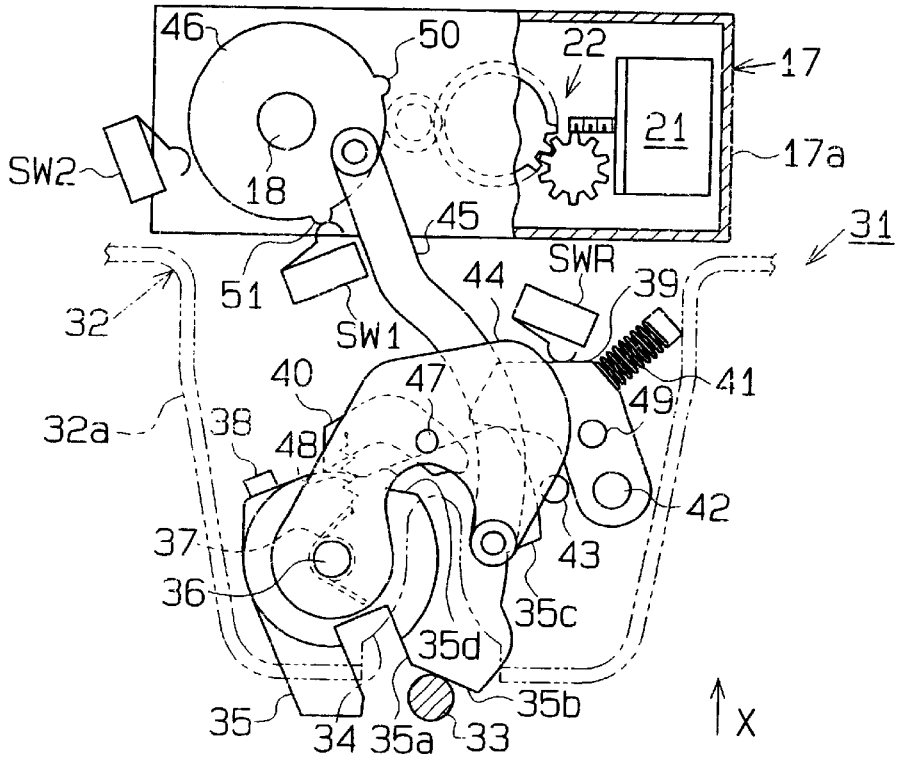
FIG. 11 is a top plan view showing a closing apparatus according to and embodiment of the invention.

FIG. 11 shows the detail of the closing apparatus 31. The closing apparatus 31 is almost the same in basic structure as the door closing apparatus 1 of the first embodiment. However, the apparatus is structured collective in a lock mechanism involving a latch, a first ratchet, and the like, because it is provided at the trunk where an accommodation space for the closing apparatus 31 is available with less sufficiency than that of the side door 2. A control circuit 27 is employed, which is configured similar to that of the first embodiment.

Figure 17:
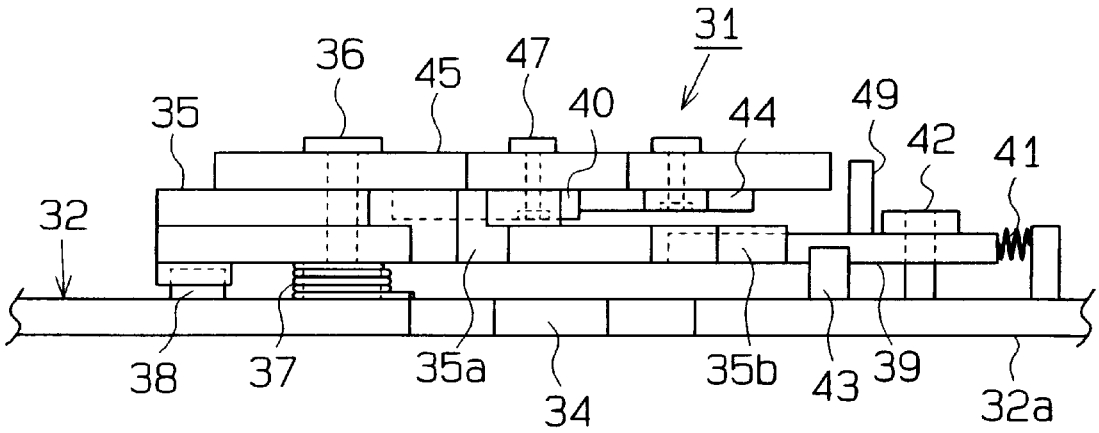
FIG. 17 is a side elevation showing the closing apparatus and taken in a direction X of FIG. 11.

As shown in FIG. 11, the trunk door 32 as a door member has a support portion 32*a* formed extending from the center of the rear end thereof to have an insertion passage 34 in which the striker 33, The support portion 32*a* is provided, at a location close to the insertion passage 34, with a latch 35 for rotation about a support shaft 36. The latch 35 is urged by a torsion spring 37 in the clockwise direction as viewed in the figure. The support shaft 36 extends to the direction perpendicular to the trunk door 32. The latch 35 as shown in FIG. 11 is at a unlock position where the latch 35 is confined in its position by abutment against a stopper 38, in which state the striker 33 is released from restraint by the latch 35. As shown in FIG. 17, the latch 35 is disposed in parallel and close to the trunk door 32.

Figure 18A:
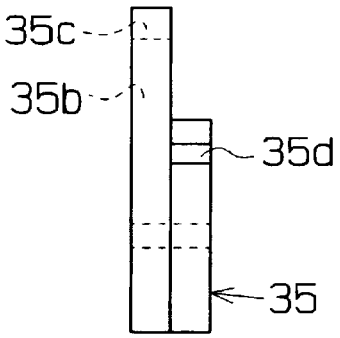
FIGS. 18 (*a*) and 18(*b*) are a side elevation and a top plan view of a latch.
Figure 18B:
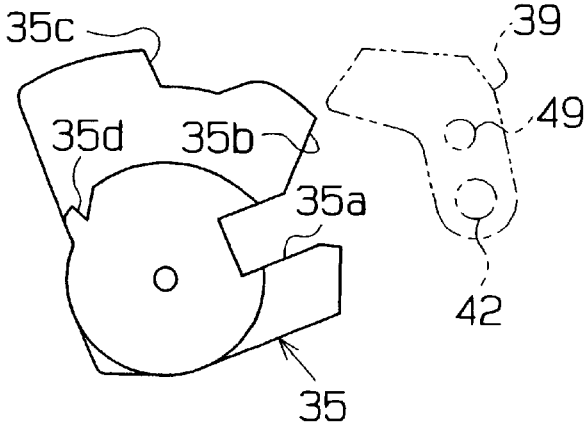

The latch 35 of the present embodiment is formed in a two-steps form in section as shown in FIGS. 18(*a*) and 18(*b*) so that it is thickened in wall thickness at a region surrounding a rotational center to provide two peripheral surfaces. The latch 5 has a recess 35*a* for restricting the striker 33, a full-latch engaging surface 35*b* and a half-latch engaging surface 35*c* formed at the outer periphery of the lower stage, and an engaging groove 35*d* formed at the outer periphery of the upper stage. The engaging surfaces 35*b*, 35*c* and the engaging groove 35*d* are located almost on one side with respect to the rotational center thereof (on almost the right side of the support shaft 36 in FIG. 11). As shown in FIG. 17 or the like, a first ratchet 39 as a engaging means and a second ratchet as a pulling means are arranged abutable against (engageable with) the latch 35 at its different outer peripheral surfaces. With such structure, the ratchets 39 and 40 are collectively arranged at locations close to each other on a space-limited support portion 32*a*, without requiring consideration of interfere by the ratchets.

The first ratchet 39 is arranged rotatable about a support shaft 42 so that it is urged to a direction close to the outer periphery of the latch 35 by a spring 41, as shown in FIG. 11. The latch 35 is confined in the full latch position by engaging the first ratchet 39 with the engaging surface 35*b*. The latch 35 is positionally confined in the half latch position by engaging the first ratchet 39 with the engaging surface 35*c*. The first ratchet 39 is restricted in position with respect to its urging direction by a restriction pin 43.

A drive cam 44 is provided rotatable about the support shaft 36, and is formed as a cam generally in a C-shape. The drive cam 44 has an end portion, located opposite to the portion supported by the support shaft 36, having a back surface rotatably connecting with a first end of an S-shaped link 45. The link 45 has a second end rotatably connected to an eccentric portion of a rotating member 46. The rotating member 46 is fixed on an output shaft 18 of an actuator 17 for rotation therewith. The actuator 17 is similar to that of the first embodiment, and has as a power source an electric motor 21 exclusive for unidirectionally rotational drive.

The second ratchet 40 is arranged connected to the back side of the drive cam 44 at almost the same height as the link 45 through a support shaft 47 for rotation thereabout. A spring 48 is stretched between the second ratchet 40 and the driving cam 44 so that the second ratchet 40 is urged to be abutted against the latch 35 at the outer periphery thereof formed with the engaging groove 35*d*. When the first ratchet 39 is in engagement with the engaging surface 35*c*, the second ratchet 40 is placed into engagement with the engaging groove 35*d*. In this state, if the drive cam 44 is rotated about the support shaft 36 in the counterclockwise direction as viewed in FIG. 12 from the neutral position in the figure, the second ratchet 40 and the latch 35 engaged through the engaging groove 35*d* therewith are forcibly rotated counterclockwise as viewed in the figure together with the drive cam 44.

Figure 14:
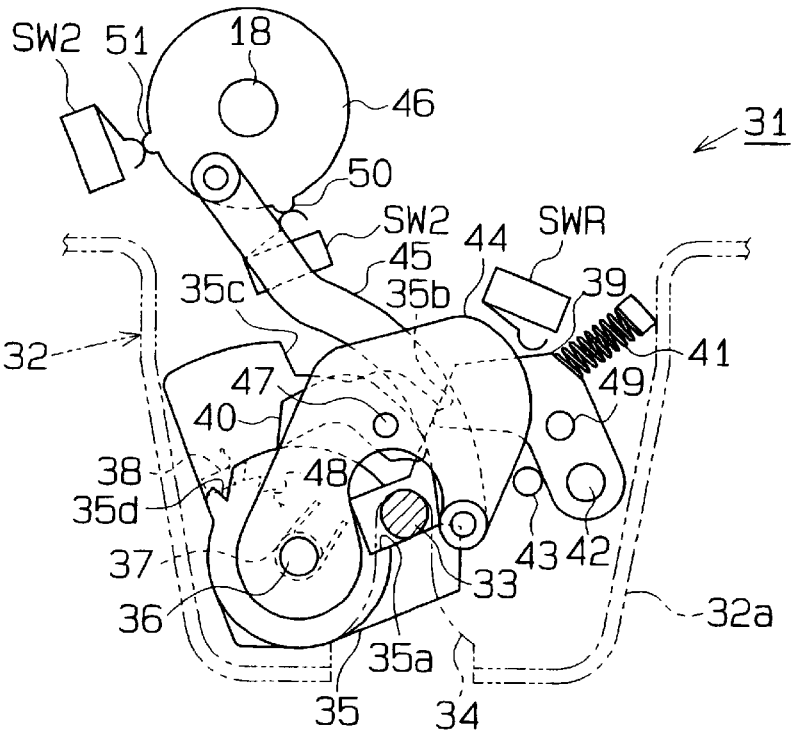

When the drive cam 44 is rotated about the support shaft 36 clockwise as viewed in FIG. 14 from the neutral position in the figure, the drive cam 44 placed into abutment against the pin 49 projecting on a top surface of the first ratchet 39 so that the first ratchet 39 thus pushed is disengaged from the engaging surface 35*b*. When the link 45 is positioned at such position that the first ratchet 39 disengages from the engaging surface 35*b*, the link 45 at its side portion depressed the base portion of the second ratchet 40 to thereby cause the second ratchet 40 to rotate in a direction away from the outer periphery of the latch 35.

The rotating member 46 has two points to be detected 50, 51 provided projecting from an outer periphery thereof. The points to be detected 50, 51 has a radial angle of approximately 100 degrees so as to sandwich therebetween the connecting portion to the second end of the link 45. The sensors (micro-switches) SW1, SW2 are arranged at positions that, when the rotating member 46 is at the initial position shown in FIG. 11, the sensors SW1, SW2 are respectively in contact with the points to be detected 50, 51. Further, a sensor (microswitch) SWR is provided at a location adjacent to the first ratchet 39 so as to detect whether or not the first ratchet 39 is in engagement with the engaging surface 35*b*, 35*c*.

Similarly to the first embodiment, the sensors SW1, SWR are arranged to turn "off" when their detecting portions become contacting with,the points to be detected 50, 51. The sensor SW2 is placed into connection to the "contact a" when its detecting portion,.contacts with the point to be detected 50, 51, whereas it is connected to the "contact b" when the detecting portion is out of contact with the point to be detected 50, 51.

The closing apparatus 31 operates as explained below.

Figure 12:
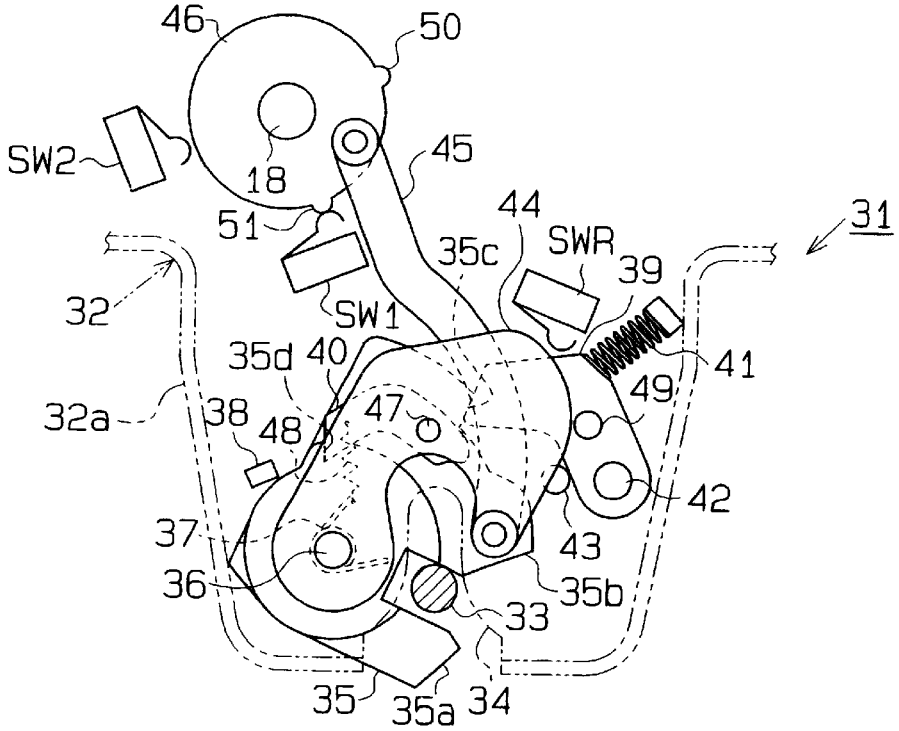
FIGS. 12 to 16 are top plan views for explaining the actions of the closing apparatus of FIG. 11.
Figure 13:
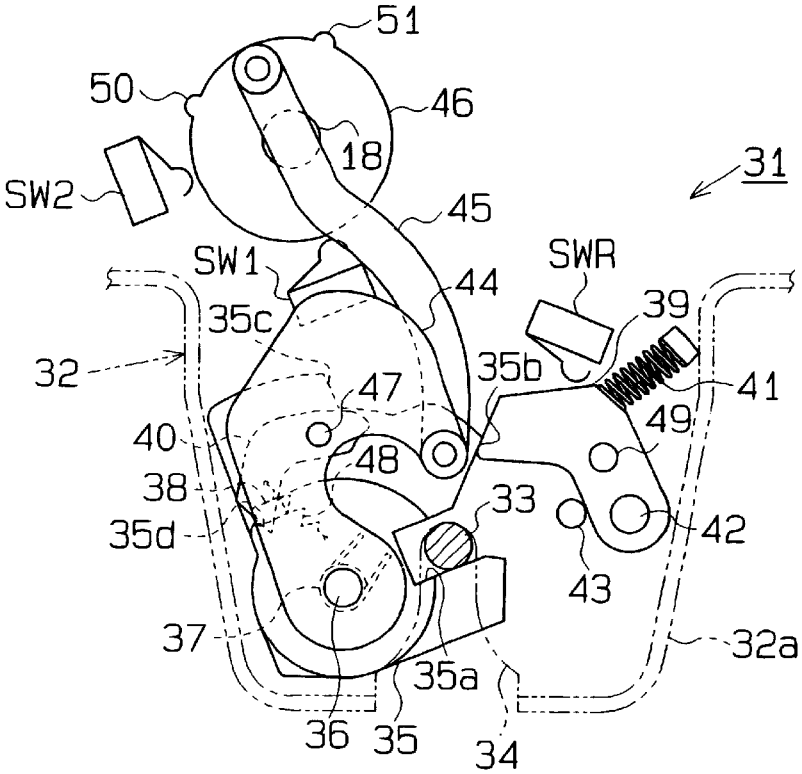

While the trunk door 32 is open, the latch 35 is at the unlock position where it is in abutment against the stopper 38, with the rotating member 46 positioned at the initial position (rotational angle θ=0 degree), as shown in FIG. 11. As shown in FIG. 12, when the trunk door 32 is incomplete of closure, the first ratchet 39 engages with the engaging surface 35*c* to thereby restrict the latch 35 at the half latch position. The second ratchet 40 engages with the engaging groove 35*d*. At this time, the first ratchet 39 is placed out of contact with the detecting portion of the sensor SWR, thereby turning "on" the sensor SWR.

Thereupon, the electric motor 21 is started of drive to cause the rotating member 46 to rotate in one counterclockwise direction as viewed in FIG. 12 from the initial position (θ=0 degree). By this rotation, the drive cam 44 connected to the rotating member 46 through the link 45 is rotated also in the counterclockwise direction. As a result, the second ratchet 40 engaging with the engaging groove 35*d* depresses the latch 35 in the counterclockwise direction so that the latch 35 is forcibly rotated from half latch position to the full latch position. Thereupon, the striker 33 inserted in the recess 35*a* is driven inward of the insertion passage 34. Thus, the trunk door 32 is completely and full-latch closed.

The rotating member 46 further continues rotating. After the rotational angle θ of the rotating member 46 exceeds around θf, the drive cam 44 returns back toward the clockwise direction. When the drive cam 44 reaches the neutral position, the points to be detected 50, 51 of the rotating member 46 are respectively brought into contact with the detecting portions of the sensors SW1, SW2, halting the drive by the electric motor 21. Thus, the rotating member 46 is stopped at its home position.

In the meanwhile, when operating the opener provided in the compartment to open the trunk door 32, the switch SWO (see FIG. 7) is turned "on" to start drive of the electric motor 21. As a result, the rotating member 46 begins to rotate in one counterclockwise direction as viewed in the figure. This rotation of the rotating member 46 causes the drive cam 44 connected thereto through the link 45 to rotate in the clockwise direction. The drive cam 44 in the course of this rotation becomes abutting against the pin 49 projecting on the first ratchet 39. The depression of this pin 49 moves the first ratchet 39 in the direction of disengagement.

Figure 15:
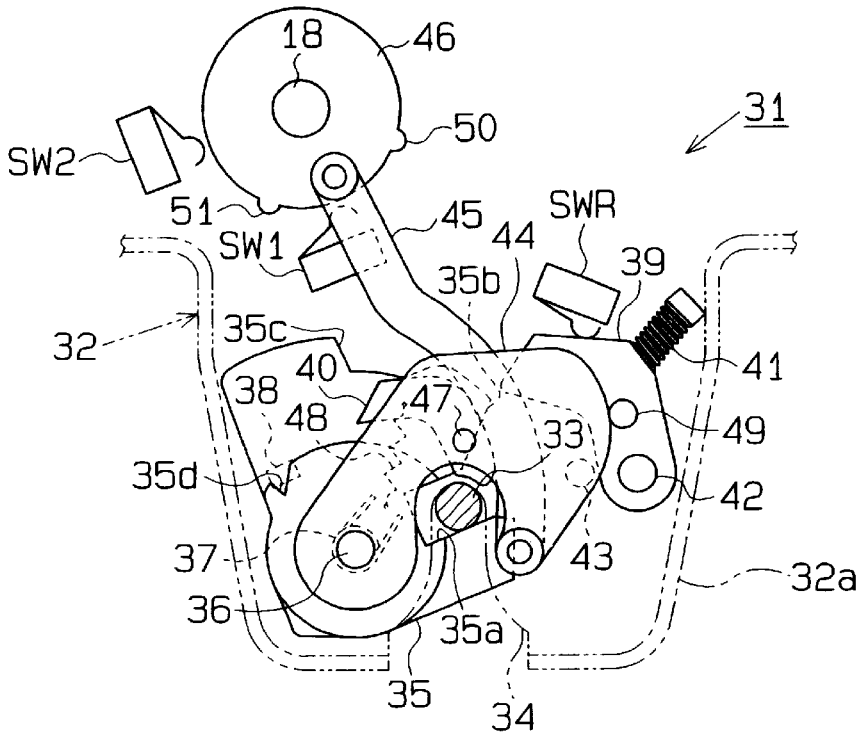
Figure 16:
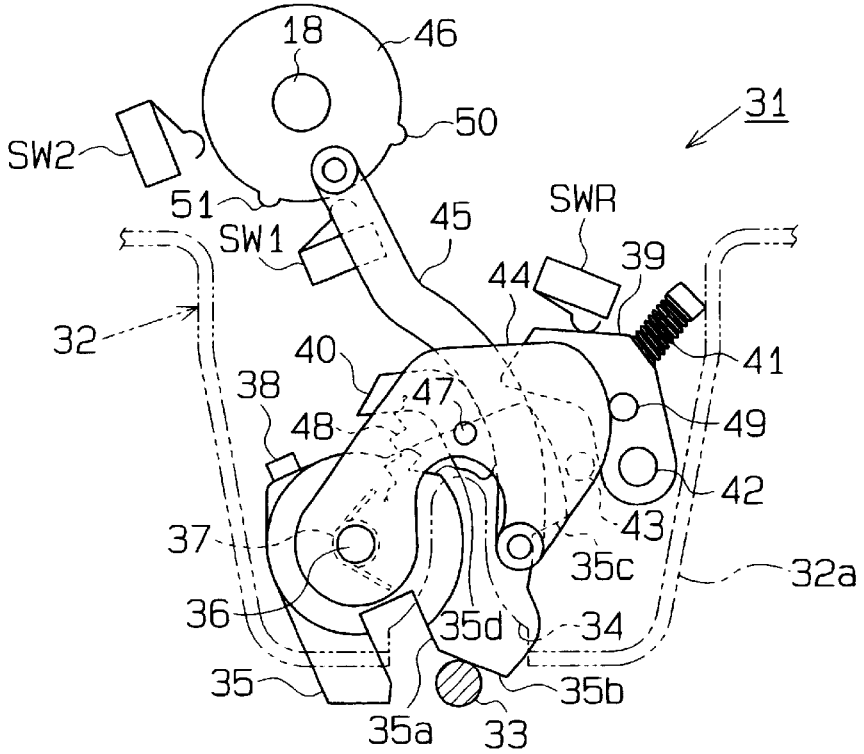

When the rotating member 46 rotates to around the rotational angle gr (=approximately 310 degrees) as shown in FIG. 15, the first ratchet 39 is disengaged from the engaging surface 35*b*. Consequently, the latch 35 is rotated in the clockwise direction as viewed in the,figure by the urging force of the torsion spring 37, being returned to a position of abutting against the stopper 38 as shown in FIG. 16. By immediately before returning of the latch 35, the link 45 depresses the base portion of the second ratchet 40 to cause the second ratchet 40 to rotate clockwise as viewed in the figure so that the second ratchet 40 disengages from the outer periphery of the latch 35. There is therefore no possibility, upon returning of the latch 35, that the second ratchet 40 be in engagement with the engaging groove 35*d*.

In this manner, the striker 33 is released from the restriction by the recess 35*a* of the latch 35, and the trunk door 32 is unlocked. Thereafter, when the rotating member 46 rotates until the point to be detected 51 contacts with the detecting portion of the sensor SW1, the electric motor 21 is halted of drive to stop the rotating member 46 at its initial position.

The second embodiment explained in detail provides the following effects.

(1) The latch 35 is configured by the two-stage structure having two peripheral surfaces, and the engaging surfaces 35*b*, 35*c* and the engaging groove 35*d* are provided at the different peripheral surfaces on one side of the latch 35. Therefore, the ratchets 39, 40 can be collectively arranged without considering the interfere therebetween. Accordingly, the trunk closing apparatus 31 can be accommodated in compactness within a limited space, even where the space for accommodating the trunk closing apparatus 31 is comparatively narrow as such in the trunk door 32.

(2) The second ratchet 40 and the link 45 are placed within the gap sandwiched between the top surface of the latch 35 lower stage and the drive can 44. This also makes possible reduction in the accommodation space required, (3) The mechanism that the link at its side surface depresses the base of the second ratchet 40 is provided to retreat the second ratchet 40 so that the second ratchet 40 upon unlocking is not engaged with the engaging groove 35*d*. Accordingly, it is possible during unlocking to positively prevent the second ratchet 40 from engaging with the engaging groove 35*d*.

(4) The closing apparatus 31 is mounted in the door 32 such that the insertion passage 34 into which the striker 33 is inserted is disposed at a central location P with respect to a length H in a width direction of the trunk door 32. Then, since the closing apparatus 31 is disposed at a central location P with respect to a length H in a width direction of the trunk door 32, the pulling-in force of the striker 33 by the apparatus 31 evenly exerts the trunk door 32. Accordingly, the closing apparatus 31 in this embodiment can close the trunk door 32 surely and stably.

(5) In addition, the closing apparatus 31 is disposed in the direction where the support shaft 36 is perpendicular to the trunk door 32. Accordingly, the closing apparatus 31 can be made mode compact in construction, so that the reduction of the trunk capacity can be retarded.

(6) Also, the latch 35 equipped in the closing apparatus 31 is disposed in the vicinity of the trunk door 32. Then, the striker 33 restrained by the latch 35 can be provided in the end portion, Accordingly, the trunk capacity can further be controlled.

The above-described embodiment can be modified in the following manner.

(1) In this embodiment, though the closing apparatus 31 is mounted in the trunk door 32, it may be mounted in the main body of the vehicle 71 corresponding to the door 32.

(2) In this embodiment, though the closing apparatus 31 is disposed at a central location P with respect to a length H in a direction of the trunk door 32 and in a direction where the rotating shaft (support shaft 36) is perpendicular to the door 32, at least the closing apparatus 31 may be disposed at a central location P.

Third Embodiment

Then the third embodiment of the present invention will be explained with reference to FIG. 19 and FIG. 20. This embodiment is a modification of the control circuit for the embodiment stated before. This embodiment is applied to the door closing apparatus 1 or the trunk closing apparatus 31. Therefore, explanations will be made only for the structure different from that of the embodiment stated above.

Figure 19:
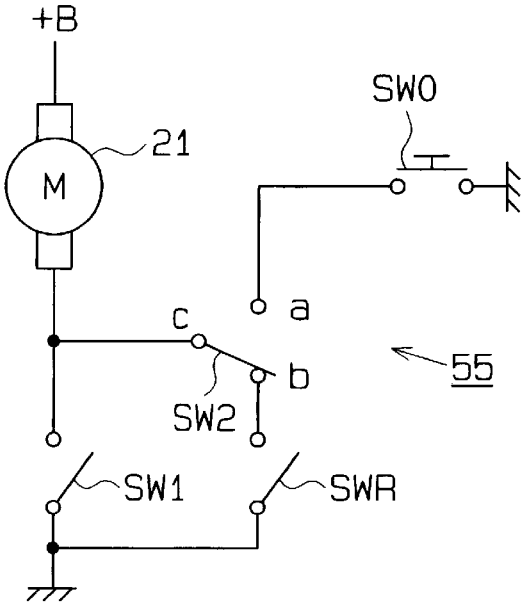
FIG. 19 is a circuit diagram showing a control circuit in a third embodiment of the invention.

Referring to FIG. 19, a control circuit 55 has an electric motor 21. The electric motor 21 has a positive terminal connected to a battery, not shown, to be applied by a battery voltage "+B". The electric motor 21 also has a negative terminal connected to a ground through a sensor SW1 and to a contact c of a sensor SW2. The sensor SW2 has a terminal a is connected to a ground through a switch SW0 that is turned "on" by operation of the opener, not shown. A terminal b of the sensor SW2 is connected to the ground through a sensor SWR.

The operation of the control circuit 55 will then be explained. Note that explanations will be made by exemplifying a door closing apparatus 1, because the operation of the control circuit 55 is basically similar if applied to either the door closing apparatus 1 or the trunk closing apparatus 31.

Figure 20:
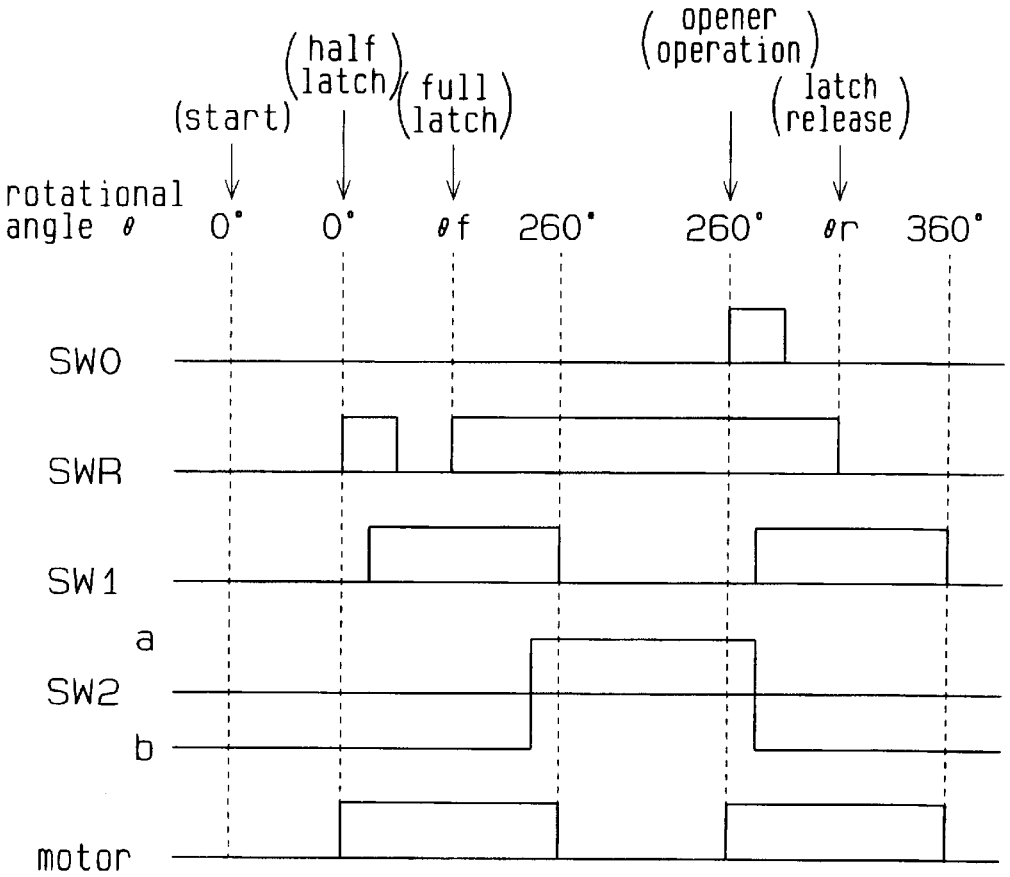
FIG. 20 is a timing chart for explaining the actions of the control circuit of FIG. 19.

While the side door is open (rotational angle θ=0 degree) as shown in FIG. 19 and FIG. 20, the sensors SWR, SW1 are "off" and the sensor SW2 has its contact c connected to the "contact b". If the side door is placed in an incomplete closing (half latch) state, the sensor SWR turns "on" to drive the electric motor 21. When the rotating member 19 begins to rotate from its initial position (rotational angle θ=0 degree), the sensor SW1 turns "on". Consequently, the drive of thee electric motor 21 will not be interrupted even by the disengagement of the first ratchet 9 from the engaging surface 5*c* and the sensor SWR is once turned "off".

When the rotating member 19 reaches a rotational angle θf (approximately 130 degrees), the first ratchet 9 engages with the engaging surface 5*b* to restrict the latch 5 within the full latch position. At this time, the sensor SWR again turns "on". Thereafter, the rotating member 19 reaches around the home position (rotational angle θ=approximately 260 degrees), the sensor SW2 first turns its connection at the terminal c from the "terminal b" to the "terminal a" and the sensor SW1 turns "off" at somewhat later timing, halting the drive by the electric motor 21. While the side door 2 is locked (fully latched), the switches SW1, SW2 and SWR remain in this state.

When the side door 2 is opened, the opener is first operated to turn "on" the switch SWO. The sensor SW2 is connected at its contact c to the contact a, and accordingly the electric motor 21 is driven. When the rotating member 19 begins to rotate from the home position (rotational angle θ=260 degrees), the sensor SW1 first turns "on" and at somewhat later timing the sensor SW2 turns its connection at the contact c from the "terminal a" to the "terminal b". The drive of the electric motor 21 will not be interrupted because the sensor SW1 is turned "on" earlier in timing. When the rotating member 19 reaches a rotational angle θr, the first ratchet 9 disengages from the engaging surface 5*b* and the drive cam 5 is rotated returning to the unlock position. Consequently, the striker 3 is released from latching. The sensor SWR turns "off" when the first ratchet 9 is placed out of engagement. Thereafter, when the rotating member 19 returns to its. initial position (θ=360 degrees), the sensor SW1 is turned "off" to thereby halt the drive of the electric motor 21.

As stated in detail above, in the third embodiment, no brake force is available for the electric motor 21 but the control circuit 55 is provided in simpler circuit configuration than those of the embodiments stated before.

Fourth Embodiment

The fourth embodiment of the present invention will then be explained with reference to FIG. 21 and FIG. 22.

This embodiment provides a modification of the power transmitting mechanism of the first embodiment that is arranged to convert the circular motion of the rotating member 19 into the swing motion of the drive cam. Incidentally, the elements or parts identical or similar in structure to those of the first embodiment will be omitted to explain, and explanations will be for elements or parts different from the first embodiment.

Figure 21:
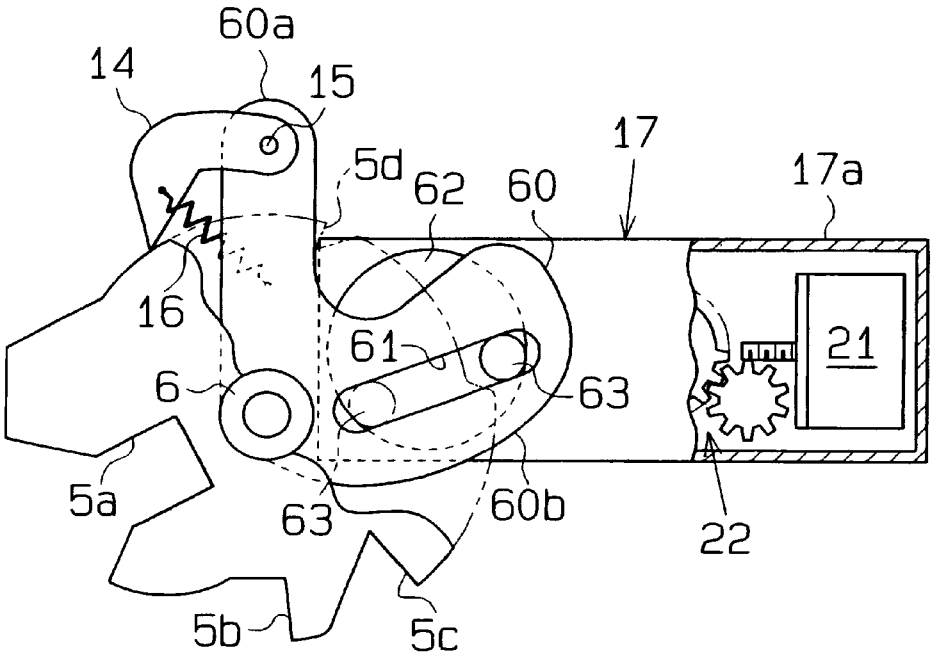
FIG. 21 is a partial top plan view showing a closing apparatus according to a fourth embodiment of the invention.
Figure 22:
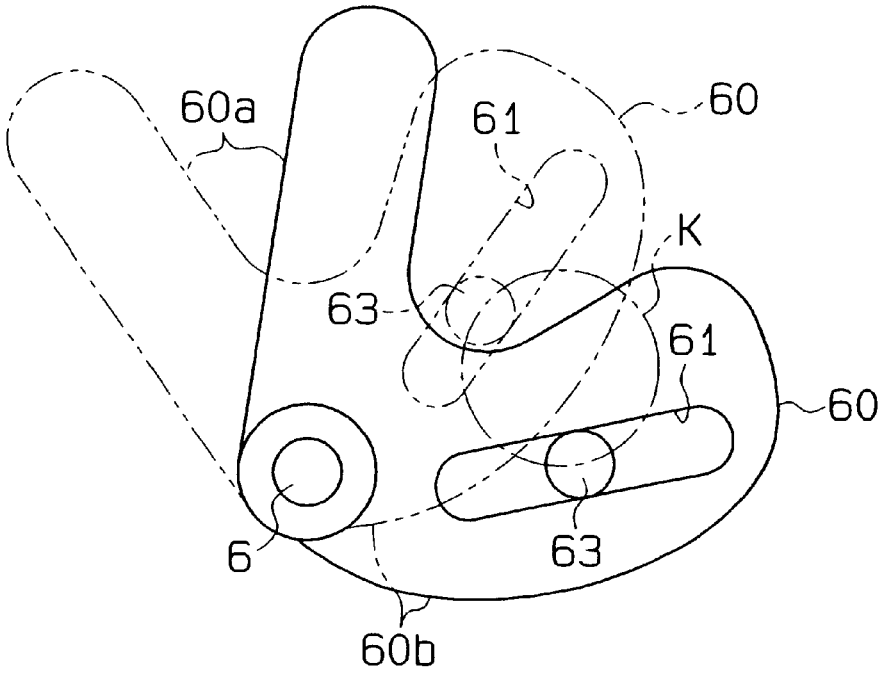
FIG. 22 is a top plan view for explaining the actions of a drive cam.

Referring to FIG. 21, a drive cam 60 is arranged as a cam on a back side of the latch 5 (on the side away from the page of FIG. 21) for rotation about a support shaft common to the latch 5. The drive cam 60 has one extending portion 60*a* provided with a second ratchet 14 and the other extending portion 60*b* formed with an elongate hole 61 as a guide constituting a power transmitting mechanism.

The actuator 17 has an output shaft 18 fixed thereon with a rotating member 62. The rotating member 62 has its surface (on the side toward this of the page of the figure) having a cylindrical guide pin 63 vertically projecting at an eccentric location from a rotational center thereof. The guide pin 63 has a diameter somewhat smaller than the width of the elongate hole 61 as an engaging portion forming the power transmitting mechanism. The guide pin 63 is inserted in the elongate hole 61. The circular motion of the guide pin 63 (circular path K in FIG. 22) causes, through the elongate hole 61, the drive cam 60 to be swung over a predetermined swing region. Note that a first ratchet 9, not shown, is arranged at such a height that is engageable with an outer periphery of the latch 5 so that a pin 23 projecting from a lower surface thereof can engage with the drive cam 60.

The rotating member 62 as shown in FIG. 21 is at an initial position where the guide pin 63 is positioned to place the drive cam 60 in a neutral position. The rotating member 62 assumes a home position, when the guide pin 63 is positioned at a position shown by the chain line in the figure to place the drive cam 60 again in the neutral position. The sensors SW1, SW2 are arranged at such respective positions that, when the rotating member is at the initial position or the home position, the sensors can be satisfied with predetermined detecting conditions as shown in FIG. 8 by points to be detected 25, 26 (both not shown in FIG. 21 and FIG. 22) provided projecting at an outer periphery of the rotating member 62.

While the side door 2 is open, the rotating member 62 assumes at a position with the guide pin 63 positioned as shown by the solid line in FIG. 21. If the side door 2 is incompletely closed, the electric motor 21 is driven to cause the rotating member to begin rotating in the counterclockwise direction as viewed in FIG. 21. This rotation in turn causes circular motion of the guide pin 63 so that the drive cam 60, that is guided by the guide pin 63 through the elongate hole 61, is rotated in the counterclockwise direction from the neutral position. As a result, the latch 5 is forcibly rotated, due to the engagement of the second ratchet 14 with the engaging groove 5*d*, from the half latch position to the full latch position. When the drive cam 60 is rotated to a position shown by the chain line in FIG. 22, the first ratchet 9 engages with the engaging surface 5*b*, thereby restricting the latch 5 within the full latch position. In this manner, the side door 2 is completely locked (fully latched). Thereafter, when the drive cam 60 is returned to the neutral position shown in FIG. 21, the electric motor is halted of drive.

If the opener is operated to open the side door 2, the electric motor 21 is started of drive. The rotating member 19 is rotated in the counterclockwise direction as viewed in the figure from the home position (the state that the guide pin 63 is at the position shown by the chain line in FIG. 21), which causes the drive cam 60 in the clockwise direction from the neutral position. The drive cam 60 comes to abutment against the pin 23 to thereby cause the first ratchet 9 to be rotated in a manner depressed away therefrom. When the drive cam 60 is rotated to a position shown by the solid line in FIG. 22, the engagement of the engaging surface 5*b* by the first ratchet 9 is released. Thus, the latch 5 rotates to return in a urged direction, releasing the striker 3 from the restriction by the latch 5. Thereafter, when the rotating member 62 returns to its initial position, the drive of the electric motor 21 is halted.

As explained in detail above, the present embodiment provides the following effects, (1) The elongate hole 61 of the drive cam 60 is inserted by the guide pin 63 provided projecting on the rotating member 62 at an eccentric location so that the circular motion in the rotating member 62 is converted into the swing motion in the drive cam 60. Therefore, it is possible to omit the link 20 employed in the first embodiment, further simplifying the structure of connecting between the rotating member 62 and the drive cam 60. To this end, the omission of the link 20 and its coupling shaft, etc. can reduce the relative number of parts, with the assembling process simplified.

(2) The structure of directly coupling between the rotating member 62 and the rive cam 60 through the guide pin 63 makes possible collective arrangement of a latch device including the latch 5 and the actuator 17 placed closing to each other than in the structure of the first embodiment.

Fifth Embodiment

The fifth embodiment of the present invention will then be explained with reference to FIG. 23 through FIG. 33. This embodiment makes possible appropriate door opening and closing even where the electric motor is abnormal in operation.

Figure 23:
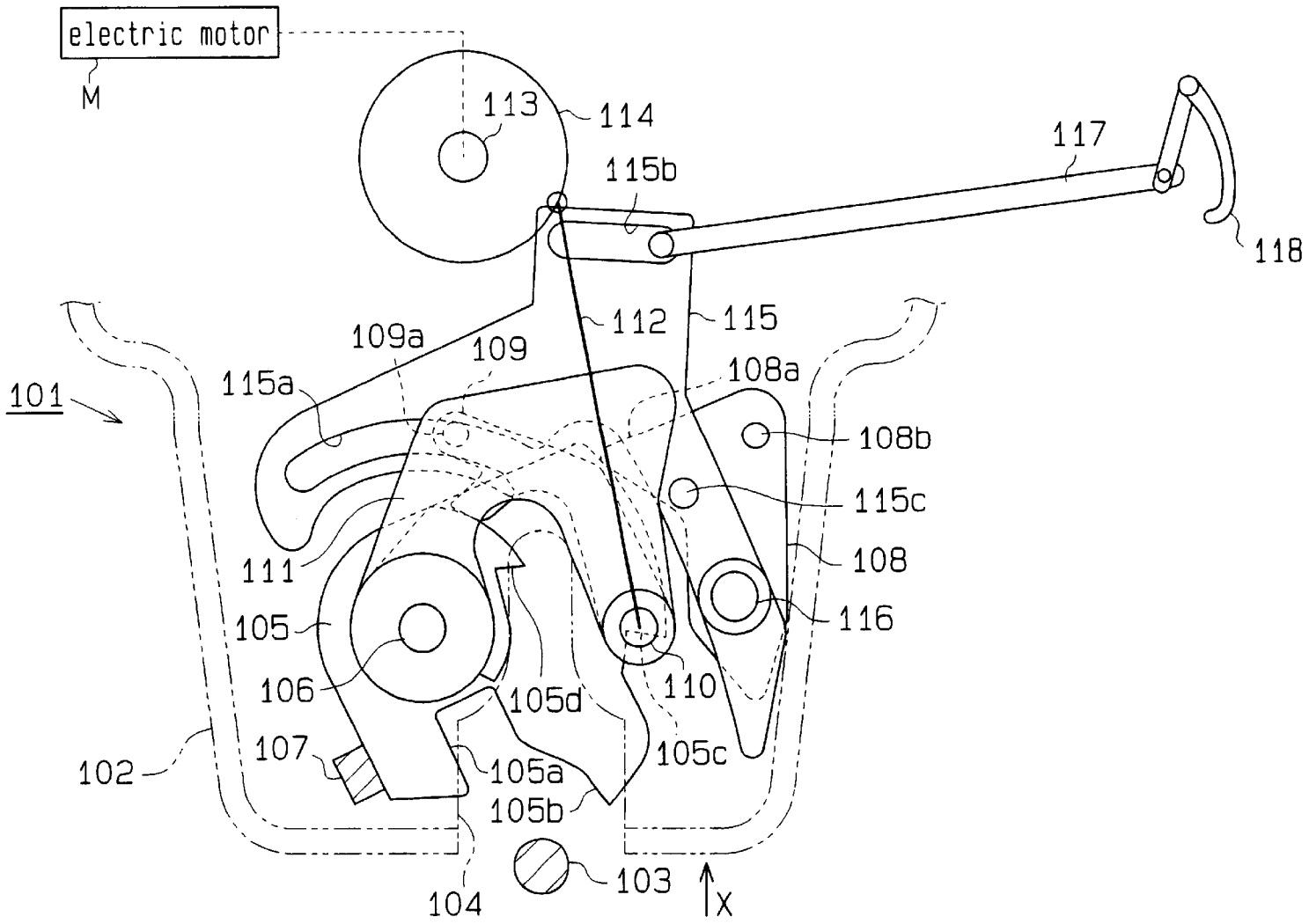
FIG. 23 is a top plan view showing a closing apparatus according to a fifth embodiment of the invention.
Figure 24:
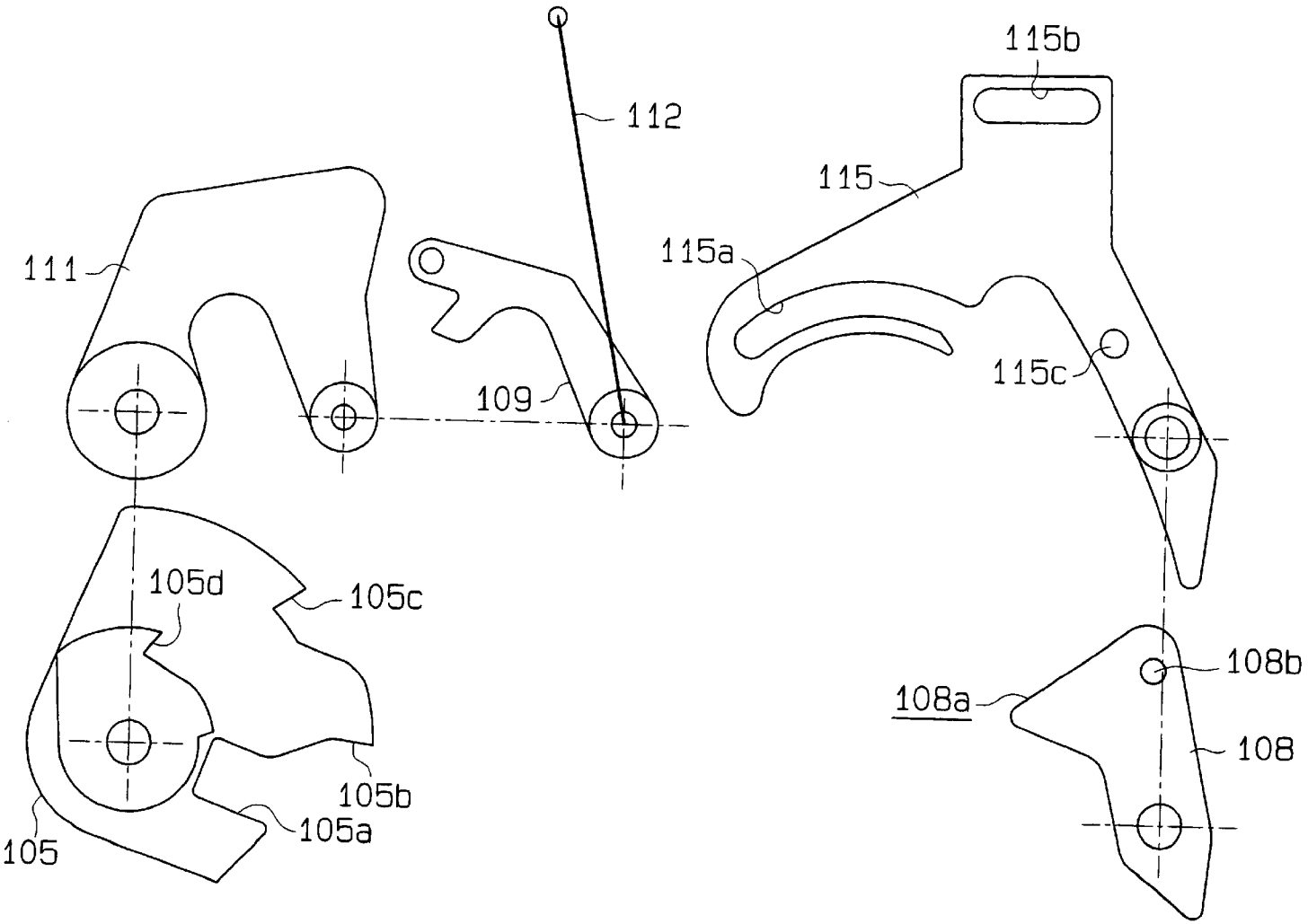
FIG. 24 is a exploded top plan view individually showing the components of the closing apparatus of FIG. 23.
Figure 25:
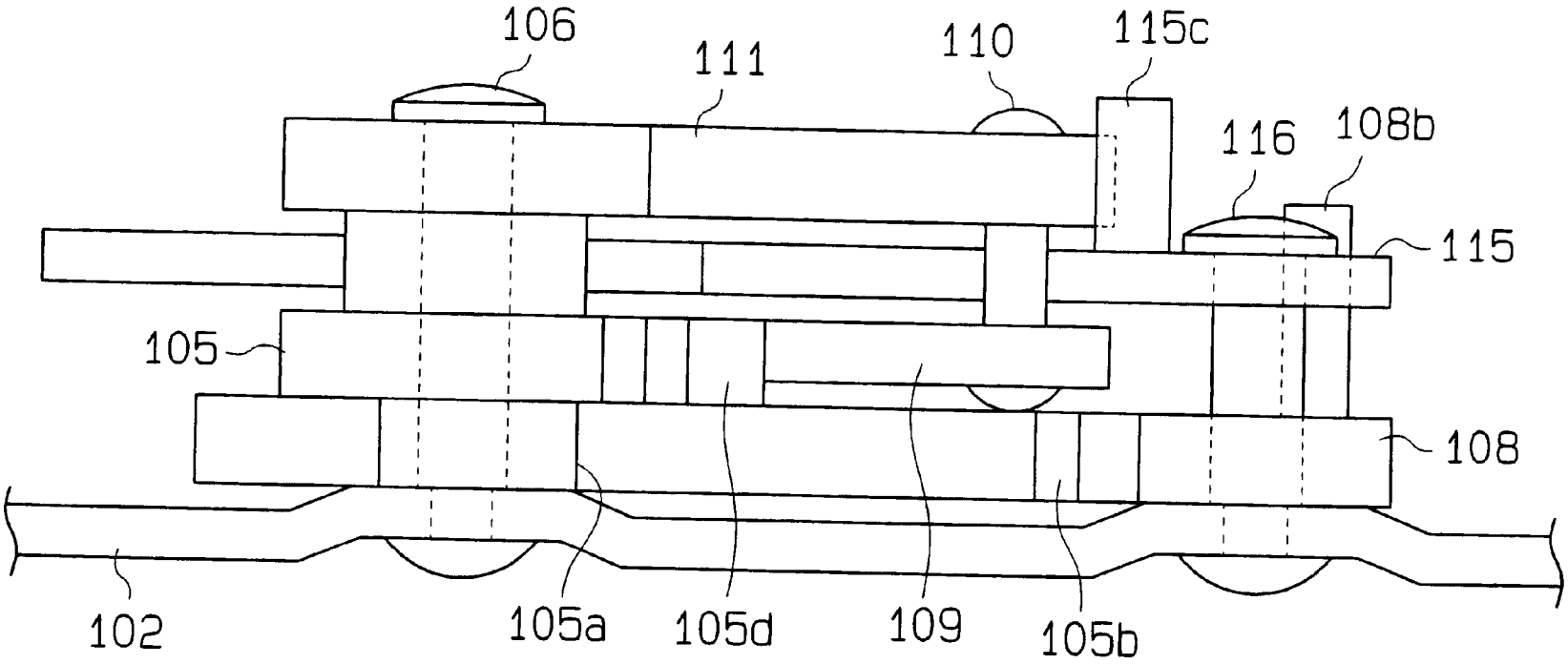
FIG. 25 is a side elevation showing the closing apparatus and taken in a direction X of FIG. 23.

FIG. 23 is a plan view of an overall structure of a door closing apparatus 101, FIG. 24 is a plan view of individual parts disassembled from the door closing apparatus 101, and FIG. 25 is a side view of the door closing apparatus 101 as viewed in a direction of the arrow X. Incidentally, in FIG. 24 the parts are shown by extending assembling lines (one-dot-chain lines) according which they are assembled.

The door closing apparatus 101 is incorporated in a door 102 as a door member at a location opposed to a striker 103 provided on a vehicular body side so that the striker 103 as an engaging portion is forcibly pulled into a full latch state to completely closing the door 2 if the door 102 is incompletely closed (half latched).

Referring to FIG. 23 through FIG. 25, the door closing apparatus 101 has a latch 105 generally in a disk for mn provided in the vicinity of an insertion passage 104 into which the striker 103 is to be inserted. The latch 105 is arranged for rotation about a support shaft 106, which is urged by a torsion spring, not shown, in a clockwise direction as viewed in the figure. The latch 105 is confined in position with respect to the urging direction by a stopper 107. When the latch 105 is confined in position by being abutted against the stopper 107, the latch 105 assumes an unlock position that the striker 103 is released from the restriction by the latch 105.

The latch 105 is formed in a two-stage form in section to be thickened in wall thickness on the side of a rotational center, so that two outer peripheries are provided at upper and lower sides. The latch 105 is formed, at the outer periphery of the lower stage thereof, with a recess 105*a* for restricting the striker 103, an engaging surface 105*b* to be placed in engagement at a full latch position, and an engaging surface 105*c* to be placed in engagement at a half latch position, and at the outer periphery of the upper stage thereof, with an engaging groove 105*d*. The engaging surfaces 105*b*, 105*c* and the engaging groove 105*d* are located almost close to one side (almost rightward of the support shaft 106 in FIG. 23) with respect to the rotational center of the latch 105 supported by the support shaft 106.

A first ratchet 108 as an engaging member is urged by a spring, not shown, in a direction close to the outer periphery of the latch 105, for rotation about a support shaft 116. The support shaft 116 is fixed on the side of the door 102 as shown in FIG. 25. With such arrangement, when the first ratchet 108 at a latch surface 108*a* engages with the engaging surface 105*c*, the latch 105 is placed in restriction to the half latch position. When the latch surface 108*a* engages with the engaging surface 105*b*, the latch 105 is placed in restriction to the full latch position.

A drive cam 111 is arranged,on the support shaft 106 common to the latch 105 above the top surface (the side toward this of the page of FIG. 23) of the latch 105, for rotation about the support shaft 106. The drive cam 111 has a first end of a straight-formed link 112 rotatably connected to a portion thereof opposite to the portion supported by the support shaft 106. The link 112 has a second end rotatably connected to a rotating member 114 at around an outer periphery thereof, which rotating member is fixed on an output shaft of a motor M for rotation therewith. This link 112 constitutes a power transmitting mechanism, the shape of which is not necessarily be limited to the straight form, but may arbitrarily be modified for example to a curved form, provided that the rotational motion in the rotating member 114 is transmittable to the drive cam 111. FIG. 23 shows a neutral position of the drive cam 111, wherein the drive cam 111 is swingable left and right with respect to the neutral position.

The electric motor M is a power source of the door closing apparatus 101, which is rotatable basically in one direction only (counterclockwise in FIG. 23 in this embodiment.). The present embodiment employs a high-speed and small-sized motor. The output of the electric motor M is coupled to the output shaft 113 through a speed-reducing mechanism to provide required rotational speed output. That is, the output of the electric motor M is reduced of speed to be delivered as a predetermined rotational speed through the output shaft 113.

A second ratchet 109 is arranged at a height almost the same as the upper stage of the latch 105, and coupled through a support shaft 110 to the drive cam 111 for rotation thereabout. A spring, not shown, is stretched between the second ratchet 109 and the drive cam 111 so that the second ratchet 109 is urged for abutment against the outer periphery of the upper stage of the latch 105 having engaging groove 105*d* formed therein. The second ratchet 109 has a free end having a pin 109*a* vertically provided at the tip thereof.

When the first ratchet 108 is in engagement with the engaging surface 105*c*, the second ratchet 109 engages with the engaging groove 105*d*. In this state, if the drive cam 111 is rotated about the support shaft 106 in the counterclockwise direction as viewed in FIG. 23, the latch 105 engaged by the second ratchet 109 through the engaging groove 105*d* is forcibly rotated, together with the drive cam 111, in the counterclockwise direction as viewed in the figure.

A fork 115 as a swing member, arranged between the drive cam 111 and the second ratchet 109, is supported on the support shaft 116 coaxially with the first ratchet 108. The fork 115 is formed, at an upper portion, an elongate hole 115*b* attached with one end of a rod 117 for movement. The rod 117 has the other end coupled with a door handle for manually opening a door 102. Consequently, if the door handle 118 is operated to pull the rod 117 rightward as viewed in the figure, the fork 115 is rotated in the counterclockwise direction as viewed in the figure. Note that the fork 115 shown in FIG. 23 denotes a position rested in a door open state. The fork 115 is formed with a guide groove 115*a* for guiding the pin 109*a* of the second ratchet 109.

Also, the fork 115 is formed with a vertical pin 115*c* that is engageable with the outer periphery of the drive cam 111. On the other hand, the first ratchet 108 has a pin 108*b* as a disengaging member that is engageable with an outer periphery of the fork 115. Consequently, when the drive cam 111 is rotated about the support shaft 106 in the clockwise direction as viewed in the figure, its outer periphery engages with the pin 115*c* of the fork 115. At this time, the fork 115 is rotated about the support shaft 116 in the clockwise direction and placed into engagement with the pin 108*b* of the first ratchet 108. The fork 115 is also rotated about the first ratchet 108 in the clockwise direction. By this series of operations, the first ratchet 108 in the full latch position is depressed away from the engaging surface 105*b* of the latch 105, thereby allowing the door to be opened.

Figure 28:
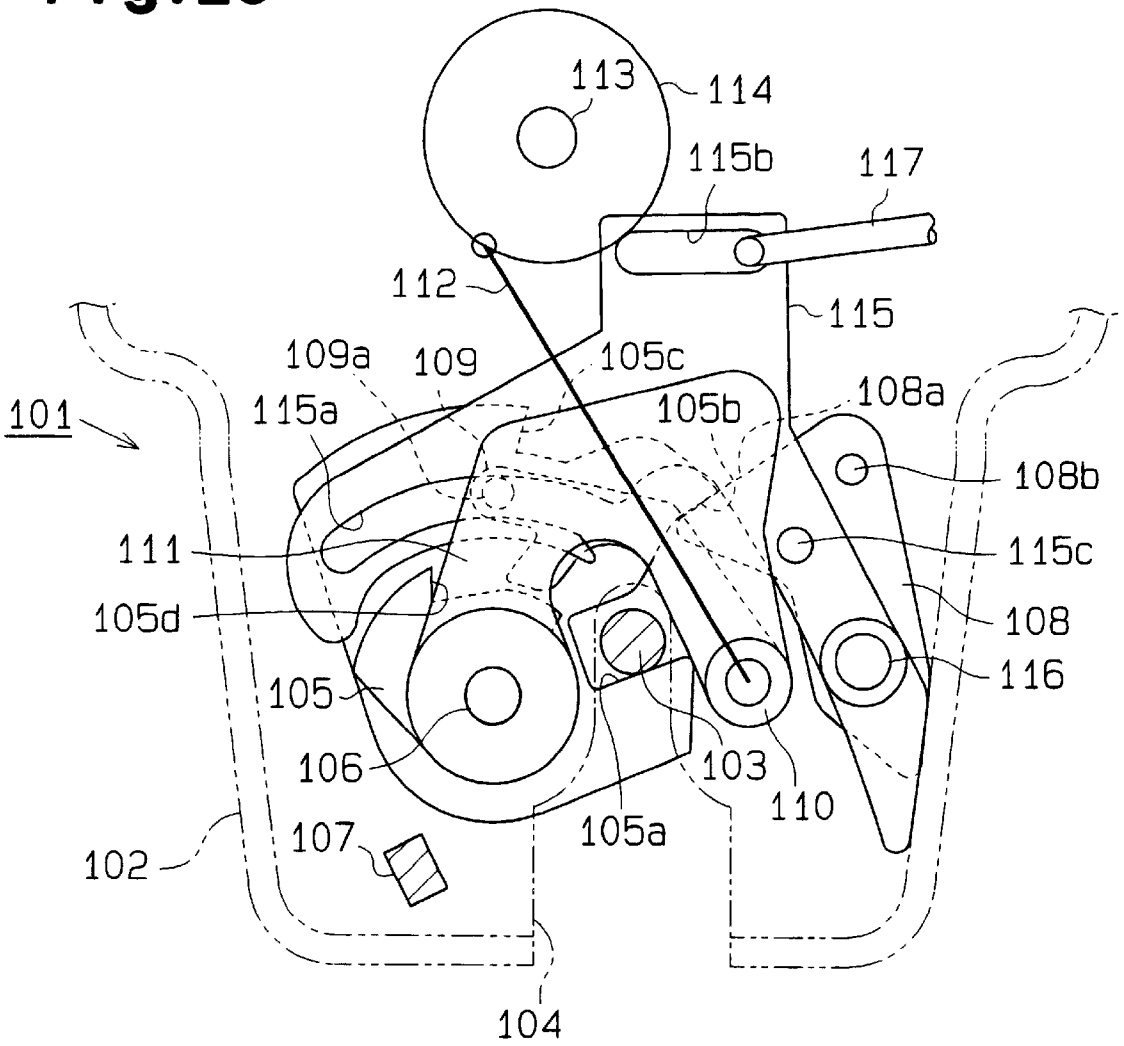

Here, the rotating member 114 shown in FIG. 23 is at an initial position. When the door 102 is opened, the rotating member 114 is always positioned at the initial position. On the other hand, the rotating member 114 shown in FIG. 28 is at a home position. When the door 102 is completely (full latch) closed, the rotating member 114 always positioned at the home position. In the state that the rotating member 114 is, positioned either one of these two states, the drive cam 111 assumes at a neutral position.

Figure 26:
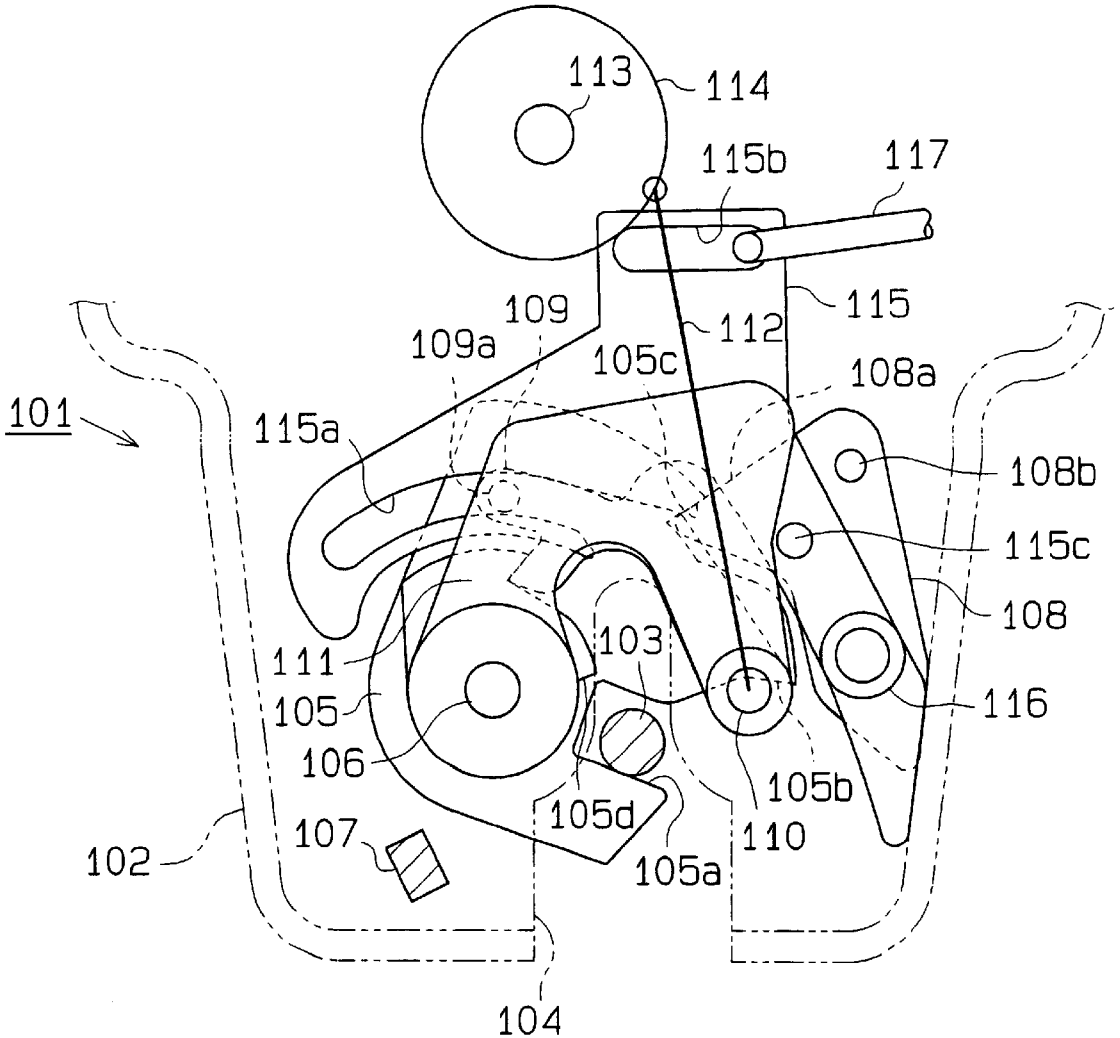
FIGS. 26 to 30 are top plan views for explaining the actions of the closing apparatus of FIG. 23.
Figure 27:
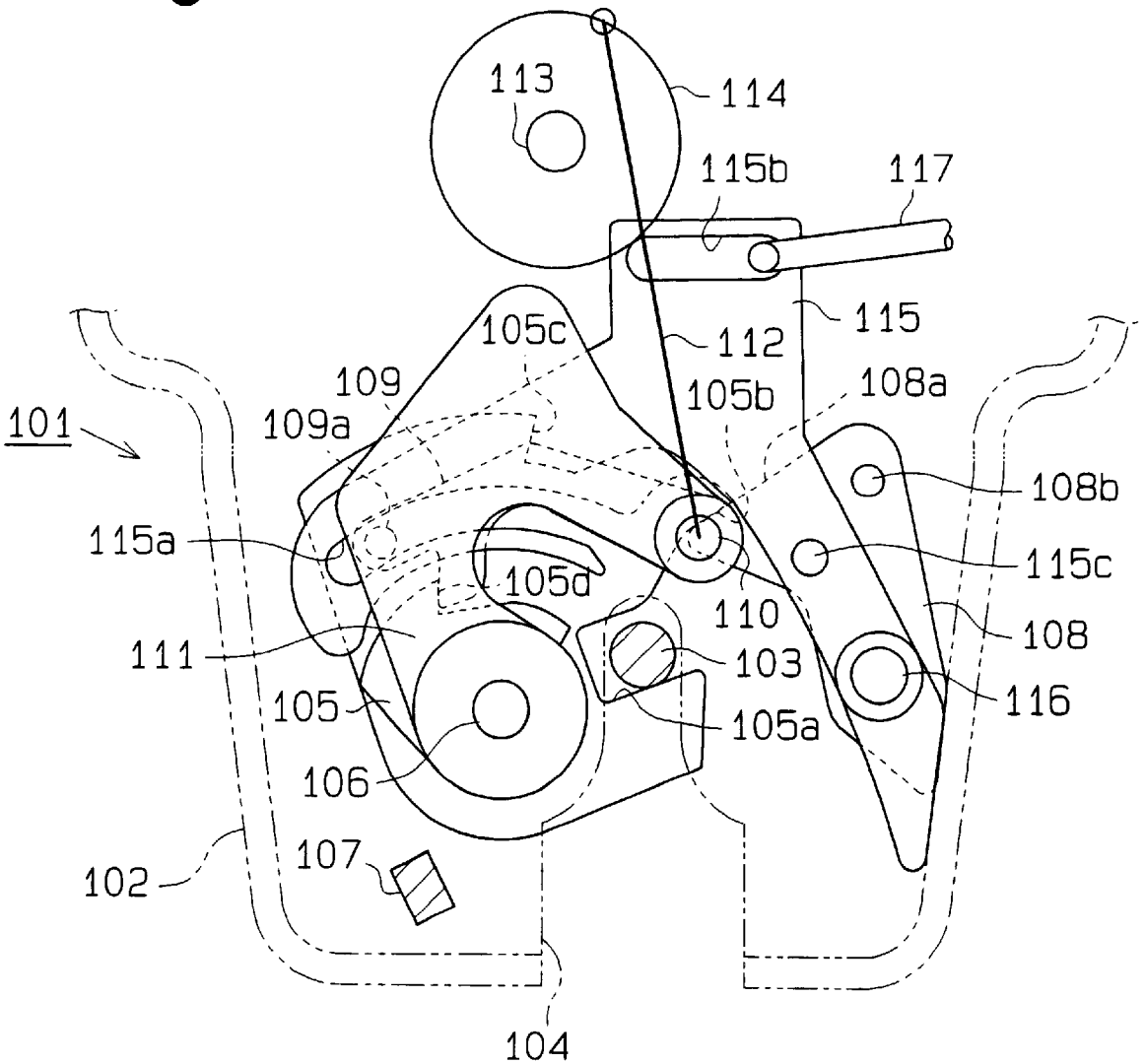

In the state that the latch 105 is at the half latch position shown in FIG. 26, if the rotating member 114 is rotated in the counterclockwise direction from the initial position to the home position, the drive cam 111 is moved by one cycle from the neutral position back to the beginning neutral position. This swing process (swing range) of the drive cam 111 is a first swing range, wherein in the half latch position when the second ratchet 109 engaged with the engaging groove 105*d* of the latch 105 is depressed leftward as viewed in the figure, the latch 105 is forcibly rotated from the half latch position to the full latch position.

On the other hand, in the state that the latch 105 is at the full latch position shown in FIG. 28, if the rotating member 114 is rotated in the counterclockwise direction from the home position to the initial position, the drive cam 111 is moved by one cycle from the neutral position back to the beginning neutral position. This swing process (swing range) of the drive cam 111 is a second swing range, wherein the drive cam 111 at its outer periphery engages with the pin 115*c* of the fork 115 to swing the fork 115 about the support shaft 116. Further, the fork 115 at its outer periphery is placed into engagement with the pin 108*a* of the first ratchet 108 constituting the disengaging means to depress the first ratchet 108 away from the latch 105 against its urging force, releasing the engagement by the first ratchet 108 restricting the latch 105 in the full latch position (or half latch position).

In the meanwhile, as another means for releasing the engagement by the first ratchet 108 restricting the latch in the full latch position (or haft latch position), it is possible to operate the door handle 118 to cause the fork 115 to forcibly swing. In such a case, the fork 115 at its outer periphery engages with the pin 108*a* of the first ratchet 108, and the first ratchet 108 is depressed in a direction away from the latch 105 to thereby release the full latch (or half latch) state.

Figure 29:
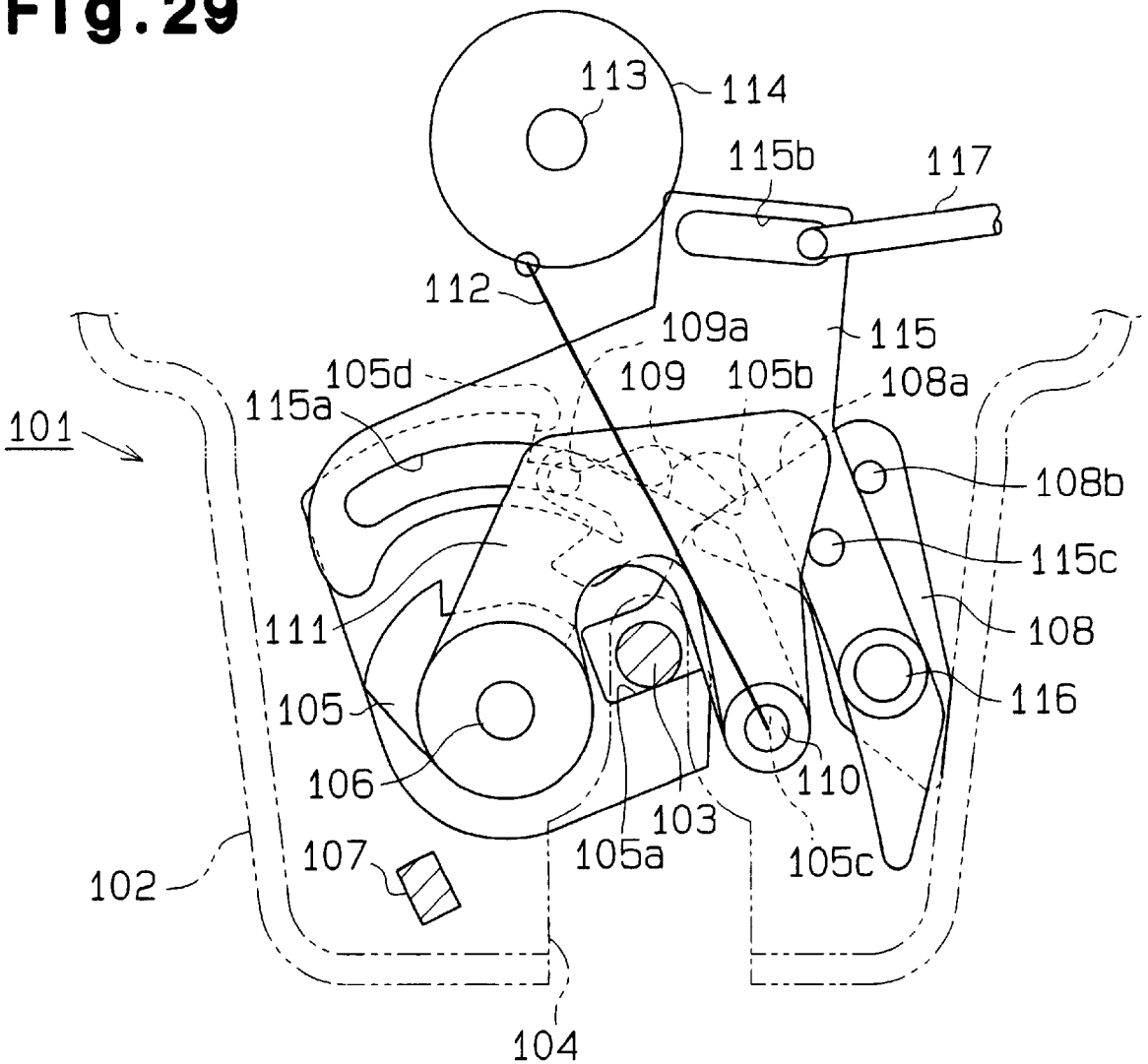
Figure 30:
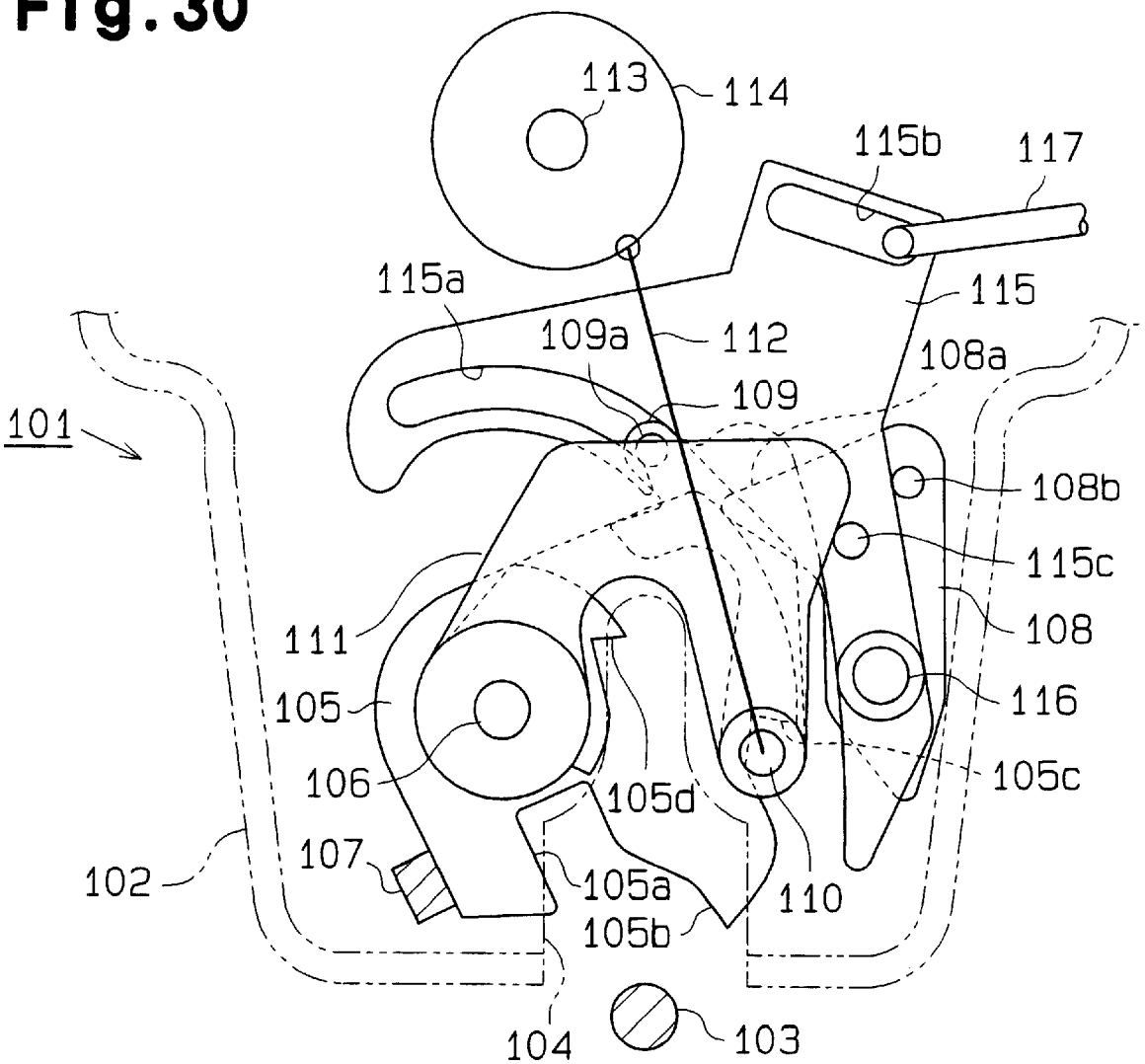

When the drive cam 111 depresses away the first ratchet 108 through the fork 115, the pin 109*a* of the second ratchet 109 is guided along the guide groove 115*a* of the fork 115. Accordingly, when releasing the engagement of the latch 105 by the first ratchet 108, the second ratchet 109 is placed at a position spaced from the outer periphery of the latch 105 as shown in FIG. 28 through FIG. 30. To this end, when the latch 105 is released from the engagement by the first ratchet 108 and then rotated to return by the urging force to the unlock position, the second ratchet 109 will not engage with the engaging groove 105*d*.

Figure 31:
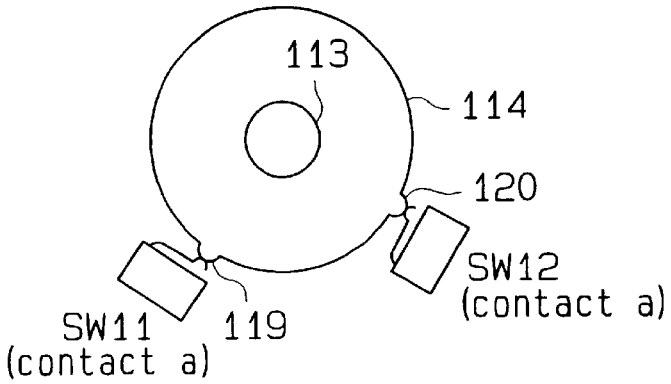
FIG. 31 presents top plan views for explaining the actions of various sensors of the closing apparatus of FIG. 23.
Figure 31:
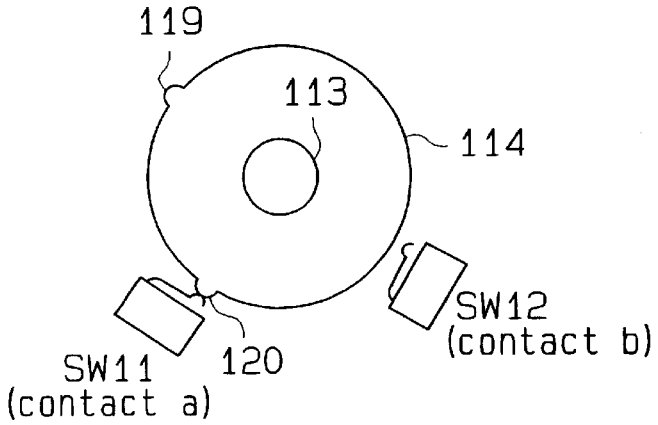
Figure 31:
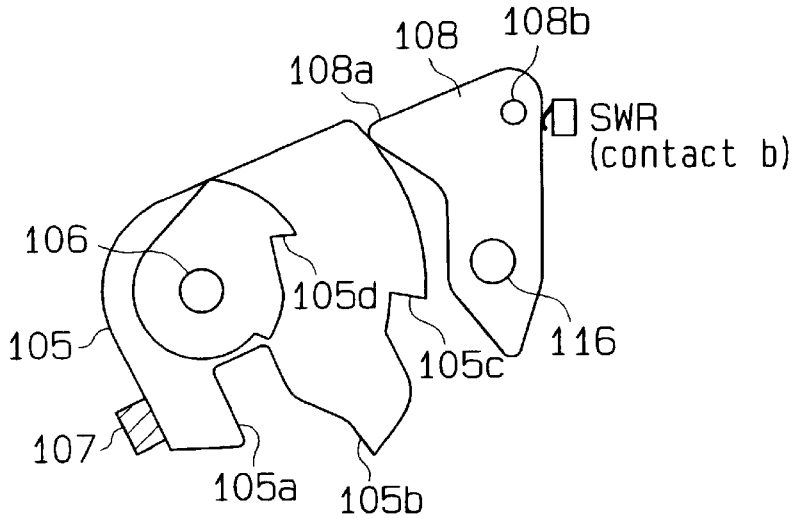

The rotating member 114 has two points to be detected 119, 120 projected at the outer periphery thereof as shown in FIG. 31. The locations of the points to be detected 119, 120 are determined to have such a center angle therebetween that is equivalent to the angle of rotation of the rotating member from the home position to the initial position. In the present structure, the second end of the link 112 (e.g., the upper end in FIG. 23) is connected at a location close to one point to be detected 120.

A sensor (micro-switch) SW11 as a second detector and a sensor (micro-switch) SW12 as a third detector are placed at such locations that they can respectively be contacted with the points to be contacted 119, 120 when the rotating member 114 is at the home position. A sensor (micro-switch) SWR as a first detector is also provided on the back side of the first ratchet 108 to detect whether or not the first ratchet 108 is in engagement with any of the engaging surfaces 105*b*, 105*c*.

Figure 32:
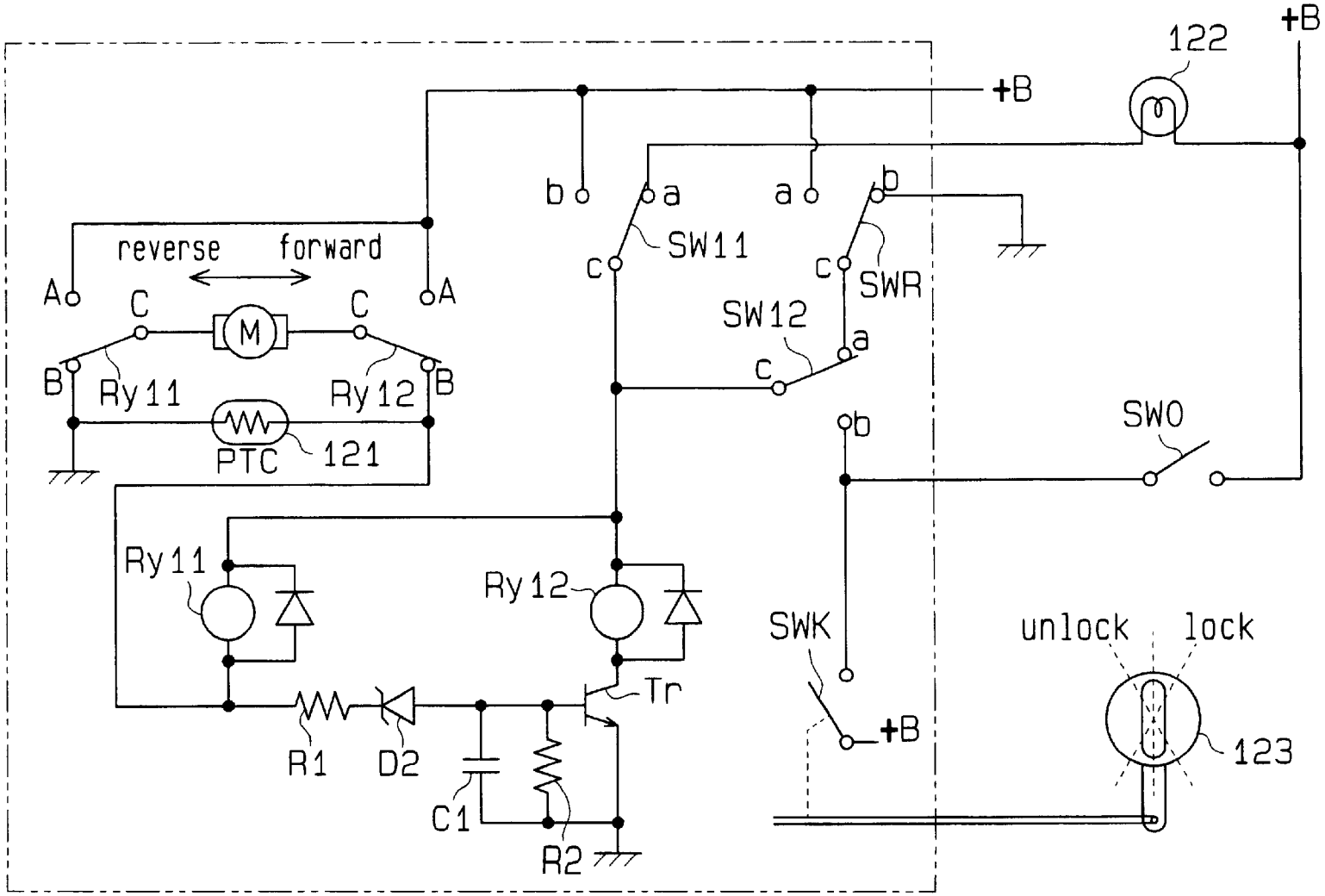
FIG. 32 is a circuit diagram showing a construction of the control system of the closing apparatus of FIG. 23.

The sensors SW1, SW2 and SWR operate as shown in FIG. 31 and FIG. 32. Here, FIG. 31(*a*) shows a state when the door is open, that is, the stoppage position of the rotating member 114 at the initial position, while FIG. 31(*b*) shows a state when the door is closed, that is, the stoppage position of the rotating member 114 at the home position. FIG. 32 shows a control circuit for control the drive by the electric motor M, wherein the sensors are representative of a state when the door is open.

As shown in FIG. 31(*a*), FIG. 31(*b*) and FIG. 32, the sensor SW11 is connected to a "contact a" when its detecting portion is contacted with the point to be detected 119, 120, and connected to a "contact b" when out of contact with 120 the point to be detected 119, 120. The sensor SW12 is connected to a "contact a" when its detecting portion is contacted with the point to be detected 119, 120, and connected to a "contact b" when out of contact with the point to be detected 119, 120. The sensor SWR as shown in FIG. 31(*c*) is connected to a "contact b" when its detecting portion is in contact with the first ratchet 108, and connected to a "contact a" when it is out of contact with the first catchet 108.

In FIG. 32, a battery voltage "+B" is connected to the contact b of the sensor SW11, the contact a of the sensor SWR, the contact A of a first relay Ry11, and the contact A of the second relay Ry12. The first and second relays Ry11, Ry12 are usually connected to the contact B and the contact C. When the relays Ry11, Ry12 are turned on, they are respectively connected to the contact A and the contact C. The first and second relays Ry11, Ry12 has their contacts C respectively connected to positive and negative terminals of the electric motor M . In this case, when an electric current flows from the contact C of the first relay Ry11 to the contact C of the second relay Ry12, the electric motor M is forwardly driven, while when a current flows from the contact C of the second relay Ry12 to the contact C of the first relay Ry11, the electric motor M is reversely driven. A PTC (positive temperature coefficient thermistor) 121 as a protection circuit is connected between the respective contacts B of the first and the second relay Ry11, Ry12.

The contact a of the sensor SW11 is connected to the battery voltage +B through a courtesy lamp 122, while the contact c of the same sensor is connected to the contact c of the sensor SW12, and the first and second relays Ry11, Ry12. The contact a of the sensor SW12 is connected to the contact c of the sensor SWR, while the contact b of the same sensor is connected to the switches SW0 and SWK for turning on/off for battery voltage +B supply. Here, the switch SW0 is turned on when the door is open by the operation of the opener. The switch SWK is turned on when operating for unlocking by a key switch 123. The contact b of the sensor SWR is grounded.

The first relay Ry11 is connected with the base of a transistor Tr through a resistance R1 and a zener diode Dz. The transistor Tr has the collector connected to the second relay Ry12. Between the base ad the emitter of the same transistor, a capacitor C1 and a resistance R2 are connected in parallel.

Figure 33:
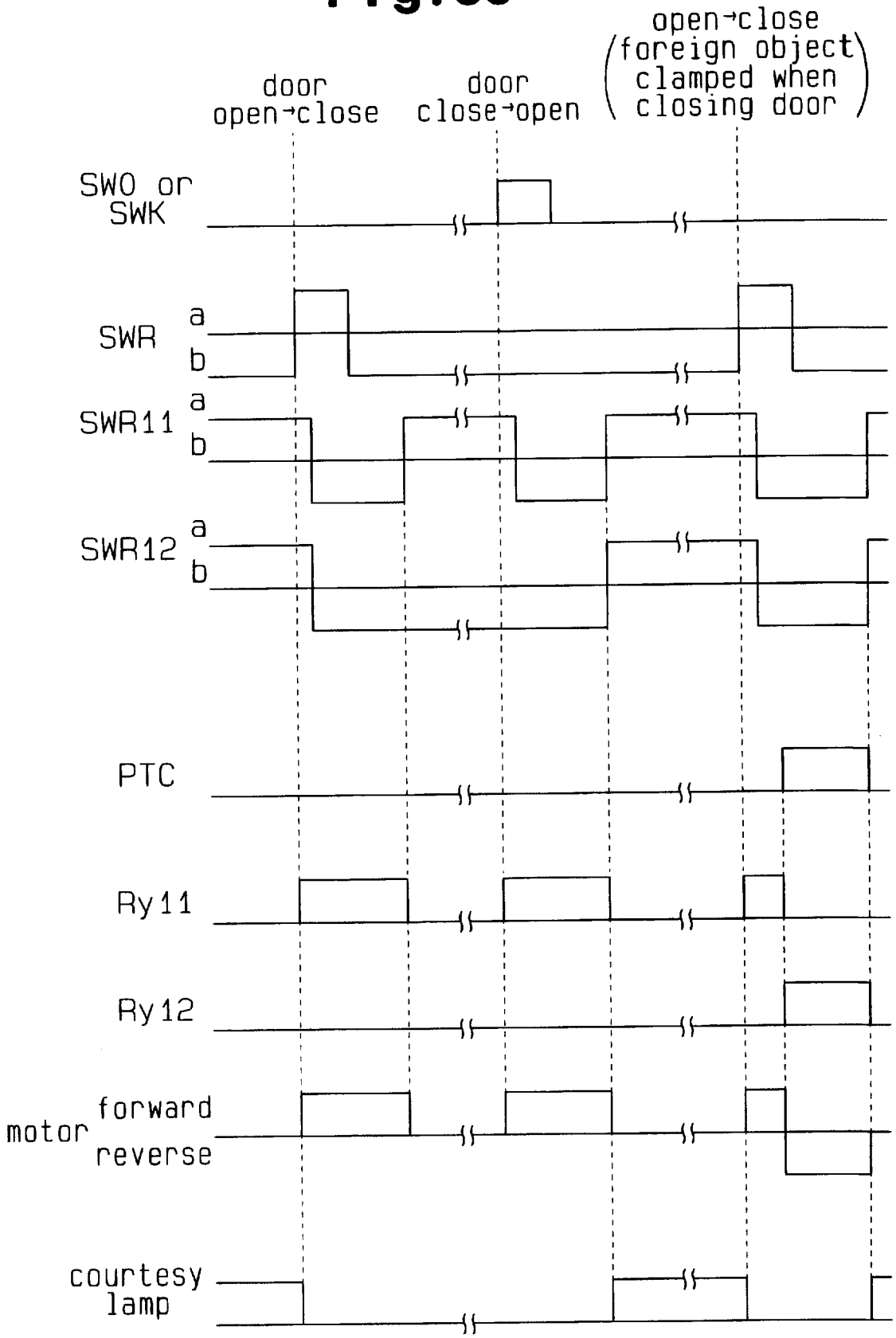
FIG. 33 Is a timing chart for explaining the actions of the control system of FIG. 32.

The operation of the door closing apparatus 101 constructed as above will then be explained with reference to a timing chart in FIG. 33.

First explained will be the operation of the door closing apparatus 101 when the door 102 is operated from the open state to the closing state. In the state that the door is open, the rotating member is positioned at an initial position as shown in FIG. 23. At this time, the sensors SW11, SW12 at their detecting portions are respectively in contact with the points to be detected 119, 120 so that they are contacted to their "points a" (the state of FIG. 31(*a*)). The sensor SWR is contacted to the "contact by", because the first ratchet 108 is not engaged with either one of the engaging surfaces 105*b*, 105*c* (the state of FIG. 31(*c*)). In such a case, the battery voltage +B is applied to and lit the courtesy lamp 122, due to the connections of a-and-c contacts in the sensor SW11, c-and-a contacts in the sensor SW12, and c-and-b contacts in the sensor SWR, as shown in the circuit diagram of FIG. 32.

It no sufficient force is applied to for closing the door 102 and accordingly the latch 105 is driven to rotate only to the half latch position by the striker 103 inserted into the insertion passage 104, the first ratchet 108 engages with the engaging surface 105*c*of the latch 105 so that the latch 105 is restricted in the half latch position. That is, the door 102 is incomplete in closure. In this state, the second ratchet 109 is in engagement with the engaging groove 105*d*, as shown FIG. 26. On this occasion, the first ratchet 108 engaged with the engaging surface 105*c* displaces toward the latch 105 so that the sensor SWR is switched over of connection from the "contact b" to the "contact a". This turns off the courtesy lamp 122.

When the sensor SWR is connected to the "contact a", a battery current flows through the first relay Ry11 due to the connections of a-and-c contacts in the sensor SWR and a-and-c contacts in the sensor SW12, connecting the contact C of the relay Ry11 to its contact A. At this time, the PCT 121 maintains a steady state to allow current flow. As a result, the electric motor M is energized in the forward direction to cause the rotating member 114 to begin rotating in the counterclockwise direction as viewed in FIG. 31(*a*) from the state shown in the same figure. When the rotating member 114 begins to rotate, the sensors SW11, SW12 at their detecting portions becomes out of contact with the points to be detected 119, 120, and the sensors SW11, SW12 switch over their connections from the "contact a", to the "contact b".

As the rotating member 114 is rotated in one counter clockwise direction, the drive cam 111 is rotated, through the link 112, in the counterclockwise direction as viewed in the figure from the neutral position. As a result, the second ratchet 109 engaged with the engaging groove 105*d* forcibly drives the latch 105 leftward as viewed in the figure, resulting in rotation of the latch 105 in the counterclockwise direction in the figure. Incidentally, although the sensor SWR is once connected to the "contact b" (omittedly shown in the time chart of FIG. 33) when the first ratchet 108 disengages from the engaging surface 105*c*, the sensor SW11 is already in connection to the "contact b" so that the electric current through the first relay Ry11 is not interrupted and hence the drive by the electric motor M is not halted.

As the rotating member 114 continues rotating due to the drive by the electric motor M, the first ratchet 108 at its latch surface 108*a* is placed into engagement with the engaging surface 105*b* of the latch 105, restricting the latch 105 to the full latch position. Thereupon, the sensor SWR again switches over in connection to the "contact b".

When the rotating member 114 further continues rotating to be contacted at its detecting portion 120 with the sensor SW11 (the state shown in FIG. 28 and FIG. 31(*b*)) and the sensor SW11 switches over in connection from the "contact b" to the "contact a", the first relay Ry11 is not supplied with electric current (non-exciting state) and has connection of its contact C to the contact B, halting the drive of the electric motor M. Incidentally, where the door 102 is completely (fully latched) closed instead of incomplete closure, the electric motor N similarly driven to place the rotating member 114 also at its home position. In this manner, whenever the door 102 is closed in the full latch state, the rotating member 114 always positions at its home position.

Then explanation will be made for the operation of the door closing apparatus 101 when the door 102 is operated from closure to open. In the state that the door is under locking, the sensor SW11 is in connection to the "contact c" and the sensor SW12 is in connection to the "contact b", and the sensor SWR is in connection to the "contact a".

For example, if the opener, not shown, provided on the door 102 or the key switch 123 is operated, the switch SW0 or SWK shown in FIG. 32 is turned on. Thereupon, a battery current flows through the first relay Ry11 (exciting state) because the sensor SW12 is in connection to the "contact b". Consequently, the contact C of the first relay Ry11 is connected to the "contact A" to start the drive of the electric motor M. The drive of the electric motor M causes the rotating member 114 to begin rotating in the counterclockwise direction as viewed in FIG. 28. Incidentally, the start of rotation of the rotating member 114 causes switch over of the sensor SW11 from the contact a to the contact b.

By the rotation of the rotating member 114, the drive cam 111 is rotated through the link 112 in the clockwise direction as viewed in FIG. 28 from its neutral position, placing the outer periphery thereof in abutment against the pin 115*c* of the fork 115. Thus, the fork 115 is rotated about the support shaft 116 in the clockwise direction. When the fork 115 is rotated, the outer periphery thereof is placed into abutment with the pin 108*b* of the first ratchet 108. Thus, the first ratchet 108 is rotated clockwise about the support shaft 116.

When the drive cam 111, the fork 115 and the first ratchet 108 are systematically rotated in this manner by the rotation of the rotating member 114, the first ratchet 108 at its latch surface 108*a* becomes disengaging from the engaging surface 105*b* of the latch 105, as shown in FIG. 30. As a result, at a time when the engagement between the first ratchet 108 and the latch 105 is released, the latch 105 is returned by rotation clockwise as viewed in the figure about the support shaft 106 by a torsion spring, not shown, to a position abutted against the stopper, that is, it is restricted in the unlock position. In this manner, the striker 103 is released from the restriction by the recess 105*a* of the latch 105, unlocking the door 102.

After the latch 105 revolves to return to the lock release position, the rotary body 114 continues its rotary motion until parts to be detected 119 and 120 abut the detecting parts of sensors SW11 and SW12. When the parts to be detected 119 an 120, respectively, transfer from the connection status with the "contact b" to the connection status with the "contact a" no current will run to the first relay Ry11 in FIG. 32 (non-excitation status). Then, the contact C of the first relay Ry11 abuts the contact B and operation of the electric motor M stops. The courtesy lamp 122 lights up again. In this manner, the rotary body 114 makes one turn from the initial position and returns, again, to the initial position. There follows this process, in which the rotary 114 turns around in a specified direction whenever the opening and closing operation of the door 102 is repeated, making one turn as the door 102 makes one opening and closing.

Incidentally, in the event that during the process of transfer from the open condition to the closed condition of the door 102, an overload operation of the electric motor M should occur as a result of foreign objects being held in the door 102, the PTC 121 will generate heat due to overload current to the electric motor M, so that when that temperatures rises to the pre-set temperature range (e.g., over 120° C.), the resistance of the PTC 121 will sharply increase. Upon activation of the PTC 121 due to this overload current, the transistor Tr turns on, current runs to the second relay Ry12 in lieu of the first relay Ry11, and the connection of the second relay Ry12 with the contact B switches over to the contact A. Consequently, the electric motor M runs in reverse, forcing the door 102 to return to the open condition.

On the other hand, in the above-mentioned door closing apparatus 101, for example, if the electric motor M suffers some disorder such as faulty operation with the door 102 in the completely closed condition, that is, the door closing apparatus 101 in the full-latched condition, there is a possibility that the opening operation of the door 102 may be rendered impossible. In such condition of the operating failure of the electric motor M, the door closing apparatus 101 is designed to be manually handled as shown hereunder.

Namely, in the full-latched condition shown in FIG. 28, when the rotary body 114 cannot rotate by the electric motor M, the driving cam 111 is unable to rotate while remaining in the neutral position. In this case, action is to urge the rod 117 linked to the door handle 118 to the right direction of the Figure. Then the fork 115 rotates clockwise with respect to the support shaft 116, the outer periphery thereof coming in abutment with the pin 108*b* provided upright on the first ratchet 108. By means of this operation of the fork 115, the first ratchet 108 rotates clockwise with respect to the support shaft 116, or in a direction of releasing engagement between the latch 105 and the first ratchet 108 to release the engagement between the engaging surface 105*b* and the surface 108*a*.

As the engagement between the latch 105 and the first ratchet 108 releases in this manner, due to the urging of a twist spring not illustrated herein, the latch 105 rotates back to the lock release position, thus permitting the opening of the door 102.

As described above, this preferred embodiment provides the desired effect according to this invention in the same way as the first embodiment through the fourth embodiment which have been explained. Further, the following effect is obtained.

(1) There is provided a fork 115 as a swing member which is constructed to make it possible to drive either the driving cam 111 or manual operation. As a result, for example, when the electric motor M has such an operating failure as to make it impossible for the motor M to release engagement between the latch 105 and the first ratchet 108, the above-mentioned engagement status can be released by driving the fork 115. Hence, in the defective status described above, it is impossible to avoid circumstances wherein the door 102 cannot be opened.

(2) In this embodiment, the fork 115 and the first ratchet 108 are arranged to provide for rotation with respect to the same support shaft 116. Consequently, despite an added construction of the fork 115, an increase in the size of the door closing apparatus 101 can be minimized.

(3) The pin 109*a* of the second ratchet 109 is disposed in the guide groove 115*a* of the fork 115 so that the free end of the second ratchet 109 moves along the above-mentioned guide groove 115*a*. The result is that when the full latched status or the half-latched status is released, the second ratchet 109 can perform operation of the latch 105 without interfering with the return to rotation of the latch 105.

The following modifications can be implemented on each of the foregoing embodiments:

(1) The reversible motor capable of reversing operation as a driving source, for example, means such as direct connection of the output shaft of the reversible motor to the rotary shaft of the cam is used to enable a construction to be established, wherein reversible operation of the reversible motor permits the cam to be in swing motion between the first swing region and the second swing region.

(2) In each of the above-mentioned embodiments, the latch and the driving cam use the same support shaft and are arranged thereon. However, so long as the centerlines of respective rotary shafts are in an approximately parallel state, it is not required that both the latch and the drive be on the same support shaft.

(3) In each of the above-mentioned embodiments, a region of rotation for the pull-in means to activate is set to be from an angle of rotation (=0° to approx. 260°) and a region of rotation to activate the engagement releasing means is set to be from an angle of rotation (=260° to approx. 360°). Be that as it may, each region of rotation can be set as necessary.

(4) In each of the above-mentioned embodiments, the pull-in operation of the first ratchet and the release operation of the second ratchet are designed to be executed by means of swing motion of one driving cam. However, it may be so designed that the pull-in operation of the first ratchet and the release operation of the second ratchet can be performed individually by the movement of two pieces of cam, for example, by using two pieces of cam which are respectively linked to two link works linked to the rotary body to be driven individually.

(5) In each of the above-mentioned embodiments, an actuator provided with a reduction gear is employed, whereas a construction wherein the rotary body is linked to the drive shaft of the electric motor exclusively for driving unidirectional rotation may be adopted. Use of a low-speed electric motor will be able to secure the desired speed of operation.

(6) The rotary body is not confined to those in circular shape. As long as it is so constructed as to produce a unidirectional circular motion, it suffices. For instance, it may be a bar-shaped member such as a clank linked to the output shaft.

(7) The construction used is that which converts the rotary motion of the rotary body to the swing motion of the driving cam. Nevertheless, it may be of such construction that the driving cam is designed not to vibrate but to rotate unidirectionally in linkage to the rotary body by way of a power transmission device such as link work or guide pin. In this instance, for example, the center of rotation of the driving cam is set up at a position different from the center of rotation of the latch. While the driving cam makes one turn, the next function is accomplished.

First, as the driving cam start rotating from the initial position, the driving cam engages and pivots the latch in a direction of forcing the latch, whereupon the engagement is released upon rotating to a preset angle. Thereafter, when the driving cam is rotated, this time it engages the first ratchet (or a pin etc. provided there) to push away the first-ratchet as if evacuating the first ratchet, and the engagement with the first ratchet is released upon rotating to a preset angle, thus completing one turn. In this construction, too, since the motor driven for unidirectional rotation can be used as the power source, it is possible to make the closing apparatus small and simplify the control circuit.

(8) In case a construction of rotating the driving cam unidirectionally as pin (7) above, a construction of directly linking the driving came to the output shaft of the actuator or the drive shaft of the electric motor can be employed. According to this construction, inasmuch as the rotary body can be dispensed with, it contributes to reducing the number of parts. Also, if each of the sensors SW1 and SW2 for detecting the rotary position of the rotary body is provided for instance so as to detect the part to be detected which is set up on the driving cam, drive control of the electric motor can be conducted in the same way.

(9) The second and third detectors can be made up first by forming a predesignated pattern of the conductive part on the outer periphery, surface, or backside of the rotary body, whereafter contacts are made to slide over the surface on which such pattern is formed, and by means of sending or stopping a current between contacts, the angle of rotation of the rotary body is detected.

(10) Objects to be detected by the first and second detectors are limited to the rotary body. Take, for instance, the link 20 as the object to be detected. Such a construction that depending on the angle of posture of the link 20, the initial position and the home position are detected are acceptable.

(11) The guide part which engages the engaging pin and guides such pin is designed to be a long aperture in the fourth embodiment mentioned above. This may be a recess of a long and narrow shape.

(12) In lieu of the above-mentioned control circuit, the electric motor drive control may be conducted by micro computer control such as ECU (Electronic Control Unit).

(13) In each of the above-mentioned embodiments, it is not necessary for a pin as means of releasing engagement to be of cylindrical construction as mentioned above. It may be formed by bending a part of the first ratchet by the press machine. Likewise, the pin 115*c* provided upright on the fork 115 as used in the fifth embodiment may be constructed by bending and forming a part of the fork 115.

(14) In the construction shown in FIG. 1 of the foregoing first embodiment or in the construction shown in FIG. 11 of the second embodiment above, a swing member (a fork) may be provided as embodied in the fifth embodiment described above. In this case, even in the event of an actuator breakdown, the opening and closing operation of the door becomes possible by manually handling the swing member.

(15) The fork 115 as the swing member and the first ratchet 108 as the engaging member are constructed on the same axis in the fifth embodiment described above. But it is not necessarily limited to such construction. It is acceptable for both members to be supported by different support shafts.

(16) In the fifth embodiment described a above, as FIG. 23 shows, the fork 115 driven by either the driving cam 111 or manual operation is directly connected to the door handle 118 via the rod 117. However, a gear device or link work may be interposed between both members to improve operability in manual operation.

(17) The locking and unlocking apparatus of this invention may be applied to door bodies other than side doors and trunks. For instance, this invention is applicable to back doors and sunroofs. In other words, this invention can be applied too all kinds of door bodies which require locking and unlocking.

Sixth Embodiment

Referring next to FIG. 34 to FIG. 49, there is shown the sixth embodiment according to this invention. The closing apparatus of this embodiment is positioned at the central position P of a length H in the direction of car width of a trunk door 32 of a car 71, for example, as in the same case of the closing apparatus 31 shown in FIG. 10.

Figure 35:
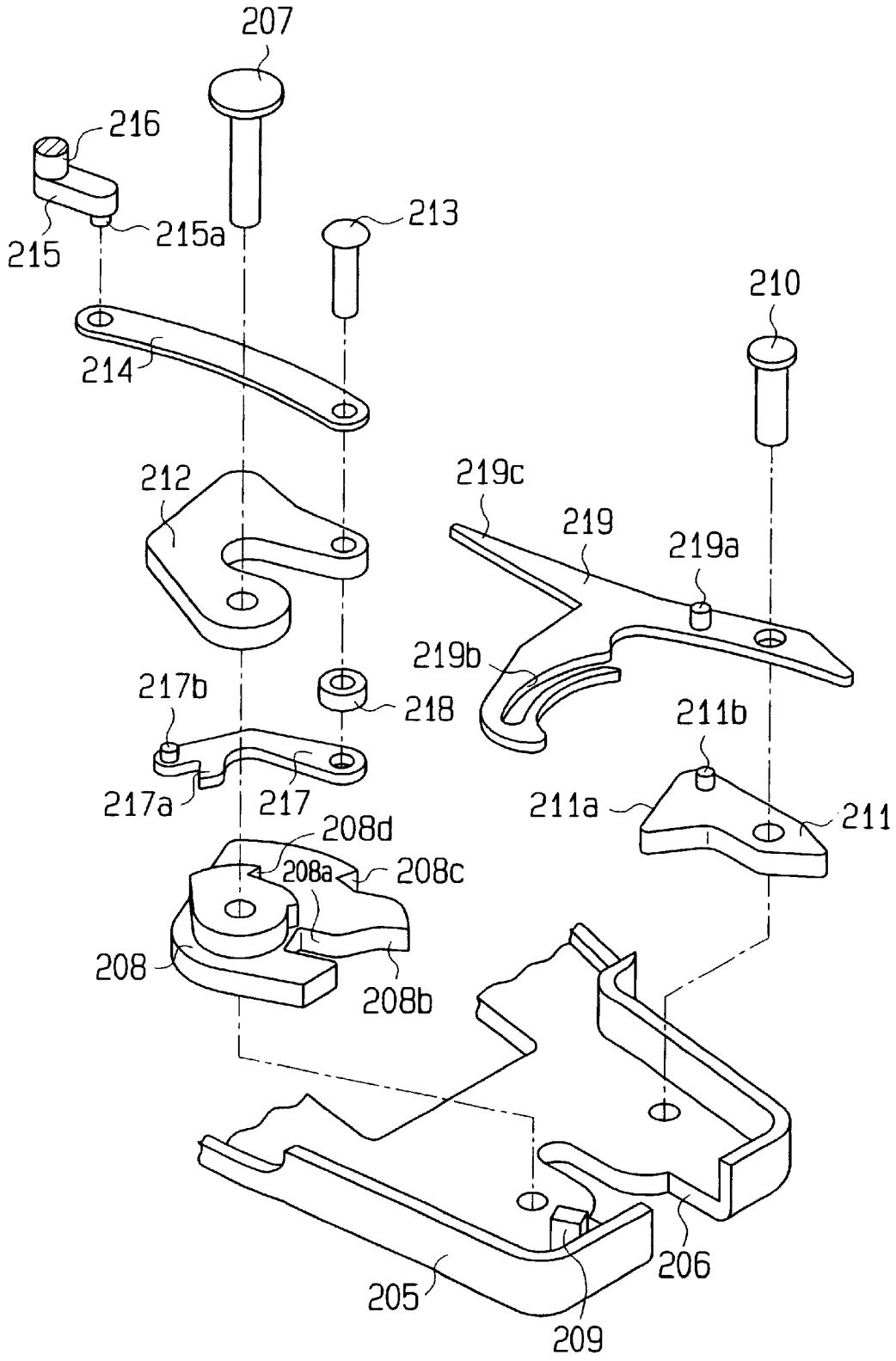
FIG. 35 is an exploded perspective view showing a closing apparatus of FIG. 34.
Figure 36:
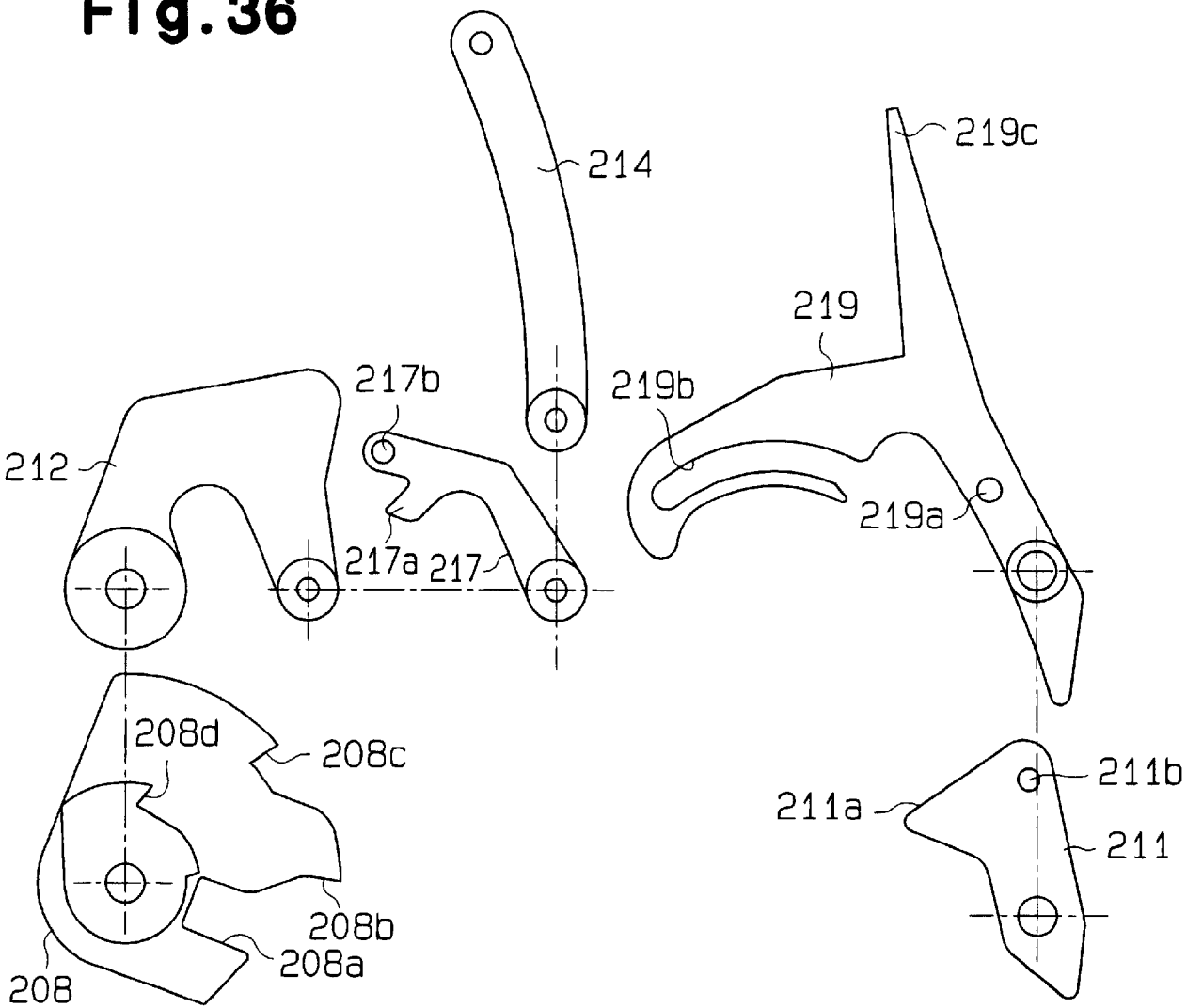
FIG. 36 is an exploded top plan view individually showing the components of the apparatus of FIG. 34.
Figure 37:
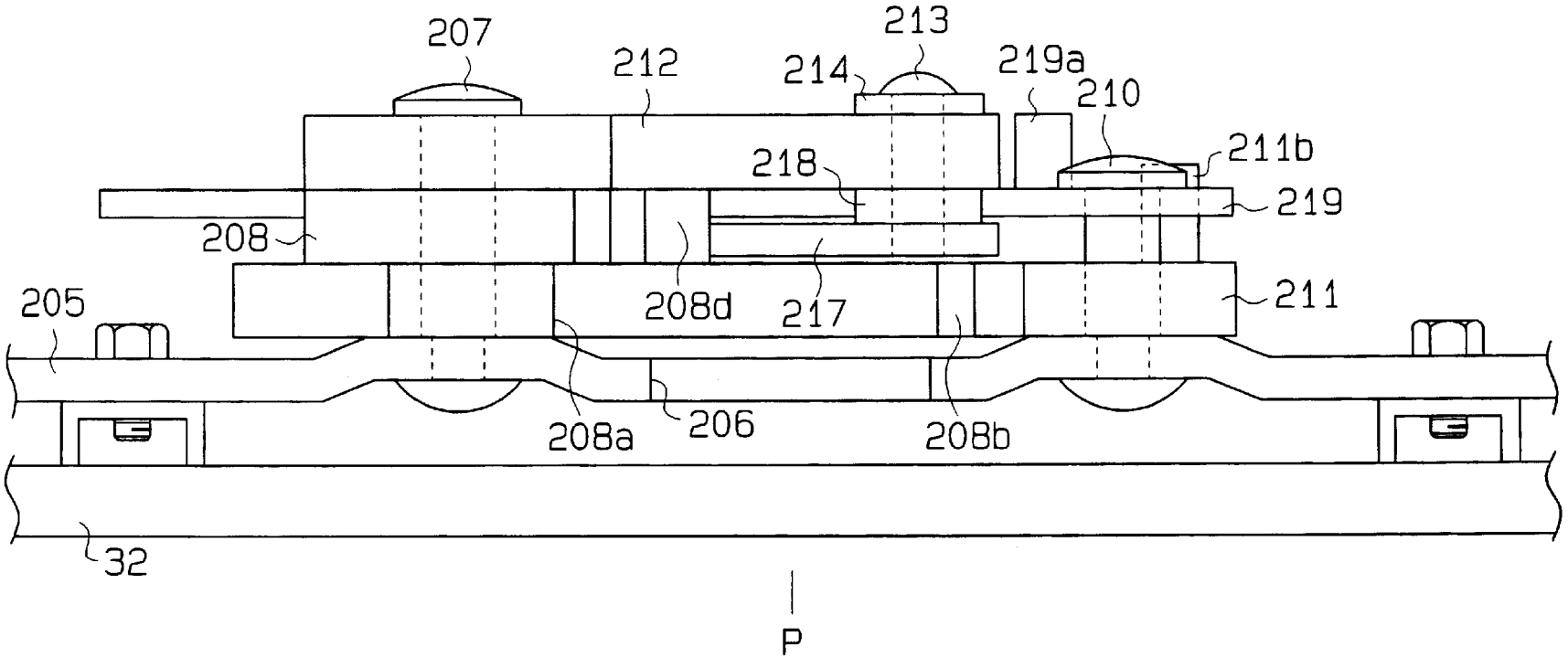
FIG. 37 is a side elevation showing the apparatus and taken in a direction X of FIG. 34.

As shown in FIG. 34 to FIG. 37, there is provided on a closing apparatus 203 a plate-shaped casing 205 in which component members such as a door locking mechanism for the apparatus 203 are to be built in. A through passage 206 through which a striker 204 provided on the body of a car is inserted is formed on the casing 205, which is fixed by screws, etc. to place the through passage 206 in the above-mentioned central position P and in parallel to the trunk door 32 as shown in FIG. 37. In the vicinity of the through passage 206 is provided, as shown in FIG. 37, a support shaft 207 serving as a pivot is installed vertically with respect to the casing 205. A latch 208 of approximately circular shape is pivotally mounted on the support shaft 207 and urged clockwise in FIG. 34 by a spring not illustrated herein. The latch 208 is subject to positional restriction regarding the urging direction thereof by means of a stopper 209. Also, the latch 208 is, as shown in FIG. 37, parallel to the trunk door 32 and placed in the vicinity thereof.

Figure 34:
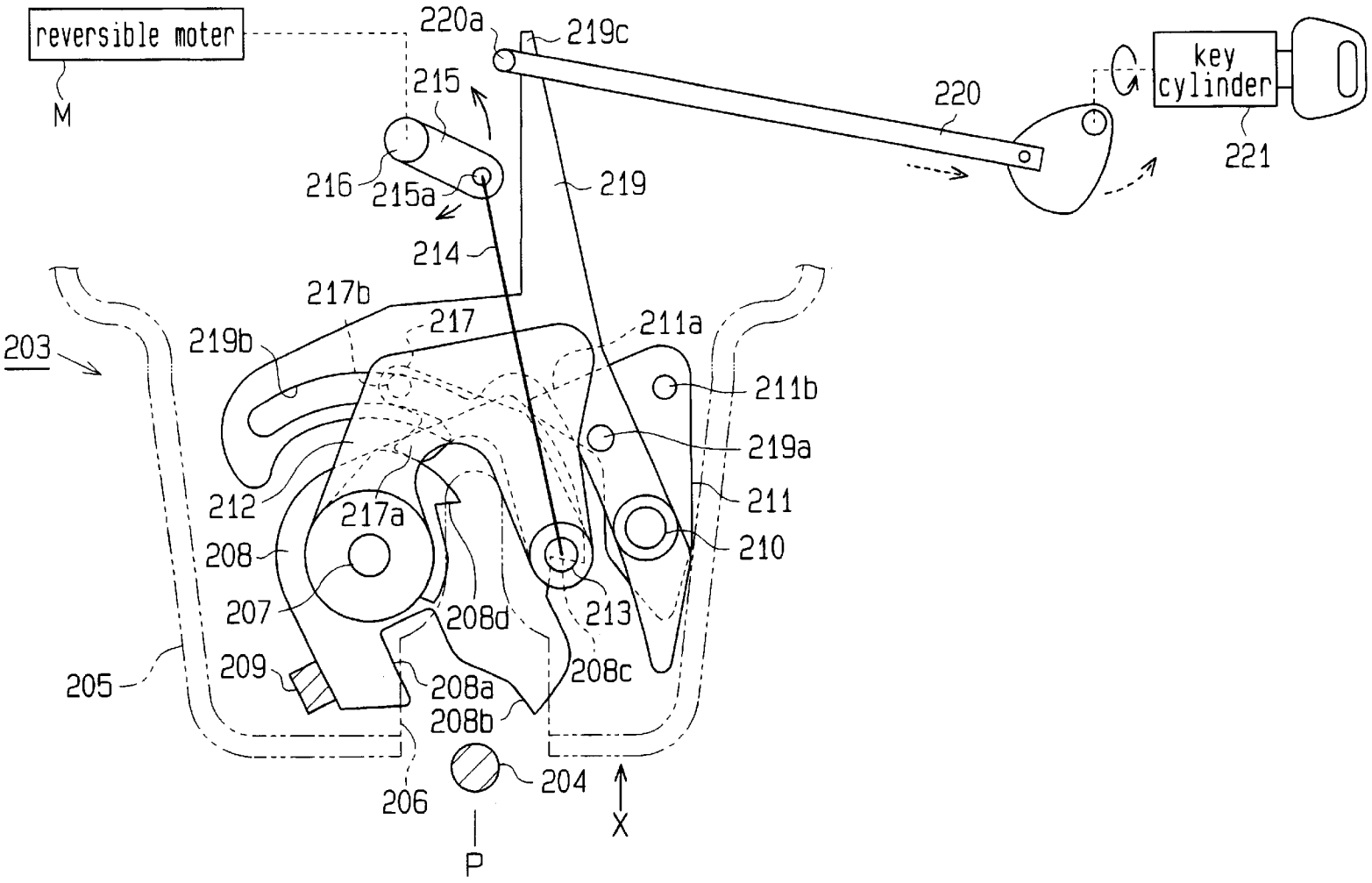
FIG. 34 is a top plan view showing a closing apparatus according to a sixth embodiment of the invention.
Figure 45A:
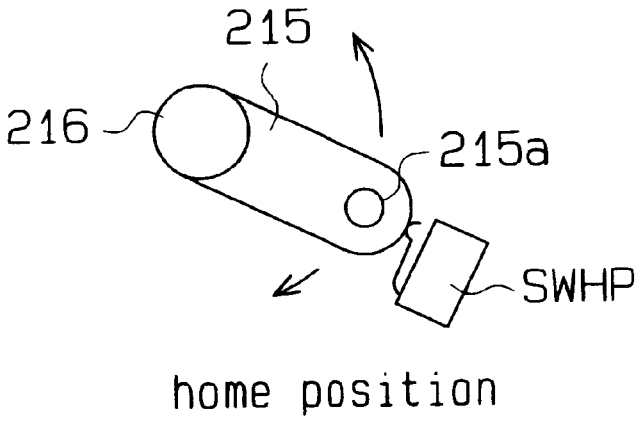
FIG. 45 presents top plan views for explaining the actions of various sensors of the apparatus of FIG. 34.
Figure 45B:
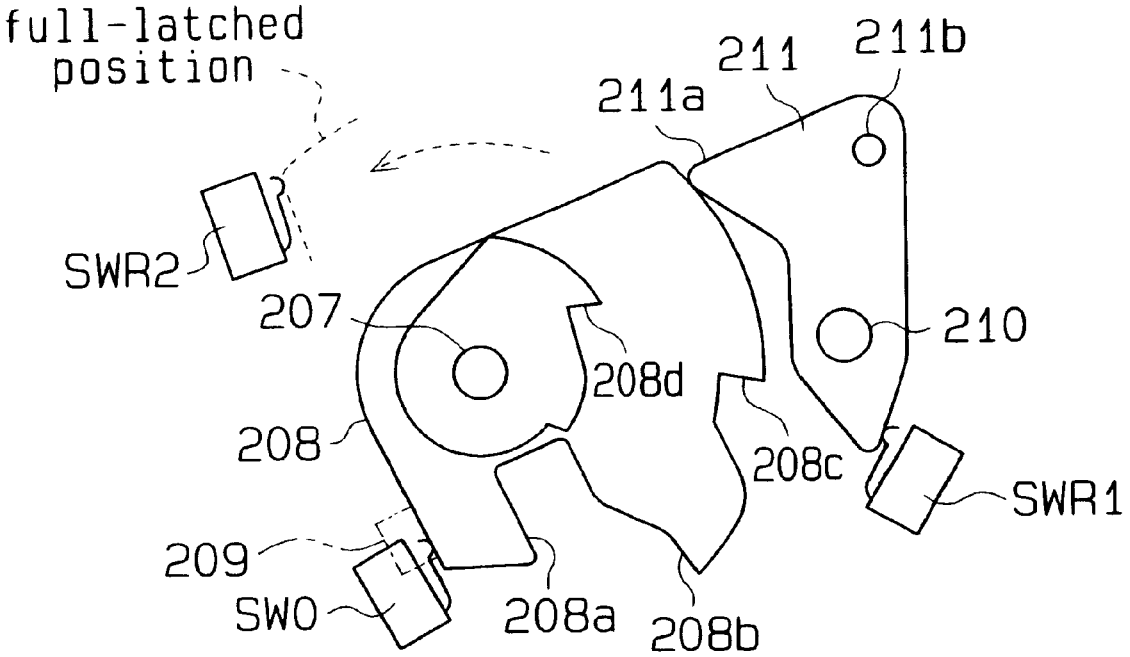

In this embodiment, as shown in FIG. 34, a condition of positional restriction of the latch 208 wherein the latch 208 is in abutment with the stopper 209 is set by the striker 204 as the lock release position of the latch 208 which discharges the striker 204 from restriction due to the latch 208. As shown in FIG. 45(*b*), in the vicinity of the stopper 209 is installed a lock release position detection switch SW0 which can detect the lock release position of the latch 208. The switch SW0 is designed to turn ON when the latch 208 is in the lock release position.

The latch 208 is formed of a 2-tier structure in which the cross-section thereof is shaped in stairs, the portion thereof near the center having heavy thickness, and there are two outer peripheries on the top tier side and the bottom tier side. On the outer periphery of the bottom tier side thereof are formed a recess 208*a* to restrict the striker 204, an engaging surface 208*b* which is in the state of engagement at the full-latched position, and an engaging surface 208 which is in the statement of engagement at the half-latched position. On the outer-periphery of the top side thereof is formed an engaging groove 208*d*. Each engaging stopper surface 208*b*, 208*c*, and the engaging groove 208*d* are positioned on the side of the above-mentioned through passage 206 (approximately on the right side of the support shaft 207 in FIG. 34) with respect to the pivot of the latch 208 supported by the support shaft 207.

Also, in the vicinity of the passage 206 on the other side with the through passage 206 of the above-mentioned support shaft 207 held in between as FIG. 37 shows, there is a support shaft 210 disposed vertically to the casing 205. One end of first ratchet 211 as engaging means is pivotally supported at the support shift 210. This first ratchet 211 is urged by a twist spring not illustrated herein toward a direction in abutment with the outer periphery of the above-mentioned latch 208 (counterclockwise in FIG. 34). On the side of the other end of the first ratchet 211, there is a latch surface 211*a* in engagement with the engaging stopper surfaces 208*b* and 208*c* of the latch 208.

Figure 38:
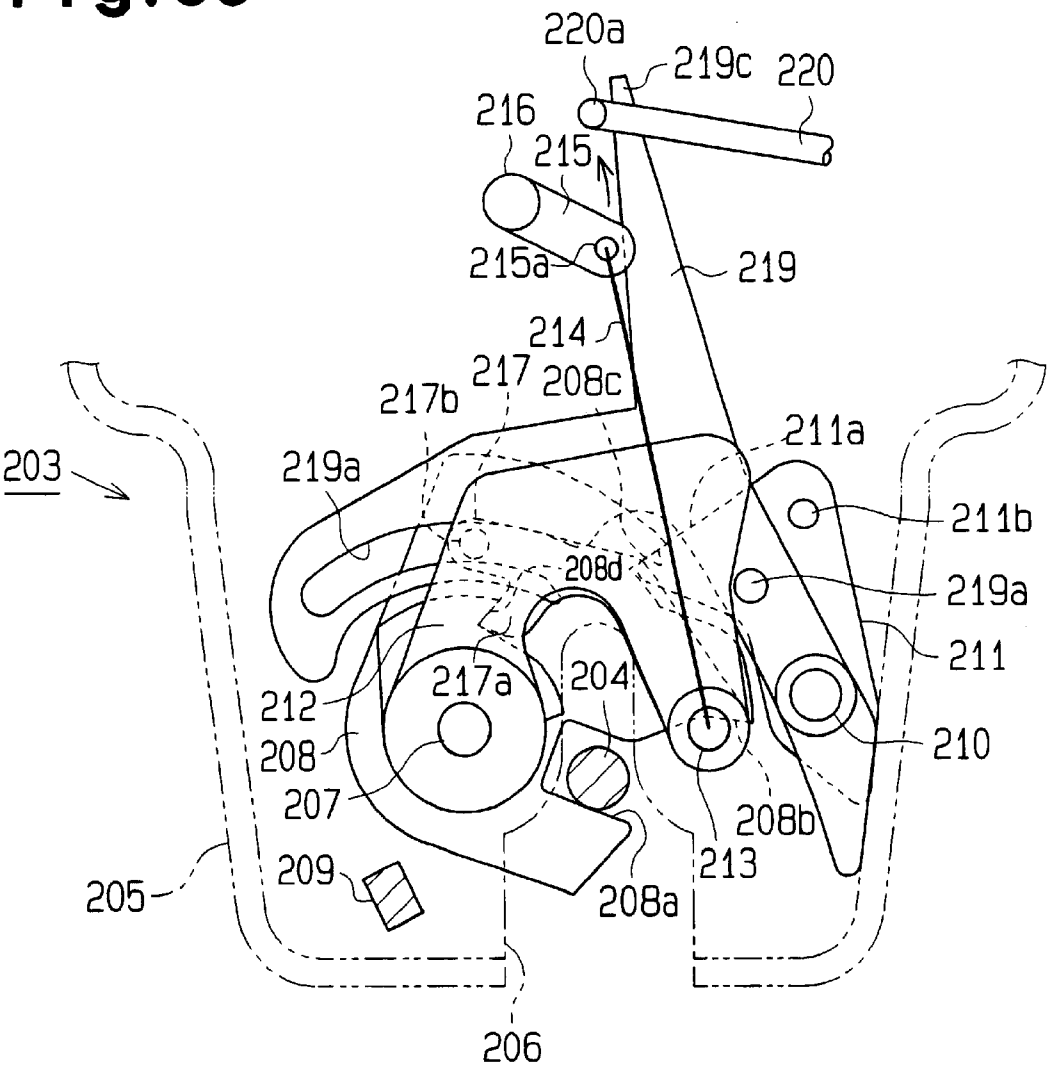
FIGS. 38 to 44 are top plan views for explaining the actions of the apparatus of FIG. 34.

It is to be noted that when the latch surface 211*a* of the first ratchet 211 engages the latch surface 208*c* of the latch 208, the latch 208 is restricted to the half-latched position (see FIG. 38). Also, when the latch surface 211*a* engages the engaging surface 208*b* of the latch 208, the latch 208 is restricted to the full-latched position (See FIG. 39 and FIG. 40). On the other end of the first ratchet 211 is provided upright an engaging pin 211*b* which makes up engagement release means.

As shown in FIG. 45(*b*), in the vicinity of the first ratchet 211 is disposed an engagement detection switch SWR1 comprising half-latch detecting means in which the first ratchet 211 detects the-state of engagement of each engaging surface 208*b* and 208*c* of the latch 208. Upon engaging each engaging stopper surface 208*b* and 208*c* of the latch 208, the first ratchet 211 starts pivoting counterclockwise in FIG. 45(*b*) on the support shaft 210, wherefore the detection switch SWR1 turns ON according to such pivoting.

In the vicinity of the full-latched position of the above-mentioned latch 208 is disposed a full-latched position detection switch SWR2 as full-latched position detection means comprising the half-latched detection means for detecting the full-latched position of the latch 208. The detection switch SWR2 turns ON when the latch 208 pivots to the full-latched position. When the latch 208 is in the half-latched position, the engagement detection switch SWR1 is in the ON status and the full-latched position detection switch SWR2 is in the OFF status, thereby providing positional detection.

On the top side of the above-mentioned latch 208 (foreground of FIG. 34) is placed a driving cam 212 as the cam of approximately rectangular shape with one short side open which uses the support shaft 207 jointly with the latch 208. One end of this driving cam 212 is pivotally supported by the casing 205. Extending through the other end of the driving cam 212 in a direction perpendicular to the casing 205 is a support shaft 213, to which is pivotally linked one end of a link 214 comprising a link mechanism on the top side of the driving cam 212. It is to be noted that although the link 214 is illustrated in FIGS. 34 and 38 to 44 linearly for the sake of explanation, in this embodiment, as FIGS. 35 and 36 show, the link 214 is formed by a curved plate. The other end of the link 214 is pivotally linked to a link pin 215*a* comprising a link mechanism which is fixed to one end of a link arm 215 as a rotary body. The other end of the link arm 215 is integrally incorporated by and pivotally fixed to an output shaft 216 which is drivingly connected to the reversible motor M as the driving source. The reversible motor M is a power Source of the door closing apparatus 203, swinging the link arm 215 fixed to the output shaft 216. It is further pointed out that the reversible motor M, in normal turn, rotates the link arm 215 counterclockwise in FIG. 34, while rotating the link arm 215, inreverse turn, clockwise in the same Figure.

Figure 40:
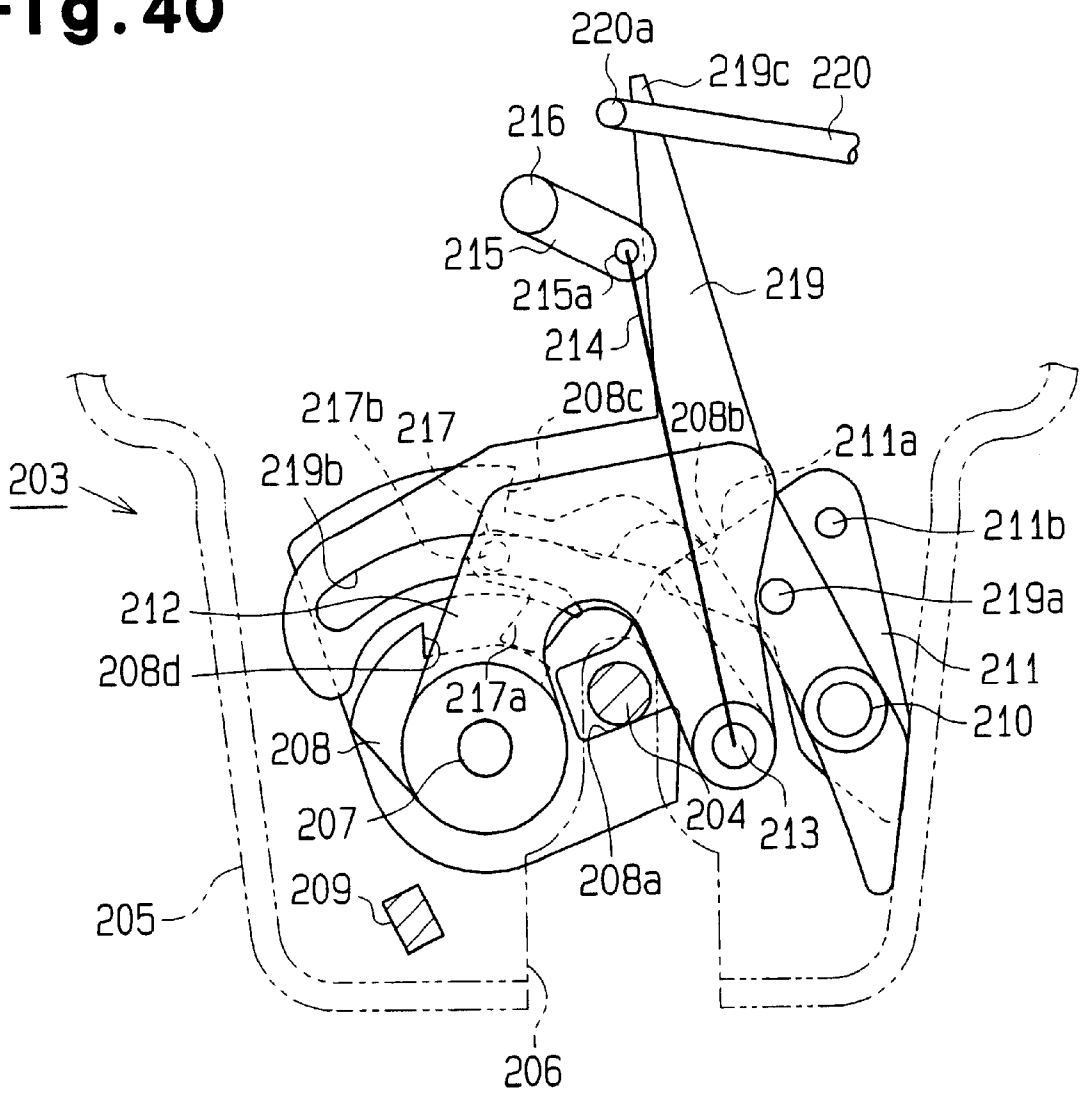

When the link arm 215 is as shown in FIG. 34, the link arm 215 is in the home position, while the link arm 215 is arranged always in the home position when the trunk door 32 is in the open condition. Further, as shown in FIG. 40, even when the trunk door 32 is in the completely closed condition (full-latched status), the link arm 215 is arranged in the home position.

When the link arm 215 is in the state of being arranged in the home position, the driving arm 212 is placed in the neutral position. In the vicinity of the home position of the link arm 215 is provided a home position detection switch SWHP for detecting the home position thereof, as FIG. 45(*a*) shows. The detection switch SWHP is designed to turn ON when the link arm 215 is placed in the home position.

Figure 46:
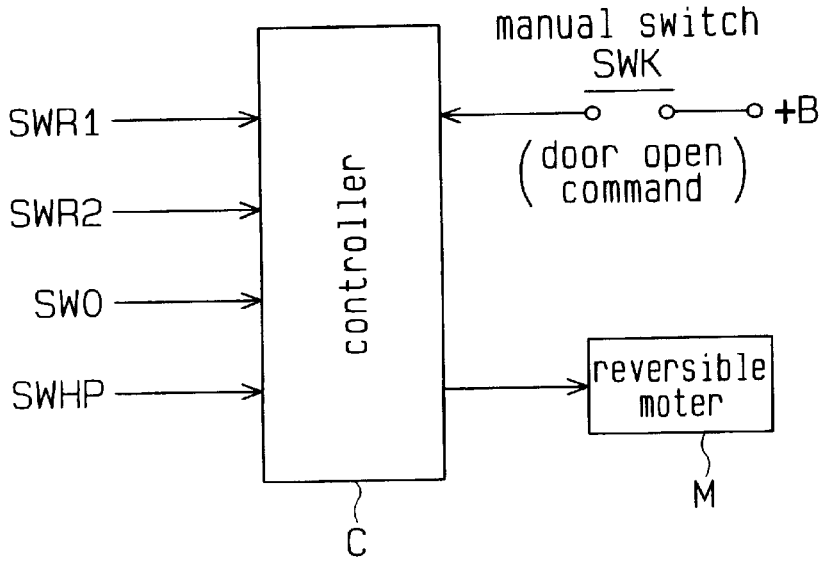
FIG. 46 is a circuit diagram showing a construction of the control system of the apparatus of FIG. 34.

It is also to be pointed out that the above-mentioned reversible motor M is as shown in FIG. 46, controlled by a controller C mounted on a vehicle 71 as control means. Each of the foregoing detection switches SWHP, SW0, SWR1, and SWR2 shown in FIG. 45 is connected to the controller C, and respective detection signals are inputted. Moreover, a manual switch SWK such as a driver's seat opener switch and a remote control switch for opening the trunk door 32 is connected to the controller C, and operating signals from the switch SWK is inputted. On the basis of detection signals from each detection switch SWHP, SW0, SWR1, and SWR2 as well as operating signals from the manual switch SWK, the controller C causes the reversible motor M to run normally or in reverse so as to operate the door closing apparatus 203.

It is to be noted here that when the above-mentioned latch 208 enters the half-latched position as shown in FIG. 38 (half-latched status), the engagement detection switch SWR1 shown in FIG. 45(*b*) enters the ON condition, while, at the same time, the full-latched position detection switch SWR2 enters the OFF condition, whence the controller C inputs the ON signal and the OFF signal respectively from the detection switches SWR1 and SWR 2 and judges that the latch 208 is in the half-latched position. In this embodiment, a signal combining these two signals is treated as the half-latch signal. Based on the judgment of the latch 208 in the half-latched position (input of the half-latch signal), the controller C runs the reversible motor M in normal revolution and rotates the link arm 215 counterclockwise in FIG. 34 from the home position.

Figure 39:
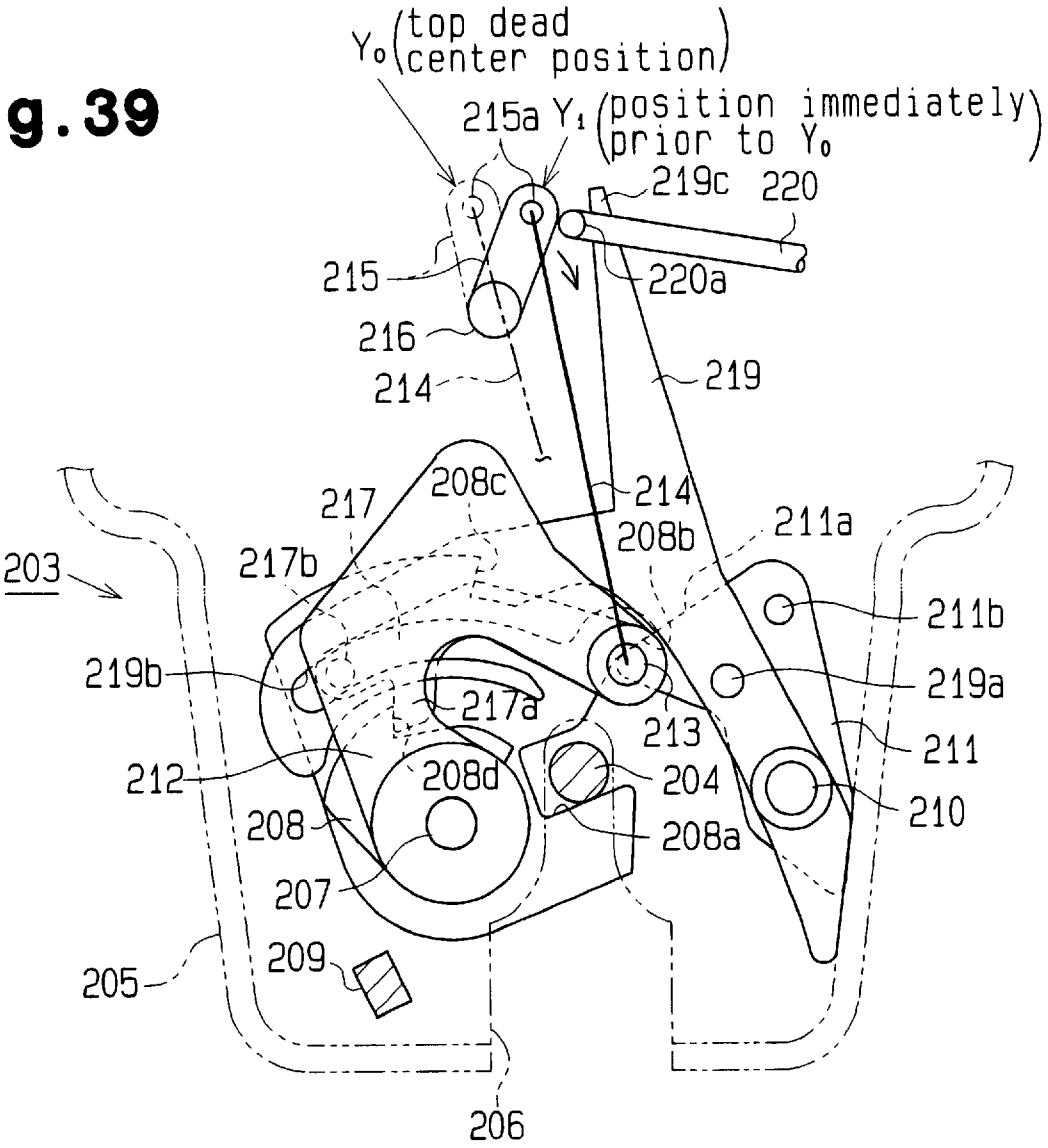

Further, when the latch 208 enters the full-latched position as shown in FIG. 39 (full-latched status), the full-latched position detection switch SWR2 shown in FIG. 45(*b*) enters the ON condition, whence the controller C inputs the ON signal from the switches SWR 2 and judges that the latch 208 is in the full-latched position. In this embodiment, this signal is treated as the full-latch signal. Based on the judgment of the latch 206 in the full-latched position (input of the full-latch signal), the controller C runs the reversible motor M in reverse revolution and rotates the link arm 215 clockwise in FIG. 39 from the position shown in the same Figure. And when the link arm 215 reached the home position shown in FIG. 40, the home position detection switch SWHP is turned ON. Base on the ON signal of the detection switch SWHF (home position signal), the controller C stops the driving of the reversible motor M.

Still further, when the manual switch SWK for opening the trunk door 32 is operated to turn it ON, the door 32 being in the completely closed condition (full-latched status), the ON signal from the switch SWK is inputted to the controller C. Based on the ON signal from the switch SWK, the controller C runs the reversible motor M in reverse and rotates the link arm 215 clockwise in FIG. 40. At this time, engagement of the latch 208 with the first ratchet 211 is released, pivotally returning to the lock release position, which turn ON the lock release position detection switch SW0. Based on the ON signal (door open signal) of the detection switch SW0, the controller C rotates the reversible motor M normally and pivots the link arm 215 clockwise in FIG. 42. And when the link arm 215 reaches the home position, turning ON the home position detection switch SWHP, the controller C stops the driving of the reversible motor M.

As FIG. 37 illustrates, on the bottom side of the above-mentioned driving cam 212, there is arranged a second ratchet 217 at about the same height as the upper side of the above-mentioned latch 208. One end of the second ratchet 217 is linked to the driving cam 212 pivotally about the support shaft 213. The support shaft 213 has a spacer 218 interposed between the second ratchet 217 and the driving cam 212. On the other end side (free end side) of the second ratchet 217 is formed an engagement stopper piece 217*a* to engage the engagement groove 208*b* formed on the upper side of the above-mentioned latch 208. On the tip of the free end side of the second ratchet 217 is provided upright an engagement stopper pin 217*b* as well.

At this point, when the latch 208 reaches the half-latched position shown in FIG. 38, as mentioned above, the reversible motor M rotates the link arm 215 counterclockwise. With this rotation of the link arm 215, the driving cam 212 which linked to the link 214 via the support shaft 213 is rotated counterclockwise about the support shaft 207. The second ratchet 217 linked by the support shaft 213 has the engagement stopper 217*a* thereof in engagement with the engaging groove 208*d* of the latch 208 to force the latch 208 to rotate counterclockwise. And when the link arm 215 reaches a position shown in FIG. 39, the first ratchet 211 has the latch surface 211*a* in engagement with the engaging surface 208 of the latch 208, subjecting the latch 208 to the full-latched position by applying positional restriction.

At this time, as shown in FIG. 39, in this embodiment, length of the above-mentioned link 214 is so determined that the latch 208 is in the full-latched position when the link pin 215*a* of the link arm 215 arrives at a position Y1 immediately preceding the top dead center position Y0 which becomes the swing end position of the driving cam 212. It is to be noted that when the link-pin 215*a* of the link arm 215 is at the top dead,center position Y0, the pull-in force F of the driving cam 212 concomitant to the rotation of the link arm 215 reaches the maximum. As the foregoing explanation shows, immediately prior to the completely closed condition of the trunk door 32 (full-latched status), weather strip-reaction, lock resistance, etc. act thereon so that a substantial force is required to close the door 32. Therefore, by making the latch 208 in the full-latched status when the link pin 215*a* of the link arm 215 reaches the position Y1 immediately prior to the top dead center position Y0, the torque of the reversible motor M can be utilized efficiently.

Another factor to ,consider is that when length of the link 214 is set so that the latch 208 is in the full-latched position when the link pin 215*a* of the link arm 215 reaches the top dead center position Y0, as a result of dimensional scattering, etc. of members making up the door closing apparatus 203, it may not be possible, in some cases, to put the latch 208 in the full-latched position. However, it will be appreciated that in this embodiment, since the setting is made so that the latch 208 is in the full-latched position when the link pin 215*a* of the link arm 215 reaches the point Y1 immediately preceding the top dead center position Y0, dimensional scattering of members making up the apparatus 203 can be absorbed.

A fork 219 is arranged at about the same height as the above-mentioned spacer 218 and supported by the above-mentioned support shaft 210 on same shaft as the first ratchet 211. The fork 219 is urged by a spring not illustrated herein about the support shaft 210 counterclockwise in FIG. 34. In the vicinity of the support shaft 210 of the fork 219 is provided upright an engaging pin 219*a* in abutment with the outer periphery of the above-mentioned driving cam 212. Also, an arc-shaped guide groove 219*b* with one end open is formed on the fork 219 and the guide groove 219*b* houses and guides the engagement stopper pin 217*b* of the second ratchet 217. In other words, the above-mentioned second ratchet 217 is being urged so that as the engagement stopper pin 217*b* is pressed toward the inner periphery of the guide groove 219*b*, the engagement stopper piece 217*a* thereof abuts the top side of the outer periphery where the engaging groove 208*d* of the latch 208 is formed.

An operating arm 219*c* is formed on the above-mentioned fork 219, and an engaging stopper portion 220*a* formed on one end of a rod 220 is operating to stop the operating arm 219*c*. Linked to the other end of the rod 220 is a key cylinder 221 to be operated manually for opening the trunk door 32. When this key cylinder 221 is subjected to the door opening and closing operation with a key, the rod 220 is pulled to the right in FIG. 34 and the fork 219 with the engagement stopper portion 220*a* stopped by the operating arm 219*c* is rotated clockwise in the same Figure. It is to be noted that when the fork 219 rotates clockwise not by the action of the rod 220, the operating arm 219*c* moves away from the engagement stopper portion 220*a* of the rod 220.

Next, description of the action of the closing apparatus 203 of the foregoing construction will be made in reference to FIG. 34 and FIGS. 38 to 49.

Figure 47:
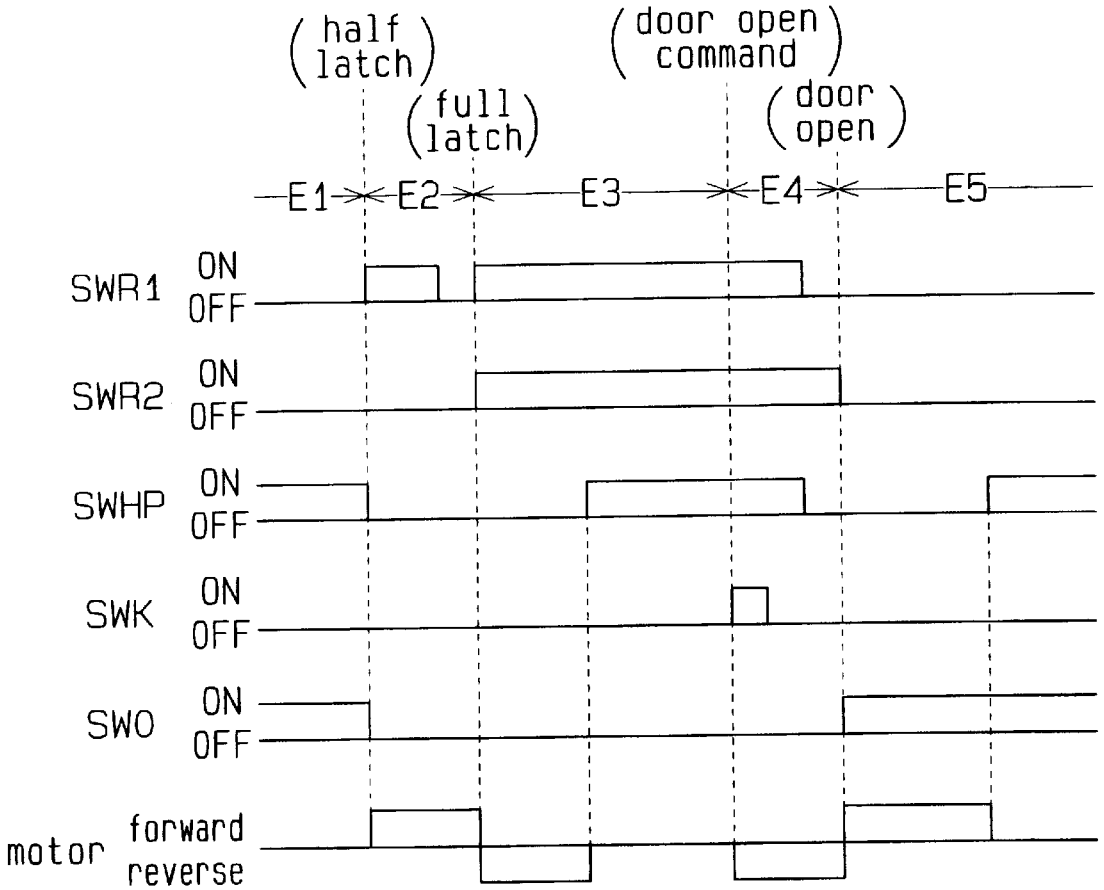
FIG. 47 is a timing chart for explaining the actions of the control system of FIG. 46.

For the sake of explanation, as FIG. 47 shows, a series of operation from the open status of the trunk door 32 (region E1), pull-in operation from the half-latched status of the door 32 to the full-latched status (region E2), the full-latched status (region E3), transfer from the full-latched status to the open status (region E4), and the door 32 open status (region E5) will be used as an example for description. Also, the control routine shown in FIG. 48 and the flow chart shown in FIG. 49 will be used. This control routine starts according to the supply of driving power to the controller C, First, in the region E1 where the trunk door 32 is in the open status, the closing apparatus 203 is in the initial condition and the link arm 215 is arranged in the home position shown in FIG. 34. The controller C determines whether or not the half-latch signal has been inputted so as to see if the trunk door 32 is in the half-latched status (door ajar). This half-latch signal is a combination signal of the ON signal and the OFF signal of each detection switch SWR1 and SWR2 shown in FIG. 45(*b*) as mentioned above C Consequently, when the trunk door 32 is in the open condition, OFF signals are inputted from both the detection switches SWRa and SWR2 into the controller C so that the controller , C repeats the step 31 until the trunk door 32 reaches the half-latched status.

For example, if sufficient power is not applied when closing the trunk door 32 and if the latch 208 pushed by the striker 204 which is inserted into the through passage 206 is not rotated up to the half-latched position, the first ratchet 211 comes to engage the engaging stopper surface 208*c* of the latch 208. In other words, as shown in FIG. 38, positional restriction is imposed on the latch 208 at the half-latch position and the trunk door 32 is in the door ajar condition (half-latched status). In this condition, the engaging stopper piece 217*a* of the second ratchet 217 is in a condition of engaging the engagement groove 208*d* of the latch 208.

In the region E2 where the trunk door 32 is in the half-latched status, when the first ratchet 211 engages the engaging stopper surface 208*c* of the latch 208, the door 32 rotates counterclockwise. Hence, the engagement detection switch SWR1 is turned ON on the basis of such rotation. Then, the half-latch signal combining the ON signal and the OFF signal of detection switches SWRl and SWR 2 is inputted to the controller C, which recognizes the half-latched status of the door 32 and proceeds to the next step 32.

Upon recognition of the half-latched status of the trunk door 32, the controller C operates the reversible motor M in normal rotation in the step 32. With the counterclockwise rotation of this link arm 215, the driving cam 212 linked to the link 214 via the support shaft 213 is rotated about the support shaft 207 from the neutral position shown in FIG. 38 counterclockwise in the same Figure.

Then, the second ratchet 217 linked by the same support shaft 213, because the engaging stopper piece 217*a* thereof is in engagement with the engagement groove 208*d* of the latch 208, forces the latch 208 to rotate counterclockwise. Also the controller C moves from the step 32 to the step 33 and verifies whether or not the full-latch signal has been inputted so as to determine if the trunk door 32 is in the full-latched status. As described above, this full-latch signal is the ON signal of the full-latch position detection switch SWR2. And the controller repeats the step 33 until the trunk door 32 reaches the full-latched status and the ON signal is inputted from the detection switch SWR 2.

Soon, as shown FIG. 39 when the link pin 215*a* of the link arm 215 reaches the point Y1 immediately preceding the top dead center position Y0 where the driving cam 212 assumes the swing end position, the latch surface 211*a* of the second ratchet 211 engages the engaging stopper surface 208*b* of the latch 208. It is at this moment when the pull-in force F of the driving cam 212 concomitant to the rotation of the link arm 215 reaches approximately maximum, whereupon the latch 208 is position restricted to the full-latched position, the trunk door 32 being in the completely closed condition (full-latched status). As a result, the trunk door 32 is automatically closed completely by the closing apparatus 203 from the door ajar condition.

In the region E3 where the trunk door 32 in the full-latched state, the latch 208 rotates to the full-latch position, thereby turning ON the full-latch position detection switch SWR2 and leading to the input of the ON signal of the detection switch SWR2 or the full-latch signal. Consequently, the controller C recognizes the full-latched status of the door 32 and proceeds to the next step 34.

Upon recognizing the full-latched status of the trunk door 32, the controller C reverses operation of the reversible motor M from normal to reverse in the step 34 and rotates clockwise the link arm 215 from the immediately prior position Y1 to the home position shown in FIG. 40. And the controller C moves from the step 34 to the step 35 for verifying whether or not the home position signal has been inputted so as to determine if the link arm 215 is positioned in the home position.

Soon, as shown in FIG. 40, the link arm 215 reaches the home positions whence the home position detection switch SWHP turns ON. Then the controller C moves from the step 35 to the step 36 and stops the reverse driving of the reversible motor M. This is followed by the controller C moving from the step 36 to the step 37 shown in FIG. 49 to verify whether or not the trunk door 32 open instructions are received. The controller repeats the step 37 until the door 32 open instructions are received.

Next, in the region E4 where the manual switch SWK is turned on to move the trunk door 32 from the full-latched status to the open status, the ON signal from the switch SWK is inputted into the controller C, which then transfers from the step 37 to the step 38, verifying whether or not the trunk door 32 is in the closed status. Namely, the fact that when the trunk door 32 is in the closed status, the lock release position detection switch SW0 shown in FIG. 45(*b*) is in the OFF status provides a basis for the controller C to determine whether or not the OFF signal from the detection switch SW0 has been inputted. Now that the trunk door 32 is in the closed status, the OFF signal is to be inputted from the detection switch SW0 to the controller C, which then proceed to the step 39.

In the step 39, the controller C reverses operation of the reversible motor and rotates the link arm 215 from the home position shown in FIG. 40 clockwise in the same Figure. With the clockwise rotation of the link arm 215, the driving cam 212 linked to the link 214 and the support shaft 213 is rotated from the neutral position clockwise in the same Figure.

The controller C also moves from the step 39 to the step 40 where verification is made as to whether or not the door open signal is inputted to determine if the trunk door 32 is in the open status. The door open signal is the ON signal of the lock release position detection switch SW0 as described above. That is to say, the controller C verifies if the ON signal is inputted from the detection switch SW0.

Now that the latch 208's position is restricted to the full-latched position by the first ratchet 211, the OFF signal is inputted into the controller C from the detection switch SW0, whereas the controller C continues repeating the step 40 until the trunk door 32 reaches the open status.

Figure 41:
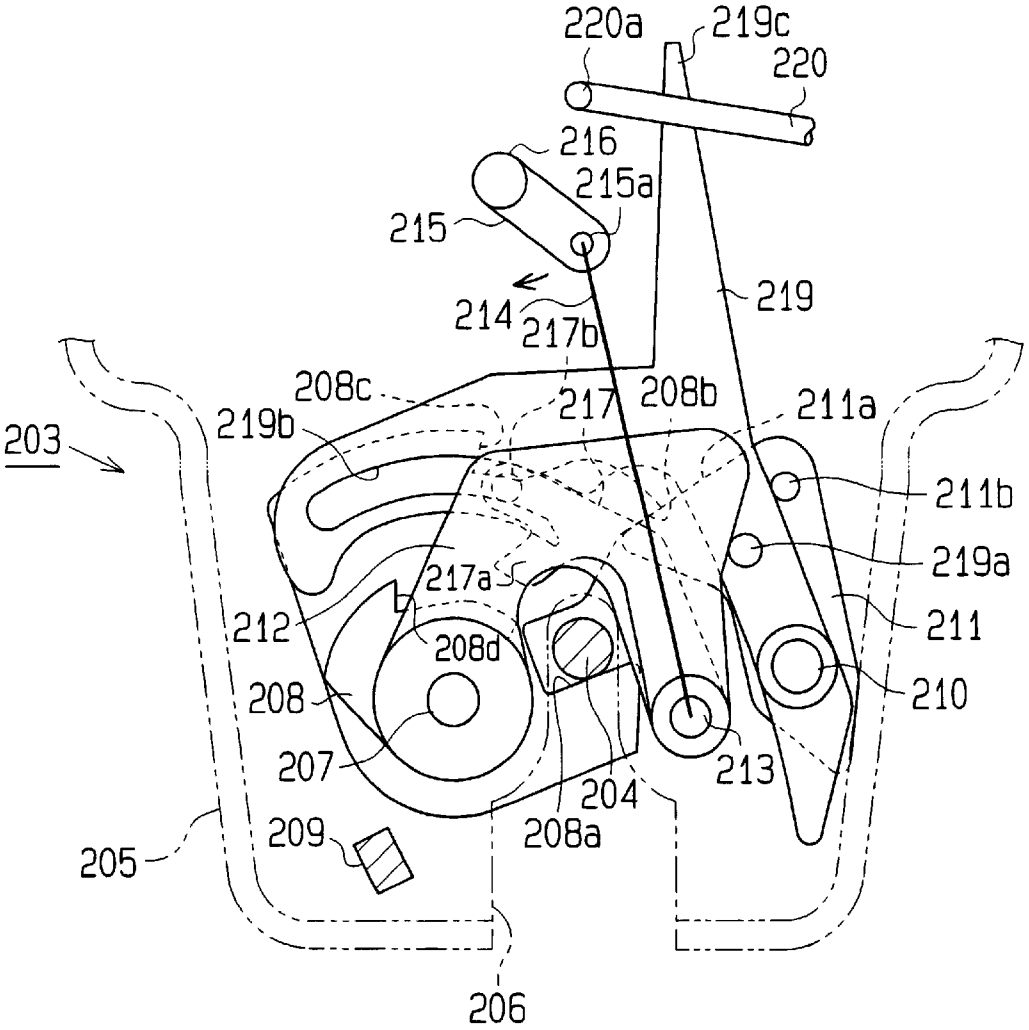

Soon, the driving cam 312 rotating clockwise has the outer periphery thereof in abutment with the engaging stopper pin 219*a* of the fork 219 to rotate the fork 219 clockwise about the support shaft 210 upon clockwise rotation of the fork 219 as FIG. 41 shows, the outer periphery thereof comes in abutment with the engaging stopper pin 211*b* of the first ratchet 211, rotating the first ratchet 211 Clockwise about the support shaft 210.

Figure 42:
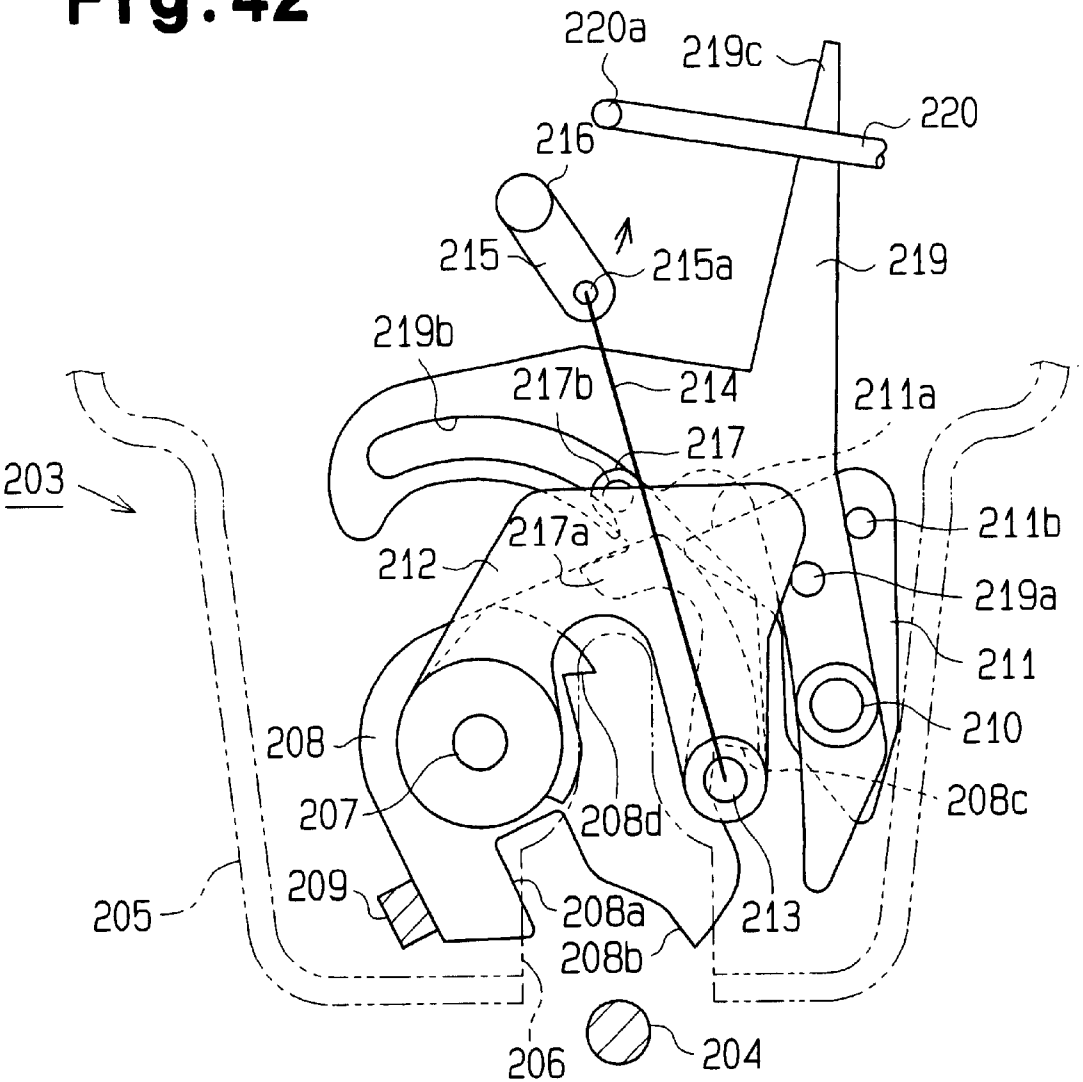

With such clockwise rotation of the link arm 215, the driving cam 212 rotates the first ratchet 211 clockwise via the fork 219, then, as shown in FIG. 42, the latch surface 211*a* of the first ratchet 211 disengages from the engaging stopper surface 208*b* of the latch 208. At this instant, the engaging stopper pin 217*b* of the second ratchet 217 is guided to the guide groove 219*b* of the fork 219 so that with the rotation of the fork 219, the second ratchet 217 is arranged to be put in a detached state to a position to provide no engagement with the engaging groove 208*d* of the latch 208.

As a consequence, upon releasing engagement between the first ratchet 211 and the latch 208, the latch 208 rotates clockwise in the same Figure about the support shaft 207 due to the urging of the spring not illustrated herein, returns to a position in abutment with the stopper 209, or the lock release position to which the latch 208 is restricted. In this manner, the striker 204 is released from the constraint due to the recess 208*a* of the latch 208 and the lock of the trunk door 32 is released.

In the E5 region where the trunk door 32 is in the open status, the lock release position detection switch SW0 is turned ON by rotation of the latch 208 to the lock release position, whereupon the ON signal of the detection switch SWRO or the door open signal is inputted into the controller C, which recognizes the open status of the door 32, proceeding to the next step 41.

In the step 41, the controller C switches over from reverse to normal operation, rotating counterclockwise the link arm 215 from a position shown in FIG. 34 to the home position. Further, the controller C transfers from the step 42 to the step 42 and verifies whether or not the home position signal is inputted so as to determine if the link arm 215 reached the home position.

Figure 48:
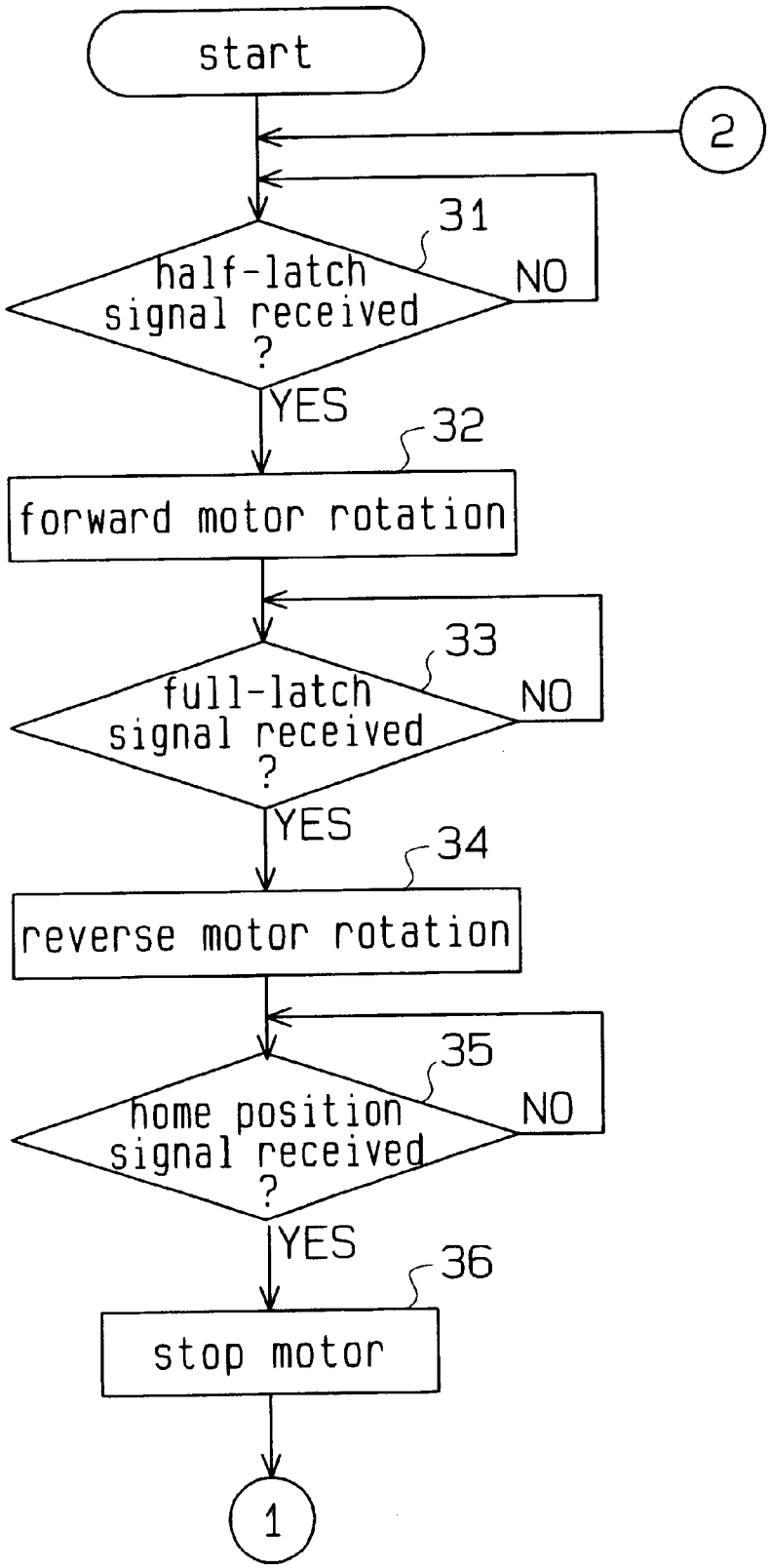
FIGS. 48 and 49 are flow charts for explaining the operations of the control system of FIG. 46.
Figure 49:
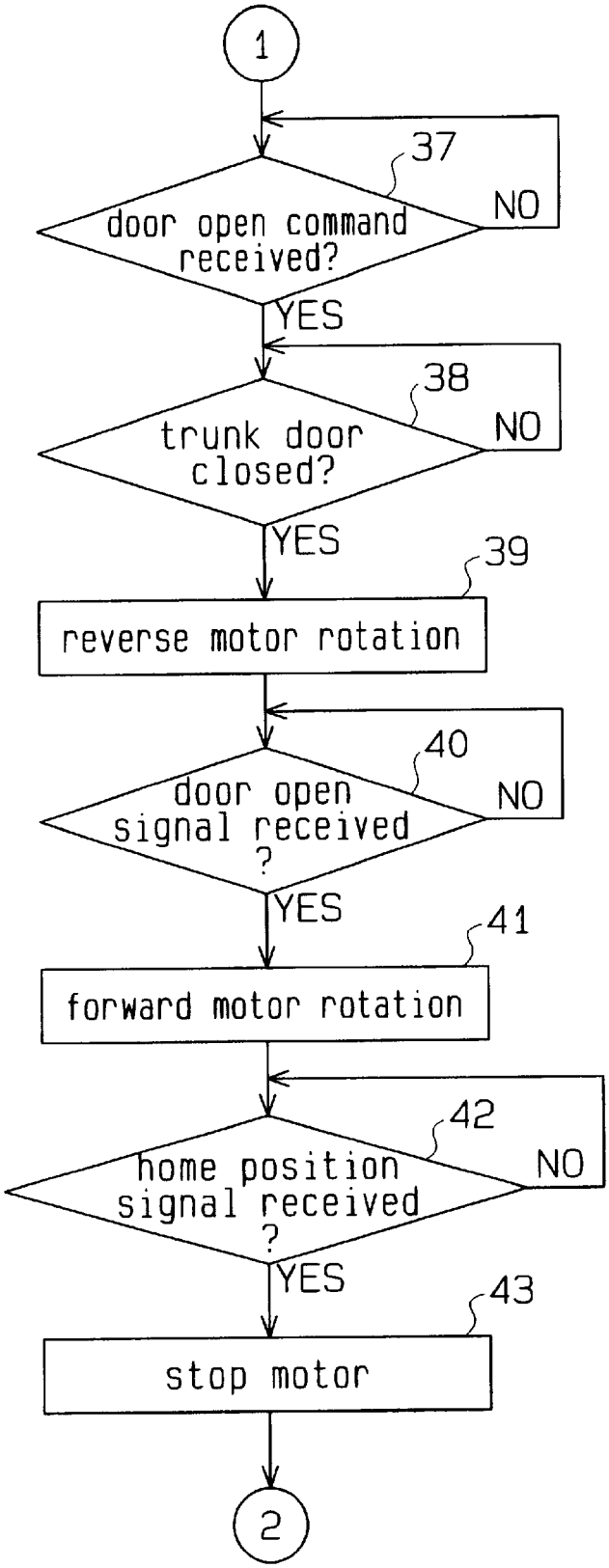

Soon, as shown in FIG. 34, the link arm 215 comes to the home position, whereupon the home position detection switch SWHP is turned ON. Subsequently, the controller C proceeds from the step 42 to the step 43, stops the normal driving of the reversible motor M then returns from the step 43 to the step 31 as shown in FIG. 48. In this manner, the closing apparatus 203 returns to the initial status.

In addition, when the trunk door 32 is in the completely closed condition (full-latched status) as mentioned above and shown in FIG. 40, it is possible to unlock the trunk door 32 by means of the door open operation with the key at the key cylinder 221.

Figure 43:
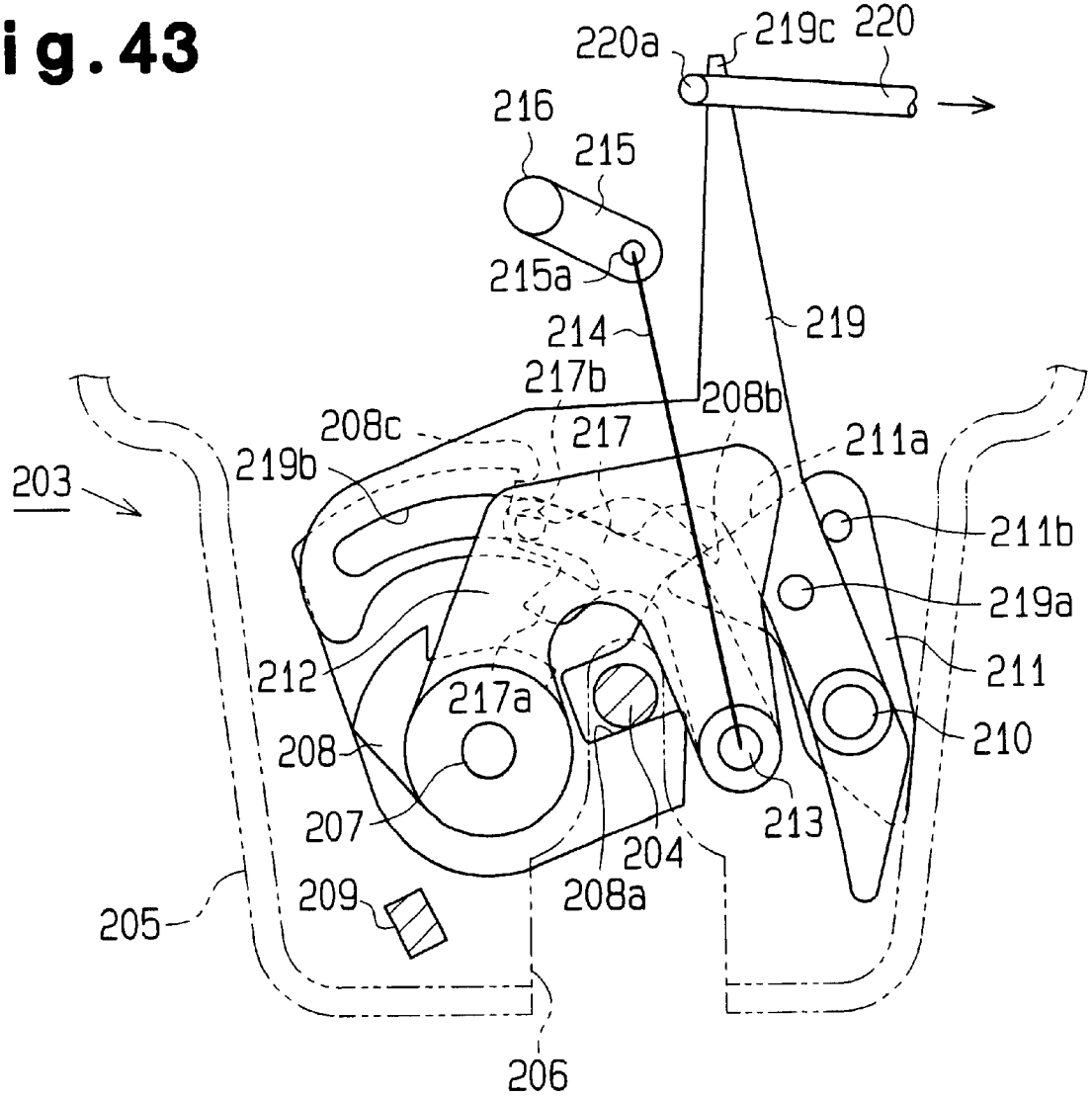

When the key cylinder 221 is subjected to door open operation with the key, the rod 220 is pulled to the right of the drawing, whereas the fork 219 with the operating arm 219*c* thereof stopped by the engaging stopper portion 220*a* rotates clockwise in the same drawing. Then as shown in FIG. 43, the outer periphery of the fork 219 abuts the engaging stopper pin 211*b* of the first ratchet 211, and the first ratchet 211 is rotated clockwise about the support shaft 210.

Figure 44:
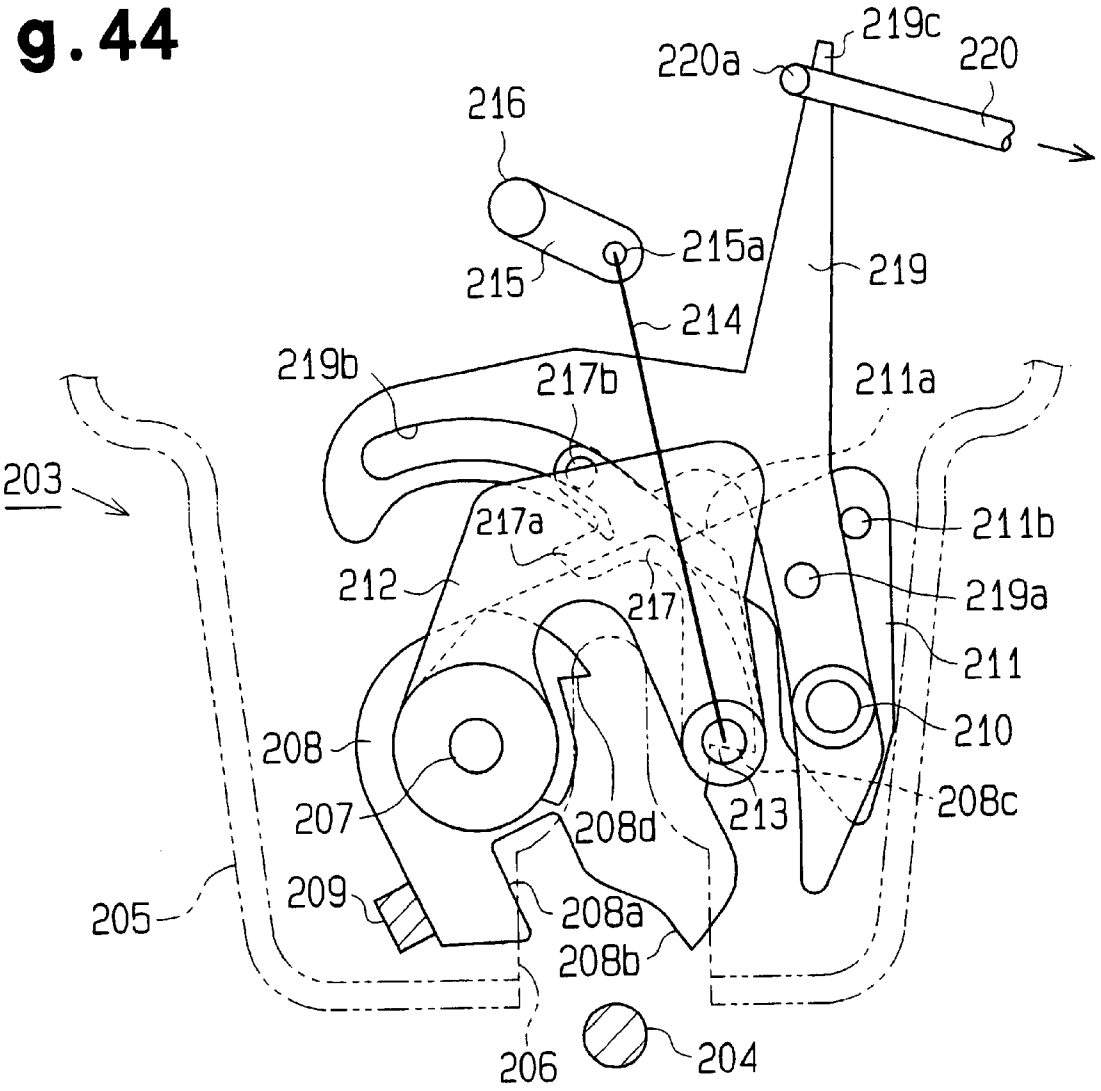

With rotation of the fork 219, soon, as FIG. 44 shows, the latch surface 211*a* of the first ratchet 211 disengages from the engaging stopper surface 208 of the latch 208. At this instant, as mentioned above, the engaging stopper pin 217*b* of the second ratchet 217 guided to the guide groove 219*b* of the fork 219, so that with rotation of the fork 219, the second ratchet 217 is arranged to be put in a detached state to a position to provide no engagement with the engaging groove 208*d* of the latch 208.

As a consequence, upon releasing engagement between the first ratchet 211 and the latch 208, the latch 208 rotates clockwise and return to be restricted to a position in abutment with the stopper 209, or the lock release position. In this manner, the striker 204 is released from the constraint due to the recess 208*a* of the latch 208 and the lock of the trunk door 32 is released also by means of the door opening operation with the key at the key cylinder 221.

In addition, when power supply is cut off to the closing apparatus 203 to make it impossible to operate and when the half-latched status is reached as shown in FIG. 38, the apparatus 203 operates so that it is possible to open the trunk door 32 by door opening operation with the key at the key cylinder 221.

Based on the door opening operation with the key at the key cylinder 221 the fork 219 rotates clockwise via the rod 220. Then, the outer periphery of the fork 219 copies into abutment with the engaging stopper pin 211*b* of the first ratchet 211 to rotate the first ratchet 211 clockwise about the support shaft 210.

Soon after rotation of the fork 219, the latch surface 211*a* of the first ratchet 211 disengages from the engaging stopper surface 208*c* of the latch 208. At this instant, the engaging stopper pin 217*b* of the second ratchet 217 is guided to the guide groove 219*b* of the fork 21 so that with the rotation of the fork 219, the engaging stopper 217*a* is released from engagement with the engagement groove 208*d* of the latch 208.

As a consequence, upon releasing engagement between the first ratchet 211 and the latch 208, the latch 208 rotates clockwise and returns to be restricted by the lock release position in abutment with the stopper 209. In this manner, the striker 204 is released from the constraint due to the recess 208*a* of the latch 208 by means of the door opening operation with the key at the key cylinder 221, and the trunk door 32 is released from the half-latched status to enable the door to be opened.

As described above in detail, the present embodiment will be conducive to producing the following effects:

(1) As shown in FIG. 39, when the latch 208 is restricted to the full-latch position by the first ratchet 211, the controller C reverses the normal operation of the reversible motor M to prevent the latch 208 from rotating further in the direction of pulling in the striker 204. In this way, the latch 208 will not pull the striker 204 any more than necessary and the forced closing of the trunk door 32 by means of the closing apparatus 203 is prevented with certainty.

(2) Immediately before the trunk door 32 reaching the completely closed condition (full-latched status), due to the action of weather strip reaction, lock resistance, and other forces, a substantial force is required to close the door 32. Hence, in this embodiment, as shown in FIG. 39, length of the link 214 is so determined that the latch 208 is in the full-latched position at a position Y1 immediately prior to arrival of the link pin 215*a* of the link arm 215 at the top dead center position Y0 which becomes the swing end position of the driving cam 212. In other words, when the link pin 215*a* of the link arm 215 is at the top dead center position Y1, the pull-in force F of the driving cam 212 concomitant to the rotation of the link arm 215 reaches the maximum.

Consequently, the torque of the reversible motor M can be utilized efficiently, contributing to even more decreasing the size of the closing apparatus 203.

Moreover, when length of the link 214 is set so that the latch 208 is restricted to the full-latched position when the link pin 215*a* of the link arm 215 reaches the top dead center position Y0, as a result of dimensional scattering, etc. of members making up the door closing apparatus 203, it may not be possible, in some cases, to put the latch 208 in the full-latched position, wherefore, in this embodiment, the setting is made so that the latch 208 is in the full-latched position when the link pin 215*a* of the link arm 215 reaches the point Y1 immediately prior to the top dead center position Y0, thus enabling dimensional scattering of members making up the apparatus 203 to be absorbed.

The following modifications can be applied to the foregoing embodiment.

(1) In the foregoing embodiment, length of the link 214 is set so that the latch 208 is in the full-latched position when the link pin 215*a* of the link arm 215 reaches the point Y1 immediately p receding the top dead center position Y0. Nevertheless, length of the link 214 may be set so that the latch 208 reaches the full-latch position when the link pin 215*a* arrives at the top dead center position Y0.

Figure 50:
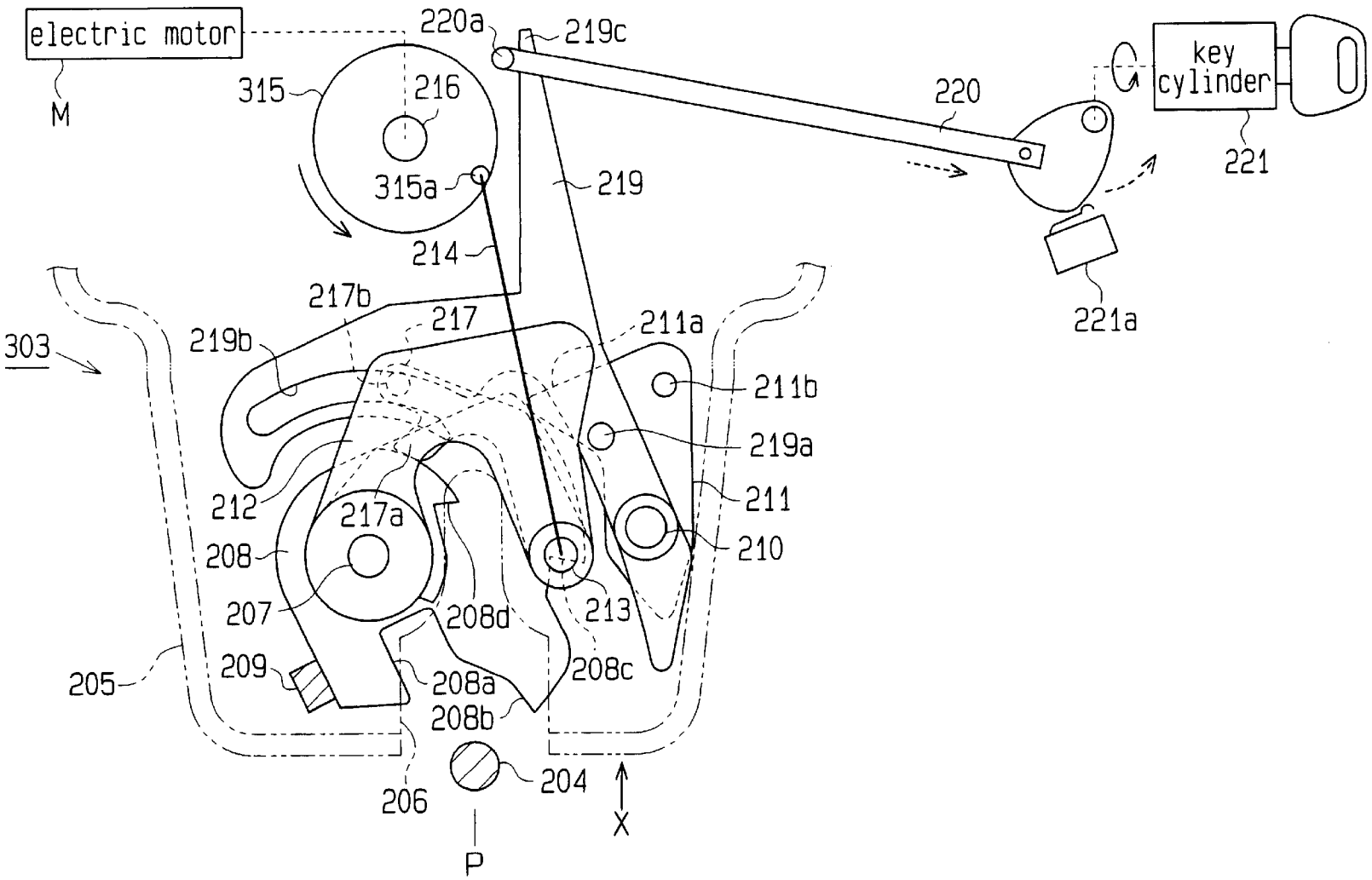
FIG. 50 is a top plan view showing a closing apparatus according to a seventh embodiment of the invention.

(2) Positional arrangements of detection switches SWHP, SW0, SWR1, and SWR2 are not confined to those positions shown in FIG. 50 if the same positional detection (status) as the foregoing embodiment can be accomplished.

Seventh Embodiment

Referring next to FIGS. 50 through 53, the seventh embodiment according to this invention will be described. In this embodiment, the same numerals as those used for the sixth embodiment described above will be used in explaining particularly those sections different from the sixth embodiment.

As shown in FIG. 50, in a closing apparatus 303 of this embodiment, a disk-shaped link part is used in place of the link arm 215 of the sixth embodiment above. And an end part of a link 214 is pivotally connected to the link pin 315*a* which is fixed to the outer periphery of the rotary body 315.

The rotary body 315 is pivotally fixed in one piece with respect to the output shaft 216 drivingly connected to the electric motor M as the driving source. The electric motor M functions as the power source for the closing apparatus 303 and rotates the rotary body 315 fixed to the output shaft 216 in one direction only (counterclockwise in FIG. 50 in this embodiment).

Figure 53:
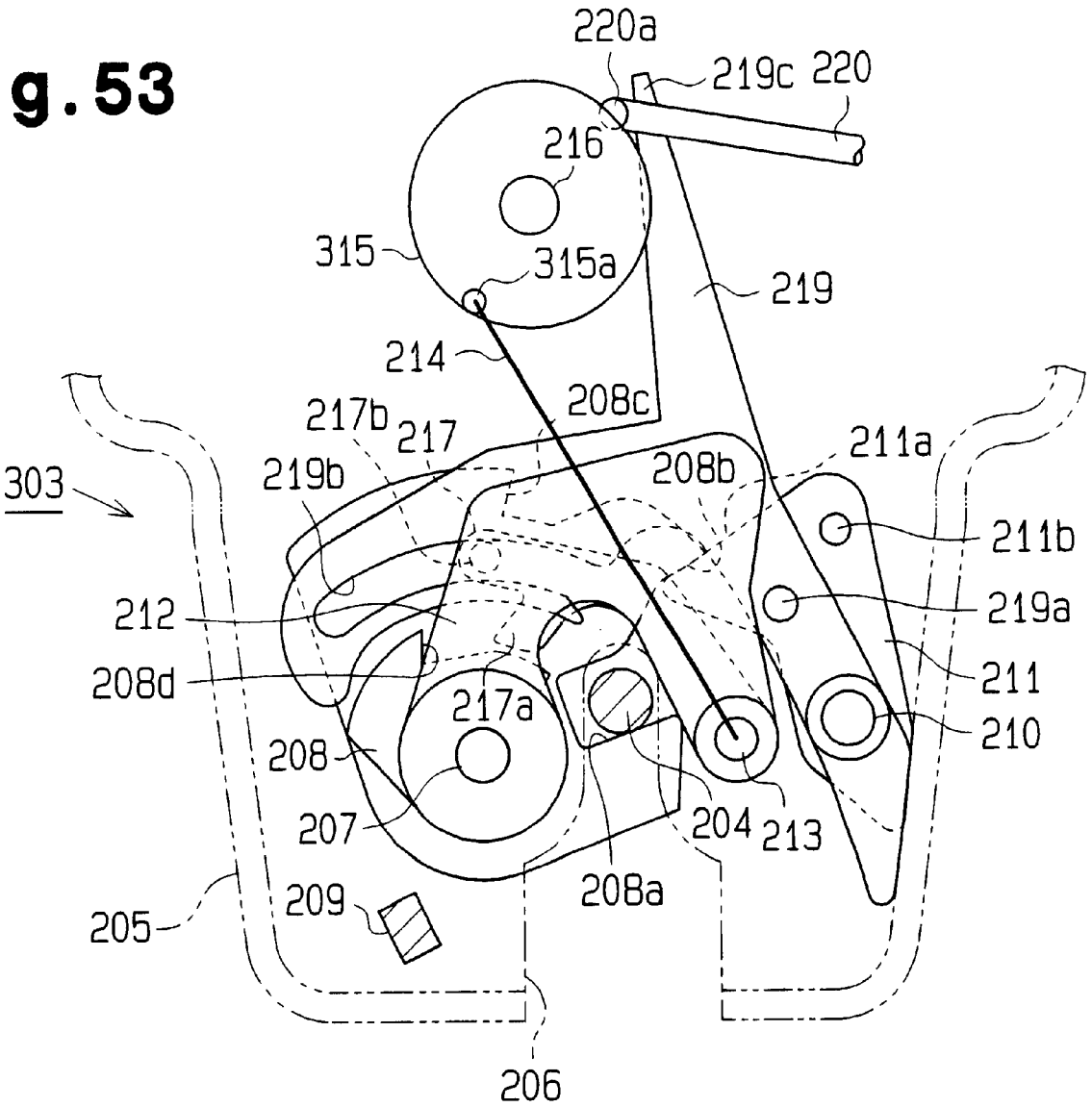

The position of the rotary body 315 shown in FIG. 50 is the initial position, and the rotary body 315 is arranged in the initial at all times when a trunk door 32 is in the open condition. Also, the position of the rotary body 315 shown in FIG. 53 is the home position, and this rotary body 315 is arranged in the home position at all times when the trunk door 32 is in the completely closed condition (full-latched status). It is to be noted that when the rotary body 315 is arranged in this position, respective positions of the rotary body 315 are detected by a microswitch, etc. not illustrated herein.

Figure 51:
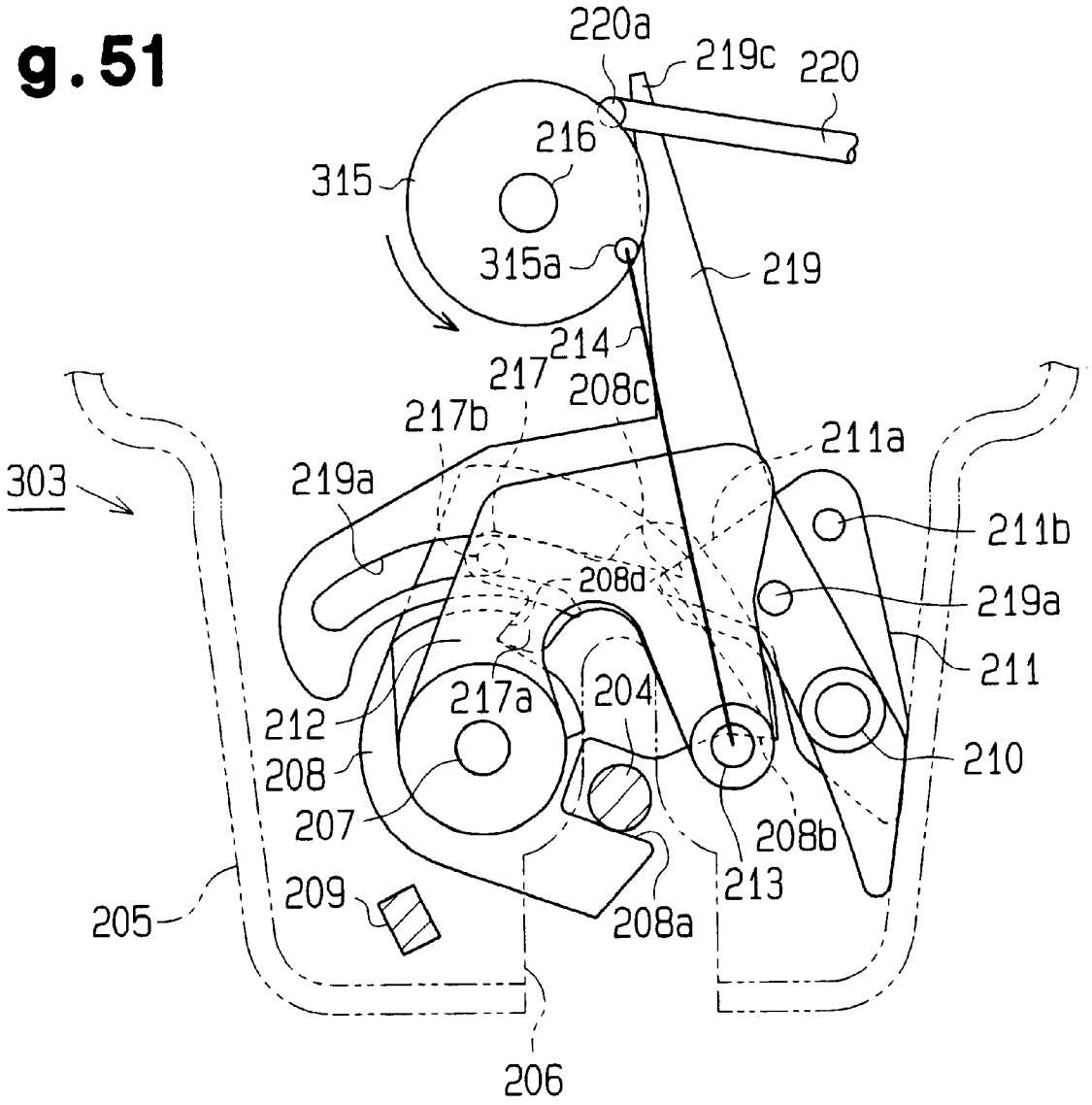
FIGS. 51 to 53 are top plan views for explaining the actions of the apparatus of FIG. 50.

When the arrangement of the above-mentioned latch 208 in the half-latch position is detected by the microswitch, etc.

not illustrated herein, the electric motor M rotates the rotary body 315 from the initial position shown in FIG. 51 to the home position shown in FIG. 53 counterclockwise. Also, as FIG. 53 indicates, when the trunk door 32 is in the completely closed condition, in response to the open instructions etc. from the driver's seat opener switch or the remote control switch (both not illustrated herein), the electric motor M rotates the rotary body 315 from the home position shown in FIG. 53 to the initial position shown in FIG. 50 counterclockwise. When the rotary body 315 is in the condition of being arranged in this position, the driving cam 212 is placed in the neutral position.

With the counterclockwise rotation of the rotary body 315 from the initial position shown in FIG. 51, the driving cam 212 linked to the link 214 via the support shaft 213 is rotated counterclockwise about the support shaft 207.

The second ratchet, 217 linked to the support shaft 213 has the engaging stopper piece 217*a*, which engages the engagement groove 208*d* of the latch 208 to force the latch 208 to rotate counterclockwise. When the rotary body 315 reaches a position shown FIG. 52, the first ratchet 211 operates so that the latch surface 211*a* thereof engages the engaging stopper surface 208*b* of the latch 208 to restrict the latch 208 to the full-latch position.

Figure 52:
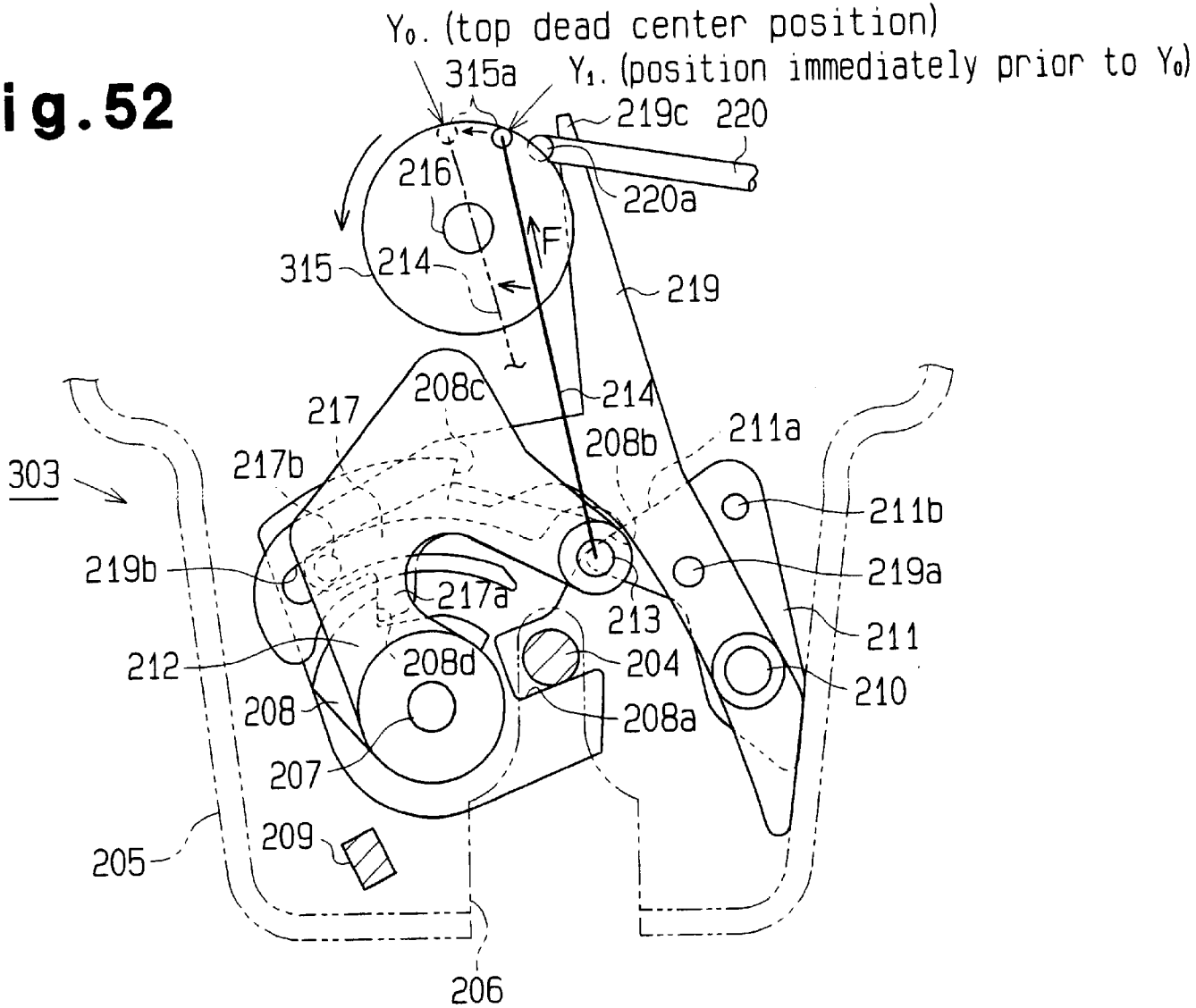

At this instant, in this embodiment, as shown in FIG. 52, length of the above-mentioned link 214 is set so that the latch 208 assumes the full-latch position when the link pin 315*a* of the rotary body 315 reaches the position Y1 immediately preceding the top dead center position Y0 which becomes the swing end position of the driving cam 212. Consequently, in the same way as the above-mentioned sixth embodiment, the torque of the motor M can be utilized efficiently and it is possible to absorb the dimensional scattering of members making up the apparatus 303.

It is also to be noted that in this embodiment, an operation detection switch 21*a* is disposed in the vicinity of the key cylinder 21. The detection switch 21*a* is designed to detected the door opening operation of the key at the key cylinder 21. When a detection is performed by the detection switch 21*a*if the rotary body 315 is not placed in the initial position, the electric motor M rotates the rotary body 315 counterclockwise so as to return the rotary body 315 to the Initial position. When a detection is performed by the detection switch 21*a*, if the rotary body 315 is placed in the initial position, the electric motor M will not be driven.

Inasmuch as operation of the closing apparatus 303 of this embodiment is approximately the same as that of the closing apparatus 101 of the foregoing fifth embodiment, detailed description of the operation will be omitted herein.

It is to be mentioned that when the power supply is resumed after the power supply to the closing apparatus 303 is cut off, an installation of a controller would be better to control the motor M so as to return automatically the rotary body 315 to a rotary position best suited to the present condition of the trunk door 32. Such arrangement would enable the condition of the trunk door 32 to match the rotary position of the rotary body 315 with certainty and alleviate a sense of incompatibility that the operator feels in regard to the door opening and closing operation.

Eighth Embodiment

Figure 54:
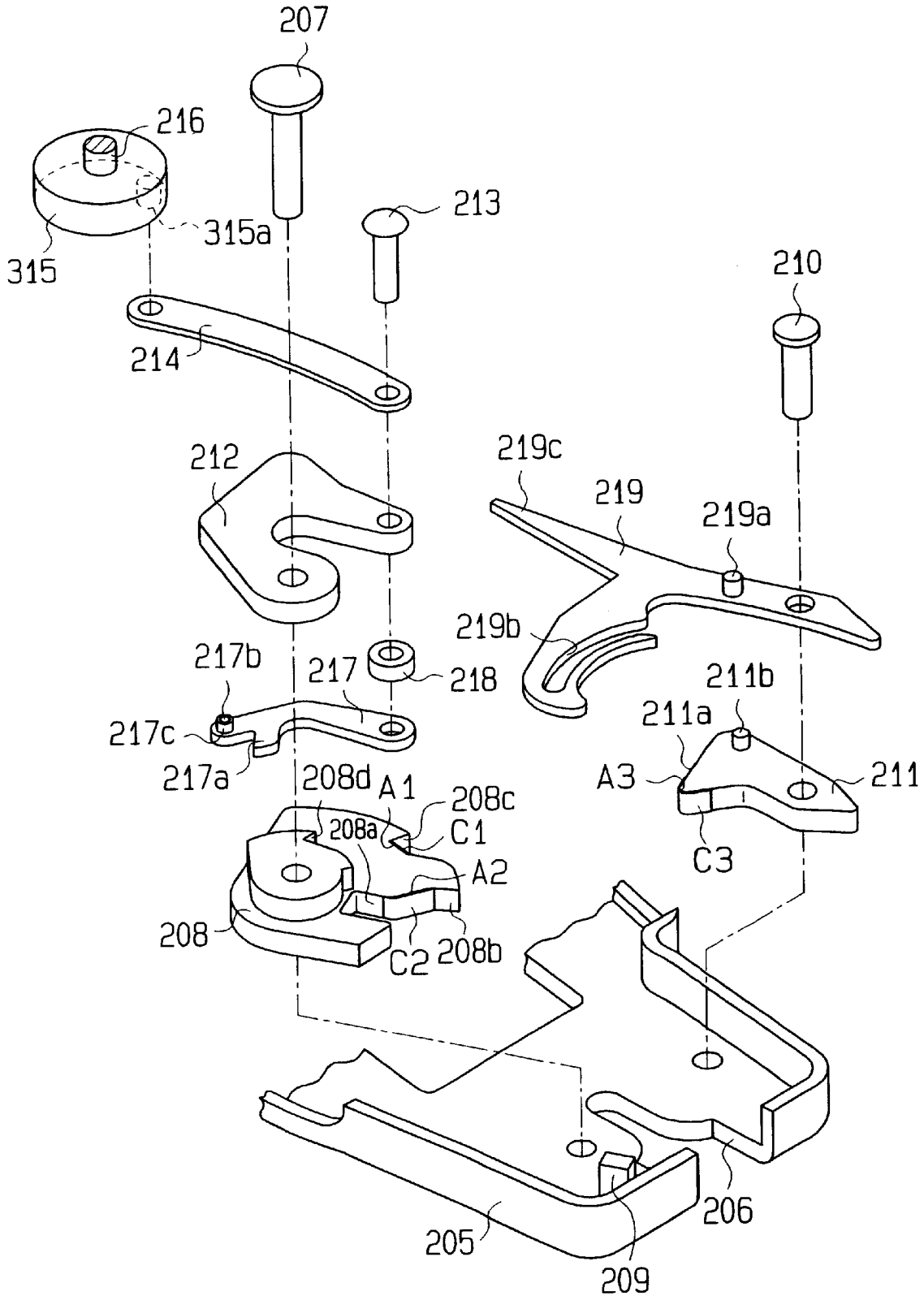
FIG. 54 is an exploded perspective view showing a closing apparatus according to an eighth embodiment of the invention.
Figure 55:
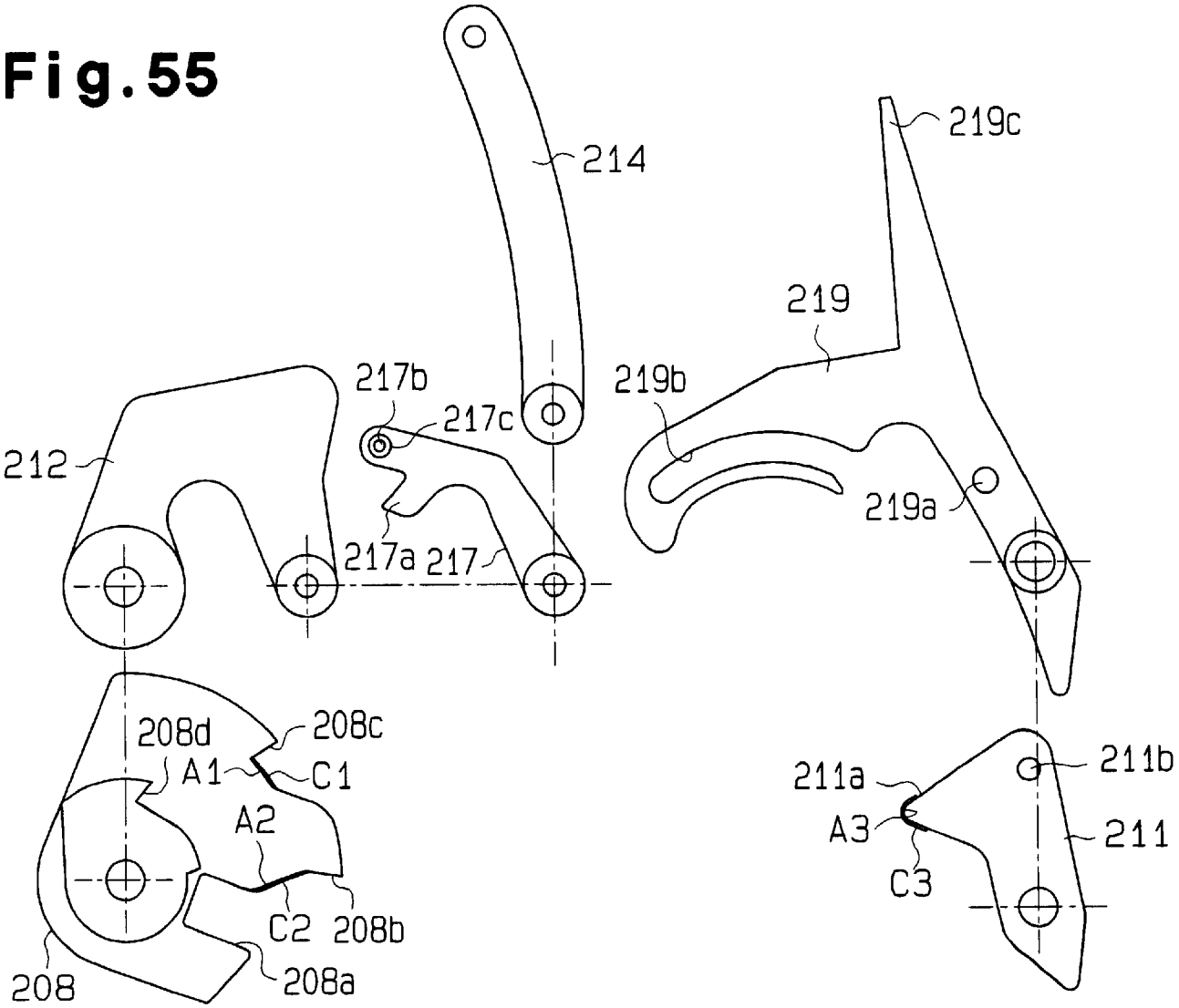
FIG. 55 is an exploded top plan view individually showing the components of the closing apparatus of FIG. 54.
Figure 56:
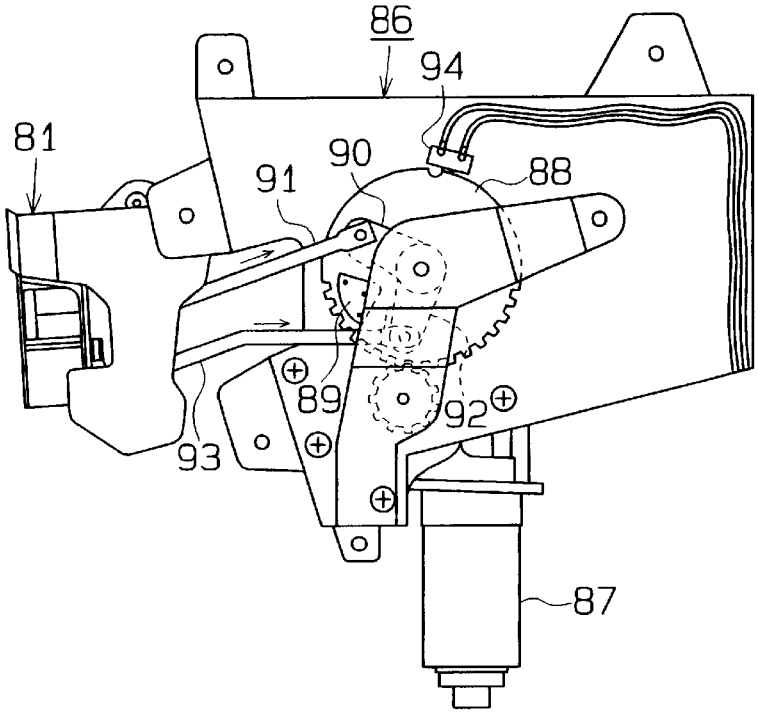
Fig.56 (Prior Art)
FIG. 56 is a side elevation of the door closing apparatus of the prior art.
Figure 57A:
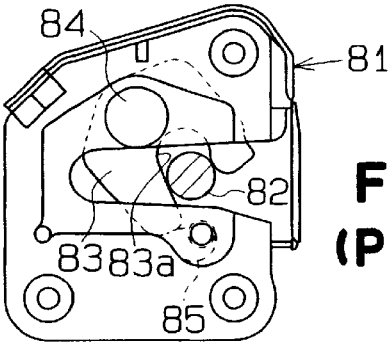
Fig.57(a) (Prior Art)
FIG. 57 presents top plan views showing the various states of the latch of the apparatus of the prior art.
Figure 57B:
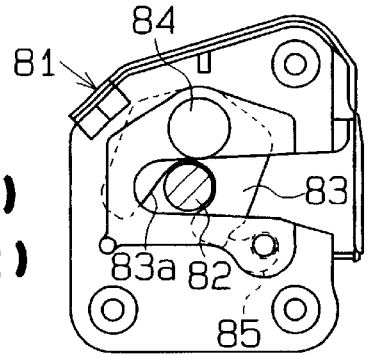
Fig.57(b) (Prior Art)
Figure 57C:
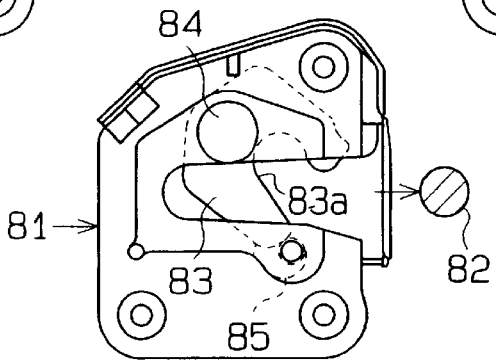
Fig.57(c) (Prior Art)

Next, in reference to FIG. 54 and FIG. 55, the eighth embodiment according to this invention will be described. In this embodiment, the latch 208 and the first ratchet 211 in the sixth and the seventh embodiments described above are made of metallic materials, and as shown in FIG. 54 and FIG. 55, resin-coated portions C1 to C3 are partially formed respectively.

The resin coated portion C1 formed on the latch 206 covers a colliding spot A1 on the outer periphery which is collided by the first ratchet 211 when the ratchet engages the engaging stopper surface 208*c* and restricts the latch 208 to the half-latch position. The resin coated portion C2 formed on the latch 208 covers a colliding spot A2 on the outer periphery which is collided by the first ratchet 211 when the ratchet engages the engaging stopper surface 208*b* and restricts the latch 208 to the full-latch position. On the other hand, the resin coated portion C3 formed on the first ratchet 211 covers a colliding spot A3 on the tip which collided by the first ratchet 211 when the ratchet engages each engaging stopper surface 205*b* and 208*c*.

These resin coated portions C1 to C3 are conducive to alleviating collision sounds generating at the time of collisions between the latch 208 and the first ratchet 211. In this case, since the resin coated portions C1 to C3 are formed on both the latch 208 and the first ratchet 211, the noise canceling effect is far greater than the case of forming the resin coated portions on one side. In addition, since the latch 208 and the first ratchet 211 having the resin coated portions C1 to C3 are formed of metallic materials deterioration of the strengths of such members will not be caused.

A further advantage is that in this embodiment, a resin washer 217*c* is attached to the engaging stopper pin 217*b* of the second ratchet 217. The resin washer 217*c* smoothly slides inside the guide groove 219*b* of the fork 219, restricting the generation of abnormal sounds at the time of sliding.

In this manner, it is possible for this embodiment to restrain abnormal sounds generating from the closing apparatus.

(1) In the above embodiment, the resin coated portions C1 to C3 are formed partially on the latch 208 and the first ratchet 211 which are made up of metallic materials. It may be pointed out that the entire latch 208 as well as the entire first ratchet 211 can be coated with resin. In this case, the latch 208 and the first ratchet 211 can be constructed of materials other than metallic materials, as long as such materials are hard enough to withstand the operation of the closing apparatus.

Furthermore, each body of the latch 208 and the first ratchet 211 may be formed of a resin material hard enough to withstand the operation of the closing apparatus. Such construction will enable a process of resin coating the latch 208 and the first hatchet 211 to be omitted.

(2) In the above-mentioned embodiment, the resin coated portions C1 to C3 were formed on the latch 208 and the first ratchet 211, but the resin coated portions may be formed on other component members making up the closing apparatus.

(3) In the above-mentioned embodiment, the resin washer 217*c* was attached to the engaging stopper pin 217*b* of the second ratchet 217, but this attachment may be waived.

What is claimed is:

1. A door member locking/unlocking apparatus comprising:

a drive source for driving an output shaft rotationally;

a latch rotatably hinged in a position to engage with a retaining portion for retaining a door member in a closed state and urged in a direction to disengage from the retaining portion;

retaining means for retaining and regulating said latch in a partially latched position and in a fully latched position;

latching means for turning said latch from the partially latched position to the fully latched position;

retention releasing means for releasing the retention of said latch in said fully latched position by said retaining means; and a cam arranged to have an axis of rotation in parallel with that of said latch and rotationally driven by the drive of said drive source for actuating said latching means and said retention releasing means.

2. The door member lockin/unlocking apparatus according to claim 1, further comprising:

wherein said drive source has said output shaft rotationally driven only in one direction; and a power transmission mechanism including a rotary member made rotatable, in one direction by the drive of said drive source, wherein said power transmission mechanism transforms the rotational motion of said rotary member into a first rocking region for actuating said latching means by said cam and a second rocking region for actuating said retention releasing means, to transmit the same to said cam.

3. The door member locking/unlocking apparatus according to claim 2, wherein said power transmission mechanism is a link mechanism.

4. The door member locking/unlocking apparatus according to claim 2, wherein said power transmission mechanism includes:

an engagement portion positioned to rotate on said rotary member; and a guide portion so positioned on said cam as to engage with said engagement portion so that it may be guided by said engagement portion.

5. The door member locking/unlocking apparatus according to claim 2, further comprising:

a first detector for detecting that said latch is in the partially latched position;

a second detector for detecting that said rotary member is in a first position for starting a rotary region in which said latching means is actuated;

a third detector for detecting that said rotary member is in a second position for starting a rotary region in which said retention releasing means is actuated;

an operation detector for detecting that an operation portion for opening said door member is operated; and a control circuit for controlling the drive of said drive source on the basis of signals coming from said individual detectors, to rotate said rotary member in a rotational range from said first position to said second position, when it is detected by said first detector that said latch is in the partially latched position, and to rotate said rotary member in a rotational range from said second position to said first position when it is detected by said operation detector that said operation portion is operated.

6. The door member locking/unlocking apparatus according to claim 5, wherein said drive source is an electric motor, and wherein said control circuit includes a brake circuit having switch means for making the two positive and negative terminals of said electric motor conductive when said electric motor is turned OFF.

7. The door member locking/unlocking apparatus according to claim 1, wherein said latch is formed to have a thickness wise two-step structure including: an engagement face to be engaged by said retaining means; and an engagement face to be engaged by said latching means.

8. The door member locking/unlocking apparatus according to claim 1, further comprising:

wherein said latching means includes second retaining means for retaining said latch; and a release mechanism for releasing said second retaining means from said latch when said latch is returned to the position to disengage from the retaining portion as a result that said retaining means is released by the action of said retention releasing means.

9. The door member locking/unlocking apparatus according to claim 8, wherein said release mechanism includes a regulating member for engaging with said second retaining means, when said cam rotates to the position to actuate said retention releasing means, to retract said second retaining means to a position where the same cannot engage with said latch.

10. The door member locking/unlocking apparatus according to claim 8, wherein said release mechanism is constructed such that when said cam rotates to a position to actuate said retention releasing means, a link composing said link mechanism engages with said second retaining means to retract the same to a position where the same cannot engage with said latch.

11. The door member locking/unlocking apparatus according to claim 1, further comprising:

a rocking member adapted to be driven by said cam or manually to actuate said retention releasing means in accordance with said drive.

12. The door member locking/unlocking apparatus according to claim 11, wherein said rocking member is borne on the same axis of rotation as that of said retaining means.

13. The door member locking/unlocking apparatus according to claim 1, wherein at least one of said latch and said retaining means is made of or coated with a resin at collision portions in which said latch and said retaining means collide against each other.

14. The door member locking/unlocking apparatus according to claim 13, wherein said latch and said retaining means, as coated with the resin, are made of a metal.

15. The door member locking/unlocking apparatus according to claim 13, wherein the bodies of said latch and said retaining means are wholly made of a resin.

16. A apparatus for locking/unlocking a door member so rotatably hinged at its base end portion to the trunk portion of a vehicle as to have an axis of rotation in parallel with the widthwise direction of said vehicle, so that it may be opened/closed on the axis of rotation, comprising:

a drive source for driving an output shaft rotationally;

a latch rotatably hinged in a position to engage with a retaining portion for retaining said door member in a closed state and urged in a direction to disengage from said retaining portion;

retaining means for retaining-and regulating said latch in a partially latched position and in a fully latched position;

latching means for turning said latch, when the same is arranged in the partially latched position, from said position to the fully latched position;

retention releasing means for releasing the retention of said latch in said fully latched position by said retaining means;

a cam arranged to have an axis of rotation in parallel with that of said latch and rationally driven by the drive of said drive source for actuating said latching means and said retention releasing means; and wherein the body of said apparatus is located either in a center position of the transverse width at the leading end portion of said door member or in the body of said vehicle corresponding to said center position.

17. The door member locking/unlocking apparatus according to claim 16, wherein said latch has a pin arranged normal to either said door member or the outer panel of the body of said vehicle.

18. The door member locking/unlocking apparatus according to claim 17, wherein said latch is arranged close to either said door member or the outer panel of the body of said vehicle.

19. A door member locking/unlocking apparatus comprising:

a drive source for driving an output shaft rotationally;

a latch rotatably hinged in a position to engage with a retaining portion for retaining a door member in a closed state and urged in a direction to disengage from said retaining portion;

retaining means for retaining and regulating said latch in a partially latched position and in a fully latched position;

latching means for turning said latch, when the same is arranged in the partially latched position, from said position to the fully latched position;

retention releasing means for releasing, the retention of said latch in said fully latched position by said retaining means;

a cam arranged to have an axis of rotation in parallel with that of said latch and rotationally driven by the drive of said drive source for actuating said latching means and said retention releasing means; and a link mechanism including a rotary member for rotating on the basis of the rotational drive of said drive source, wherein said link mechanism transforms the rotational motion of said rotary member into a rocking motion of said cam to actuate said latching means and said retention releasing means, and wherein said link mechanism sets said latch to the fully latched position through said latching means when said rotary member reaches a position between a top dead center providing the rocking end position of said cam and a position immediately short of said top dead center.

20. The door member locking/unlocking apparatus according to claim 19, wherein said link mechanism sets said latch to the fully latched position through said latching means when said rotary member reaches the top dead center providing the locking end position of said cam.

21. A door member locking/unlocking apparatus comprising:

a drive source for driving an output shaft rotationally forward and backward;

a latch rotatably hinged in a position to engage with a retaining portion for retaining a door member in a closed state and urged in a direction to disengage from said retaining portion;

retaining means for retaining and regulating said latch in a partially latched position and in a fully latched position;

latching means for turning said latch, when the same is arranged in the partially latched position, from said position to the fully latched position;

retention releasing means for releasing the retention of said latch in said fully latched position by said retaining means;

a cam arranged to have an axis of rotation in parallel with that of said latch and rotationally driven by the drive of said drive source for actuating said latching means and said retention releasing means;

a link mechanism including a rotary member for rocking on the basis of the forward and backward rotations of said output shaft of said drive source, wherein said link mechanism transmits the rocking motion of said rotary member as that of said cam to actuate said latching means and said retention releasing means;

partially latched position detecting means for detecting that said latch is regulated to the partially latched position;

fully latched position detecting means for detecting that said latch is regulated to the fully latched position;

control means for causing said drive source to rotate forward thereby to actuate said latching means when said partially latched position detecting means detects that said latch is regulated to the partially latched position, and for causing said drive source to rotate backward thereby to stop any further rotation of said latch by the latching action of said latching means on the basis of the detection of said fully latched position detecting means when said latch reaches the fully latched position and is regulated to the same position.

22. The door member locking/unlocking apparatus according to claim 21, wherein said link mechanism sets said latch to the fully latched position through said latching means when said rotary member reaches a position between a top dead center providing the rocking end position of said cam and a position immediately short of said top dead center.

* * * * *